US008931317B2

(12) United States Patent
Ikeda

(10) Patent No.: US 8,931,317 B2
(45) Date of Patent: Jan. 13, 2015

(54) BENDING METHOD AND MACHINE THEREOF

(75) Inventor: Hidekatsu Ikeda, Kanagawa (JP)

(73) Assignee: Amada Co., Ltd., Kanagawa (JP)

( * ) Notice: Subject to any disclaimer, the term of this patent is extended or adjusted under 35 U.S.C. 154(b) by 1634 days.

(21) Appl. No.: 11/576,735

(22) PCT Filed: Sep. 27, 2005

(86) PCT No.: PCT/JP2005/018253

§ 371 (c)(1),
(2), (4) Date: Jul. 19, 2007

(87) PCT Pub. No.: WO2006/043408

PCT Pub. Date: Apr. 27, 2006

(65) Prior Publication Data

US 2008/0066510 A1 Mar. 20, 2008

(30) Foreign Application Priority Data

Oct. 22, 2004 (JP) ..... 2004-307854
Feb. 8, 2005 (JP) ..... 2005-032383
Sep. 9, 2005 (JP) ..... 2005-262148

(51) Int. Cl.

*B21C 51/00* (2006.01)
*B21D 55/00* (2006.01)
*B21D 31/00* (2006.01)
*B21D 5/02* (2006.01)

(52) U.S. Cl.

CPC ..... *B21D 5/0281* (2013.01); *B21D 5/02* (2013.01)
USPC ..... 72/18.2; 72/31.11; 72/389.3

(58) Field of Classification Search

CPC ..... B21D 5/02; B21D 5/0209; B21D 5/0281; B21D 11/22; B21D 43/003; B21D 43/26
USPC ..... 72/16.2, 16.4, 17.1, 17.2, 18.1, 18.2, 72/18.9, 20.1, 31.1, 31.11, 389.3, 389.4, 72/16.7, 18.5, 19.4
See application file for complete search history.

(56) References Cited

U.S. PATENT DOCUMENTS 4,148,203 A * 4/1979 Farazandeh et al. ..... 72/17.2
4,706,491 A * 11/1987 Sartorio ..... 72/16.7
5,182,936 A * 2/1993 Sartorio ..... 72/420
5,761,940 A * 6/1998 Moore et al. ..... 72/19.4
7,007,530 B2 3/2006 Koyama et al.

(Continued)

FOREIGN PATENT DOCUMENTS

JP 4-047818 4/1992
JP 5-007938 1/1993

(Continued)

OTHER PUBLICATIONS

English Language Abstract of JP 2004-017072.
English Language Abstract of JP 5-007938.
English Language Abstract of WO 2006/043408.

*Primary Examiner* — Teresa M Ekiert
(74) *Attorney, Agent, or Firm* — Greenblum & Bernstein, P.L.C.

(57) ABSTRACT

In a bending machine, there is provided at one back gauge abutting part (5) a plurality of contact confirmation sensors for confirming the contact thereof with a workpiece; and there is included control means driving a ram (1) on the conditions of ON of all the sensors automatically or manually specified among these contact confirmation sensors and ON of a foot pedal (6) when the workpiece is abutted.

10 Claims, 35 Drawing Sheets

(56) References Cited

U.S. PATENT DOCUMENTS

| | | | | |
|---|---|---|---|---|
| 2002/0092333 | A1* | 7/2002 | Lindstrom | 72/19.4 |
| 2003/0015012 | A1* | 1/2003 | Nagakura | 72/31.11 |
| 2006/0162408 | A1 | 7/2006 | Niwa et al. | |

FOREIGN PATENT DOCUMENTS

| | | |
|---|---|---|
| JP | 2004-017072 | 1/2004 |
| JP | 2006-130508 | 5/2006 |

* cited by examiner

FIG.8

| BENDING PROCESS | LEFT-SIDE ABUTTING PART | | | | | RIGHT-SIDE ABUTTING PART | | | | |
|---|---|---|---|---|---|---|---|---|---|---|
| | $S_1$ | $S_2$ | $S_3$ | $S_4$ | $S_5$ | $S_1$ | $S_2$ | $S_3$ | $S_4$ | $S_5$ |
| 1 | ○ | ○ | ○ | ○ | ○ | ○ | ○ | ○ | ○ | ○ |
| 2 | ／ | ○ | ○ | ／ | ／ | ／ | ／ | ／ | ○ | ○ |
| ・・・・ | ・・・・ | ・・・・ | ・・・・ | ・・・・ | ・・・・ | ・・・・ | ・・・・ | ・・・・ | ・・・・ | ・・・・ |
| n | ・・ | ・・ | ・・ | ・・ | ・・ | ・・ | ・・ | ・・ | ・・ | ・・ |

FIG.24

| BENDING PROCESS \ PUSH BUTTON SWITCH | ONE RESPECTIVELY AT LEFT AND RIGHT | ANY TWO | ANY ONE |
|---|---|---|---|
| 1 | ○ | | |
| 2 | | ○ | |
| 3 | | | ○ |
| ..... | ..... | ..... | ..... |
| n | | | |

FIG.29

(A) NUMBER INPUT TYPE

| BENDING PROCESS | SELECTED AND SPECIFIED CONTACT CONFIRMATION SENSOR |
|---|---|
| 1 | 1 |
| 2 | 3 |
| 3 | 2 |
| ⋮ | ⋮ |

(B) ARRANGEMENT SPECIFYING TYPE

| BENDING PROCESS | SELECTED AND SPECIFIED CONTACT CONFIRMATION SENSOR |
|---|---|
| 1 | 1 0 0 0 0 0 0 0 0 0 1 |
| 2 | 1 1 0 0 0 0 0 0 1 1 |
| 3 | 0 1 1 0 0 0 0 1 1 0 |
| ⋮ | ⋮ |

BENDING METHOD AND MACHINE THEREOF

TECHNICAL FIELD

The present invention relates to a bending method and a machine thereof in the case where there are provided at a back gauge abutting part a contact confirmation sensor for confirming the contact thereof with a workpiece.

BACKGROUND ART (1) First Problem

Conventionally, there has been provided in a press brake a workpiece positioning device as disclosed in, for example, Japanese Patent Application Laid-Open No. 5-7938, and this workpiece positioning device includes a sensor at the central portion on the abutting face of a back gauge and an electromagnet on both sides of this abutting face.

Owing to such construction, when a workpiece is abutted against mentioned sensor, by the electromagnets being excited, this workpiece is sucked and secured, thereafter when a ram is driven, thus a punch and a die come close to each other, and the punch is contacted with the workpiece (pinching point), the electromagnets are demagnetized to release the workpiece, and then this workpiece is subjected to a predetermined machining with the punch and the die.

Recently, job shop type production becomes mainstream, and the shape of a workpiece comes to be more complicated as well, therefore the shape of an abutting part of the workpiece with respect to a back gauge also comes to differ from each other in each bending process.

In mentioned conventional art, however, there is provided at the back gauge abutting part only one sensor, accordingly, for example, even if a workpiece is abutted against the back gauge with being slanted, the sensor is ON, thus to be regarded as in the suitable contact state.

As a result, due to that a workpiece is machined with being slanted, a defective product is produced, so that machining needs to be done again, and thus the efficiency of machining is extremely reduced and decreased.

Furthermore, to improve the efficiency of machining, there are some cases where a workpiece is abutted against a back gauge in the state in which the blade space between a punch and a die is made smaller.

However, owing to a small space between the blades, in mentioned conventional art, the contact state of a workpiece with respect to the back gauge cannot be visually observed by an operator, accordingly, the ON/OFF state of a sensor cannot be determined, and thus the contact state has to be determined only with the feel of hands, resulting in an extremely large burden of the operator.

(2) Second Problem

To solve such problem, the present application (in particular, Japanese Patent Application No. 2004-307854, applied on Oct. 22, 2004, which is one of three Japanese patent application of which the present application claims priority, and matured as U.S. Pat. No. 3,668,895 registered on Apr. 22, 2005) proposes a bending method and a machine thereof. However, at the time of pull back after a workpiece has been positioned, the misregistration of the workpiece may occur.

That is, as illustrated in FIG. 20, normally, after a workpiece W has been abutted against a back gauge abutting part 50 (FIG. 20 (A-1)) to be positioned, a ram is driven, when a punch (FIG. 20 (A-2)) has reached a pinching point PP, and this punch P is abutted against the workpiece W, and this workpiece W is clamped with the punch P and the die D.

In this state, the abutting part 50, to prevent interference accompanied by jumping of a workpiece W, is reversed (pull back), and by continuing to drive the ram, the workpiece W is bent with the punch P (FIG. 20 (A-3)) and the die D.

However, there is an error between an actual plate thickness t of a workpiece (FIG. 20 (B-1)) and a nominal plate thickness, for example, on the supposition of a thin plate thickness t, at a pinching point PP having been set (FIG. 20 (B-2)), the punch P is not abutted against the workpiece W, to be in the unclamped state.

Accordingly, when the abutting part 50 is reversed at the time of pull back, due to that an operator normally pushes the workpiece W to the abutting part 50, so that the workpiece W is reversed accompanied with the reverse of this abutting part 50 (FIG. 20(B-3)), and a bend line m is misaligned with the tip of the punch P, resulting in the occurrence of misregistration.

As a result, even if machining is made in the state of misregistration occurring (FIG. 20 (B-4)), the dimension H' of a flange F to be formed will differ from the original dimension H, due to production of a detective product, machining has to be made again, thus leading to waste materials and increase of the cost of materials; as well as inspection processes after machining come to be necessary, an inspection time becomes longer, and thus, also in this respect, the efficiency of machining is extremely lowered.

Furthermore, since inspection processes after machining are required, the time of making discrimination between non-defective products and defective products is delayed, whereby the time of delivering non-defective products to intended destinations is delayed, and thus also at this point, resultingly, the entire efficiency of machining from the start of machining to the end thereof is reduced.

In addition, the present application (in particular, the above-mentioned JP 3,668,895) further proposes a bending machine provided with a plurality of contact confirmation sensors at one back gauge abutting part, which solves the mentioned initial problems (FIGS. 1 to 11 of the present application).

(3) Third Problem

According to this bending machine, the contact confirmation sensor that has to be ON in the case where a workpiece abutting part is suitably abutted against a back gauge abutting part has preliminarily been selected and specified, on the conditions of ON of this contact confirmation sensor having preliminarily been selected and specified, and ON of a foot pedal, a ram is driven, and a workpiece will be bent.

In the bending machine disclosed in mentioned U.S. Pat. No. 3,668,895, however, conventionally, there is no means with which an operator easily can select and specify the already-described contact confirmation sensor that has to be ON.

Consequently, like this, an operation panel with which an operator can easily make selection and specification has been desired to obtain.

(4) Fourth problem

Furthermore, the already-described conventional contact confirmation sensor is provided at a back gauge abutting part, and functions effectively in the case where a workpiece is abutted against the abutting face of the back gauge abutting part (FIG. 3 of mentioned U.S. Pat. No. 3,668,895 (FIG. 3 of the present application).

However, in the case where there is provided a workpiece support 3 for preventing this workpiece from being hung down when the workpiece is abutted (FIG. 34(A) of the present application), when the workpiece is abutted against this workpiece support 3 and has to be positioned (FIG. 34(B)

of the present application), no conventional contact confirmation sensor effectively functions mechanically.

Consequently, a contact confirmation sensor effectively functioning even in the case where a workpiece is abutted against the workpiece support to be positioned has been desired to obtain.

Accordingly, a first object of the present invention is to provide a bending method and a machine thereof with which even if an abutting part of a workpiece with respect to a back gauge has any shape, by determination of whether or not this workpiece abutting part is suitably abutted against the back gauge abutting part, production of a defective product is prevented, thus the efficiency of machining is improved, as well as the burden of an operator is reduced.

Furthermore, a second object of the present invention is provide a bending method and a machine thereof with which by detection of defective products and non-defective products at the beginning, waste materials are eliminated to decrease the cost of materials, and inspection processes after machining are omitted to shorten an inspection time, as well as the appointed date of delivery of non-defective products is made earlier, thus resulting in improvement in the entire efficiency of machining.

Moreover, a third object of the present invention is to provide a bending machine including an operation panel with which in a bending machine provided with a plurality of contact confirmation sensors at one back gauge abutting part, the contact confirmation sensor that has to be ON in the case where a workpiece abutting part is suitably abutted against a back gauge abutting part can be easily selected and specified.

In addition, a fourth object of the present invention is to provide a bending machine including a contact confirmation sensor effectively functioning even in the case where in a bending machine provided with a plurality of contact confirmation sensors at one back gauge abutting part, a workpiece is abutted against a workpiece support to be positioned.

DISCLOSURE OF THE INVENTION

To solve the above-mentioned first problem, the present invention, provides a bending method in which based on a product information J, in each bending process 1, 2 . . . , after a die, a die layout, a position of a workpiece W, a position of a back gauge 7, and a shape of an abutting part of the workpiece W with respect to the back gauge 7 has been determined, based on the contact state between this workpiece abutting part and a back gauge abutting part 5, a contact confirmation sensor that has to be ON when a workpiece is abutted is determined among contact confirmation sensors $S_1$, $S_2$, $S_3$, $S_4$, $S_5$ provided in plural at one back gauge abutting part 5, on the conditions of ON of all these contact confirmation sensors having been determined and ON of a foot pedal 6, and a ram 1 is driven to make bending of the workpiece W; and a bending machine in which there are provided at one back gauge abutting part 5 a plurality of contact confirmation sensors $S_1$, $S_2$, $S_3$, $S_4$, $S_5$ for confirming the contact thereof with a workpiece W, and there is included control means driving a rain on the conditions of ON of all the sensors having been automatically or manually specified among these contact confirmation sensors $S_1$, $S_2$, $S_3$, $S_4$, $S_5$ and ON of a foot pedal 6 when the workpiece is abutted.

According to construction of the above-mentioned first invention of the present invention, due to that there are provided at one back gauge abutting part 5 (FIG. 2) a plurality of contact confirmation sensors $S_1$ to $S_5$, actually when a workpiece W is abutted (Step 108 of FIG. 11), unless all the corresponding contact confirmation sensors are ON (YES of Step 109 of FIG. 11), as well as the foot pedal 6 is ON (YES in Step 110 of FIG. 11), the ram 1 is not lowered, so that there will be no such harmful effect that a workpiece W is bent with in a slanted state to produce a defective product, and then to repeat machining multiple times, thus improving the efficiency of machining.

Furthermore, actually when a workpiece is abutted (Step 108 of FIG. 11), only by an operator S (FIG. 1) abutting the workpiece W against the back gauge 7 and the side gauge 8 (FIG. 2), with all the corresponding contact confirmation sensors ON (YES in Step 109 of FIG. 11), a workpiece abutting part is abutted suitably against a back gauge abutting part, so that even if the space between the blades of a punch P and a die D is small, such a troublesome operation as an operator S determines the contact state of a workpiece W with respect to the back gauge 7 only with the feel of hands will be unnecessary, thus reducing the burden of this operator S.

Whereby, according to the first invention of the present invention, provided can be a bending method and a machine thereof with which even if an abutting part of a workpiece with respect to a back gauge has any shape, by determination of whether or not this workpiece abutting part is abutted suitably against the back gauge abutting part, production of a defective product is prevented, the efficiency of machining is improved, as well as the burden of an operator is reduced.

Furthermore, according to the first invention of the present invention, based on a product information J, in each bending process, the shape of an abutting part of a workpiece W with respect to the back gauge 7 is determined (flowchart), the contact confirmation sensor necessary for determining whether or not this workpiece abutting part is suitably abutted against the back gauge abutting part 5 is automatically determined via, for example, contact confirmation sensor determining means 24E of NC device 24 (FIG. 1), so that the bending method and the machine thereof according to the present invention can be used by any operator S, not depending on the proficiency of the operator S, as well as without no increase of the number of set-up processes.

In addition, according to the first invention of the present invention, due to that there are provided the stroke enlarging levers $E_1$ to $E_5$ between the workpiece-abutting parts $C_1$ to $C_5$ and micro switches $M_1$ to $M_5$ that form a plurality of contact confirmation sensors $S_1$ to $S_5$ at mentioned one back gauge abutting part 5 (FIG. 3), for example, as compared with the stroke Y2 of the push button $M_{5a}$ of the micro switch $M_5$ (FIG. 5), the stroke Y1 of the workpiece-abutting part $C_5$ can be made smaller, so that the amount of the workpiece-abutting parts $C_1$ to $C_5$ protruding from the abutting face 5A (FIG. 3) of this back gauge abutting part 5 can be made small, resulting in reduction in the burden of an operator when the workpiece is abutted; as well as, supposing that a workpiece W having been contacted with the back gauge 7 is spaced apart from the abutting part 5 to return forward (the operator side), the workpiece-abutting parts $C_1$ to $C_5$ having a smaller stroke Y1 (FIG. 5) are also returned forward, whereby the push button having a larger stroke Y2 is moved in the same direction to return to the original position, and the micro switches $M_1$ to $M_5$ having been once ON are immediately brought in OFF, so that machining can be stopped at this time point, and thus the production of a defective product is prevented.

Furthermore, according to the first invention of the present invention, there are provided at the back gauge abutting part 5 (FIG. 3) only the contact confirmation sensors $S_1$ to $S_5$, and a conventional workpiece securing means (electromagnet) becomes unnecessary, so that the construction of a back gauge abutting part 5 comes to be extremely simple, and accompanied thereby, costs are decreased.

Moreover, to solve the above-mentioned second problem, the present invention, provides a bending method in which after a workpiece W has been positioned, when a back gauge abutting part 5 is reversed after a punch P has been contacted with the workpiece W, in the case where a contact confirmation sensor $S_1$, $S_2$, $S_3$, $S_4$, $S_5$ provided at a back gauge abutting part 5 is ON, a defective signal A informing the production of a defective product based on a misregistration of the workpiece W is output, and in the case where this contact confirmation sensor $S_1$, $S_2$, $S_3$, $S_4$, $S_5$ is OFF, a non-defective signal informing the production of a non-defective product is output; and a bending machine in which there is provided at a back gauge abutting part 5 a contact confirmation sensor $S_1$, $S_2$, $S_3$, $S_4$, $S_5$ for confirming the contact thereof with a workpiece W; and there is included control means, when a back gauge abutting part 5 is reversed after a punch P has been contacted with the workpiece W after positioning of the workpiece W, outputting a defective signal A informing the production of a defective product based on a misregistration of the workpiece in the case where a contact confirmation sensor $S_1$, $S_2$, $S_3$, $S_4$, $S_5$ is ON, and outputting a non-defective signal B informing the production of a non-defective product in the case where this contact confirmation sensor $S_1$, $S_2$, $S_3$, $S_4$, $S_5$ is OFF.

According to the above-mentioned second invention of the present invention, after a pinching point at which a punch P is contacted with a workpiece W, when the back gauge abutting part 5 is reversed (Step 114 of FIG. 18), by determination of the ON/OFF state of the contact confirmation sensor (Step 115 of FIG. 18), in the case of ON (YES), a defective signal A is output (Step 116 of FIG. 18), and in the case of OFF (NO), a non-defective signal B is output, so that an operator can find at the beginning a defective product and a non-defective product.

Consequently, there will be no such harmful effect that machining is made (FIG. 20 (B-4)) with the misregistration of a workpiece W occurring (FIG. 20 (B-3)), and thus material waste is eliminated, thereby enabling to reduce the cost of materials, and enabling to omit inspection processes after machining, so that an inspection time is shortened, as well as associated with that inspection processes after machining can be omitted, defective products and non-defective products can be divided and stored in a storage shelf, so that an appointed date of delivery of non-defective products can be made earlier, whereby the entire efficiency of machining will be improved.

Whereby, according to the second invention of the present invention, provided can be a bending method and a machine thereof with which by detection of defective products and non-defective products at the beginning, material waste is eliminated to decrease the cost of materials, and inspection processes after machining are omitted to shorten an inspection time, as well as the appointed date of delivery of non-defective products is made earlier, thus improving the entire efficiency of machining.

In addition, to solve the above-mentioned third problem, the present invention, provides a bending machine including an operation panel 20 formed of a push button switch 20A, 20B, 20C, 20D with which a contact confirmation sensor necessary for confirming the suitable contact state between a workpiece abutting part and a back gauge abutting part 5 is selected and specified among the contact confirmation sensors $S_1$, $S_2$, $S_3$, $S_4$, $S_5$ provided in plural at one back gauge abutting part 5 after a die, a die layout, a position of a workpiece, and a position of a back gauge has been determined in each bending process based on a product information.

According to construction of the above-mentioned third invention of the present invention, at the operation panel 20 constructed of a touch panel (FIG. 23), for example, of a total of ten contact confirmation sensors, five at each of the back gauge abutting parts 5 at left and right (FIG. 22), as a push button switch with which the contact confirmation sensor necessary for confirming the suitable contact state is selected and specified, there are provided "one respectively at left and right" push button switch 20B of selecting and specifying not less than one contact confirmation sensor from each five contact confirmation sensors at left and right (FIG. 23), "any two" push button switch 20C of selecting and specifying any not less than two of a total of ten contact confirmation sensors, and "any one" push button switch 20D of selecting and specifying any not less than one of a total of ten contact confirmation sensors.

Whereby, according to the third invention of the present invention, by an operator having preliminarily pressed mentioned "one respectively at left and right" push button switch 20B, "any tow" push button switch 20C, or "any one" push button switch 20D before machining, supposing that the contact confirmation sensor that has to be ON when a workpiece is abutted has preliminarily been selected and specified in each bending process before machining (Step 203 of FIG. 30), at the time of actual machining, a workpiece is abutted (Step 207 of FIG. 30), in the case where the above-mentioned selected and specified contact confirmation sensor is ON (YES in Step 208 of FIG. 30), depending on the kind of mentioned push button switch having been pressed before machining (Step 208A of FIG. 31 showing details of Step 208 of FIG. 30), NC device (illustration is omitted) makes determination of which contact confirmation sensor has to be ON (YES in Step 208B, YES in Step 208C, or YES in Step 208D of FIG. 31) when a workpiece abutting part is abutted suitably against a back gauge abutting part, upon ON of the foot pedal 6 (FIG. 21) (YES in Step 209 of FIG. 30), and lowers the ram 1 (FIG. 21) and makes machining; so that an operator needs not to select and specify individual contact confirmation sensors, thus enabling to shorten a time period for selection and specification, and an operator, in the case where the workpiece abutting part is suitably abutted against the back gauge abutting part, can easily select and specify the contact confirmation sensor positioned at this contact point.

Furthermore, to solve the above-mentioned fourth problem, the present invention, provides a bending machine including a contact confirmation sensor $S_1$, $S_2$, $S_3$ comprising: a workpiece support 3 provided at a back gauge abutting part 5; a pin member 4A to 4C contained in this workpiece support 3; a swing member 15A to 15C abutted against this pin member 4A to 4C, as well as disposed in a swingable manner at the back gauge abutting part 5; a stroke enlarging lever $E_1$ to $E_3$ enlarging the stroke of this swing member 15A to 15C by a predetermined amount; and a micro switch $M_1$ to $M_3$ brought in ON when a push button $M_{1a}$ to $M_{3a}$ is pressed and moved by a stroke enlarged by this stroke enlarging lever $E_1$ to $E_3$.

According to construction of the above-mentioned fourth invention of the present invention, due to that the pin members 4A to 4C are contained in the workpiece support 3 disposed at the back gauge abutting part 5 (FIG. 32), for example, in the case of a short workpiece abutting part F (FIG. 34(B)), a workpiece W is abutted against the workpiece support 3 to be positioned, so that when, for example, the pin member 4C contained in this workpiece support 3 is pressed (FIG. 35 (B)), the L-shaped stroke enlarging lever $E_3$ (FIG. 35(A)) is pivoted in the counterclockwise direction in a horizontal plane via the swing member 15C and the bolt 19, so that the push button $M_{3u}$ disposed on the side of the micro switch $M_3$ is pressed, whereby this micro switch $M_3$ will be ON.

Whereby, according to the fourth invention of the present invention, even in the case where a workpiece is abutted against the workpiece support to be positioned (FIG. 34(B)), the contact confirmation sensor $S_1$, $S_2$, $S_3$ provided at the back gauge abutting part 5 (FIG. 32, FIG. 33) functions effectively.

BRIEF DESCRIPTION OF THE DRAWINGS

FIG. 8 is a chart indicating the relation between each bending process and a contact confirmation sensor that has to be ON when a workpiece is abutted according to the first invention.

FIG. 24 is a chart indicating the relation between each bending process and a push button switch selected and specified according to the third invention.

FIG. 29 are charts indicating examples in which a contact confirmation sensor is selected and specified using a conventional operation panel 20B according to the third invention.

BEST MODES FOR CARRYING OUT THE INVENTION

Hereinafter, the present invention is described referring to the accompanying drawings with exemplary embodiments.

A. First Invention

Figure 1:
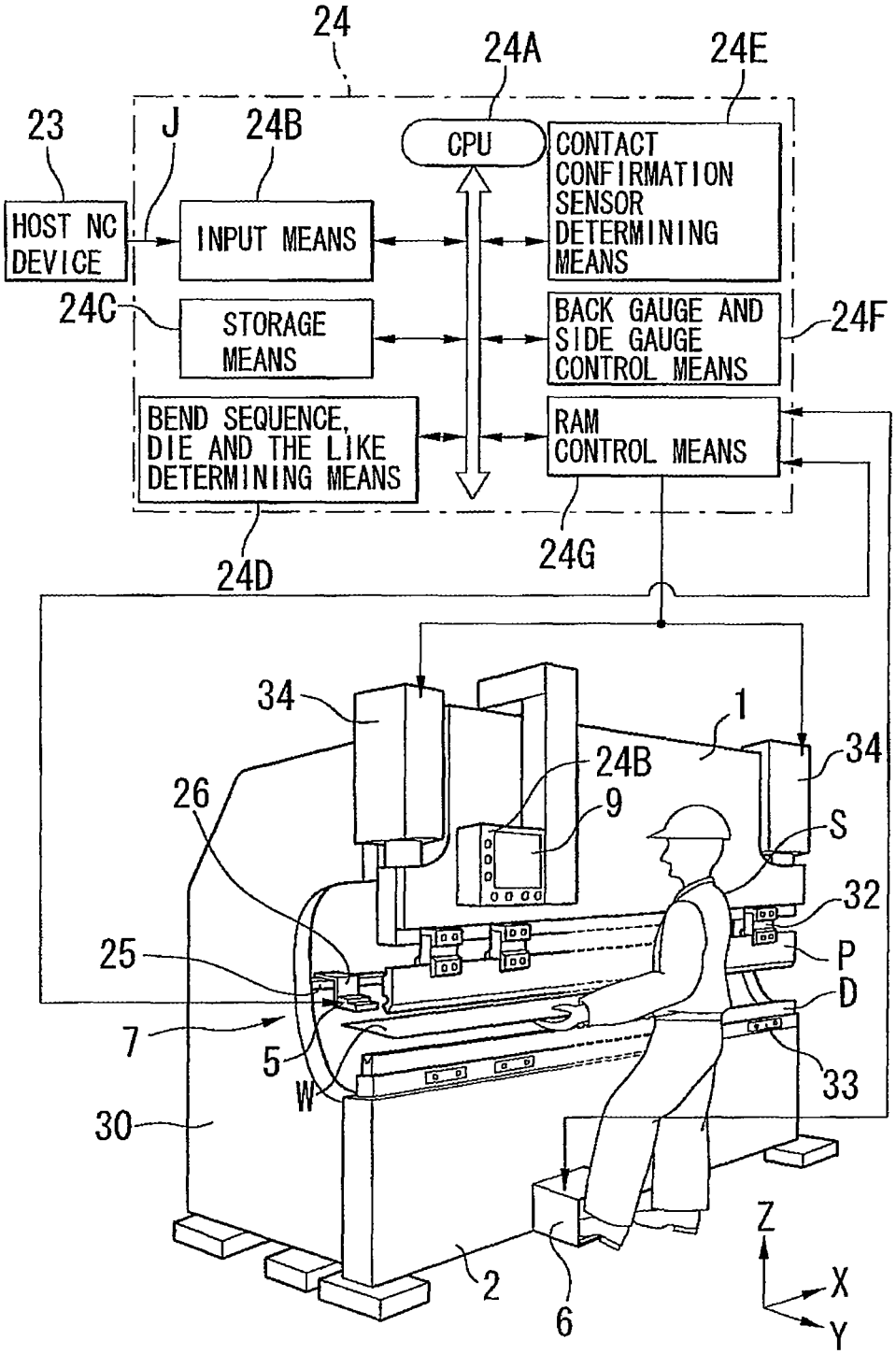
FIG. 1 is an entire view illustrating an exemplary embodiment of a first invention.

FIG. 1 is a view illustrating an exemplary embodiment of a first invention according to the present invention, and a bending machine illustrated is, for example, a press brake.

This press brake includes side plates 30 on both sides of a machine main body, an upper table 1, being a ram is attached to the upper portion of these side plates 30 via, for example, an oil hydraulic cylinder 34, and a punch P is attached to this upper table 1 via an intermediate plate 32.

Furthermore, a lower table 2 is disposed at the lower portion of the side plates 30, and a die D is attached to this lower table 2 via a holding plate 33, as well as a side gauge 8 (FIG. 2) is provided movably in the lateral direction (X-axis direction), functioning to position the lateral position of a workpiece W.

That is the bending machine illustrated in FIG. 1 is a lifting-down press brake, in which after a workpiece W has been abutted against the below-described back gauge 7 disposed behind the lower table 2 and mentioned side gauge 8 (Step 108 of FIG. 11), when all corresponding contact confirmation sensors are ON (YES in Step 109 of FIG. 11) as well as a foot pedal 6 is ON (YES in Step 110 of FIG. 11), supposing that the oil hydraulic cylinder 34 is operated via a ram control means 24G (FIG. 1) to lower the ram 1 (Step 111 of FIG. 11), mentioned workpiece W is bent by cooperation between mentioned punch P and die D (Step 112 of FIG. 11).

The back gauge 7 including an abutting part 5 is disposed behind mentioned lower table 2 (FIG. 1), and this back gauge 7 is supported on the lower table 2 via, for example, a link mechanism (illustration is omitted).

A stretch 25 (FIGS. 1 and 2) is disposed in the lateral direction (X-axis direction) between mentioned link mechanisms on both sides of the lower table 2, an abutting part main body 26 including an abutting part 5 in the front is mounted movably in the lateral direction with X-axis motor Mx (illustration is omitted); and further, the link mechanisms can be moved in the forward and backward directions (Y-axis direction) with Y-axis motor My (illustration is omitted) and in upward and downward directions (Z-axis direction) with Z-axis motor Mz (illustration is omitted) respectively.

Owing to such construction, by the below-described back gauge and side gauge control means 24F (FIG. 1), the back gauge 7 has preliminarily been positioned in a predetermined position (Step 107 of FIG. 11).

The front face of the above-mentioned abutting part 5 (FIG. 2) is an abutting face 5A against which a workpiece W is abutted; and there are provided on this abutting face 5A a plurality of contact confirmation sensors $S_1$, $S_2$, $S_3$, $S_4$, $S_5$, and these contact confirmation sensors are operated independently of each other, and act to confirm the contact state of the workpiece W with respect to the back gauge 7.

Figure 3:
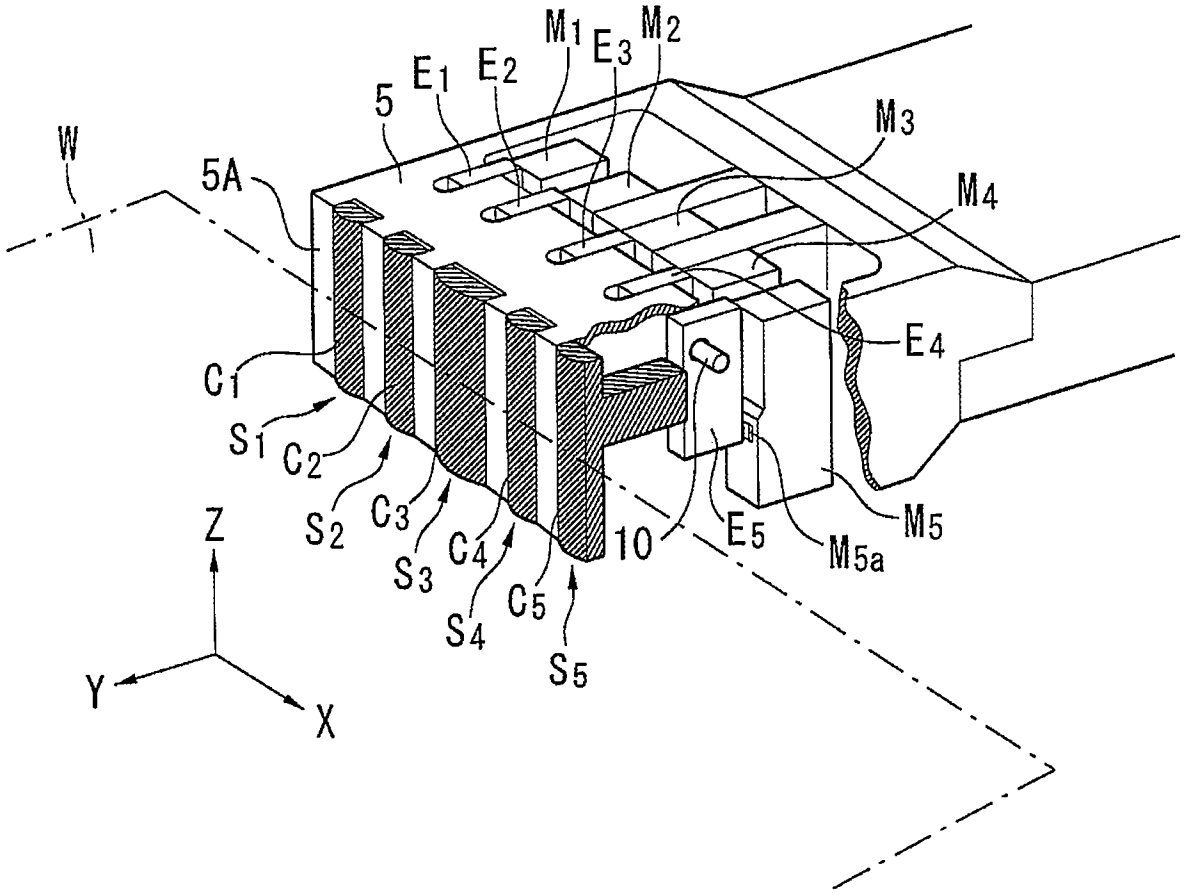
FIG. 3 is a perspective view illustrating details of FIG. 2.

Each of the above-mentioned contact confirmation sensors $S_1$, to $S_5$, as illustrated in FIG. 3, includes a workpiece-abutting part $C_1$ to $C_5$ against which a workpiece W is abutted, a stroke enlarging lever $E_1$ to $E_5$ enlarging a predetermined amount the stroke Y1 (FIG. 5) of each workpiece-abutting part, and a micro switch M1 to M5 brought in ON when a push button is pressed and moved by the stroke Y2 (FIG. 5) that is obtained by being enlarged with each stroke enlarging lever.

Conventionally, to make a micro switch ON, the stroke of this push button needs to be not less than 0.5 mm, and to do so, the stroke of a workpiece-abutting part likewise needs to be not less than 0.5 mm.

Therefore, a workpiece abutting part has to considerably protrude from the abutting face of the back gauge abutting part (for example, not less than (1.5 mm), and thus, the burden of an operator abutting a workpiece comes to be larger.

Moreover, even if after a micro switch has once been ON, a workpiece is returned forward (to an operator side) from any cause to be moved in a direction separate from the back gauge, the micro switch remains ON until the workpiece is spaced a predetermined distance (for example, not less than 0.5 mm).

Accordingly, even if a workpiece is not suitably abutted with respect to the back gauge, for example, a workpiece is largely slanted, a micro switch continues to be in ON state, and the workpiece is machined as it is, which is the cause of production of defective products.

Figure 4:
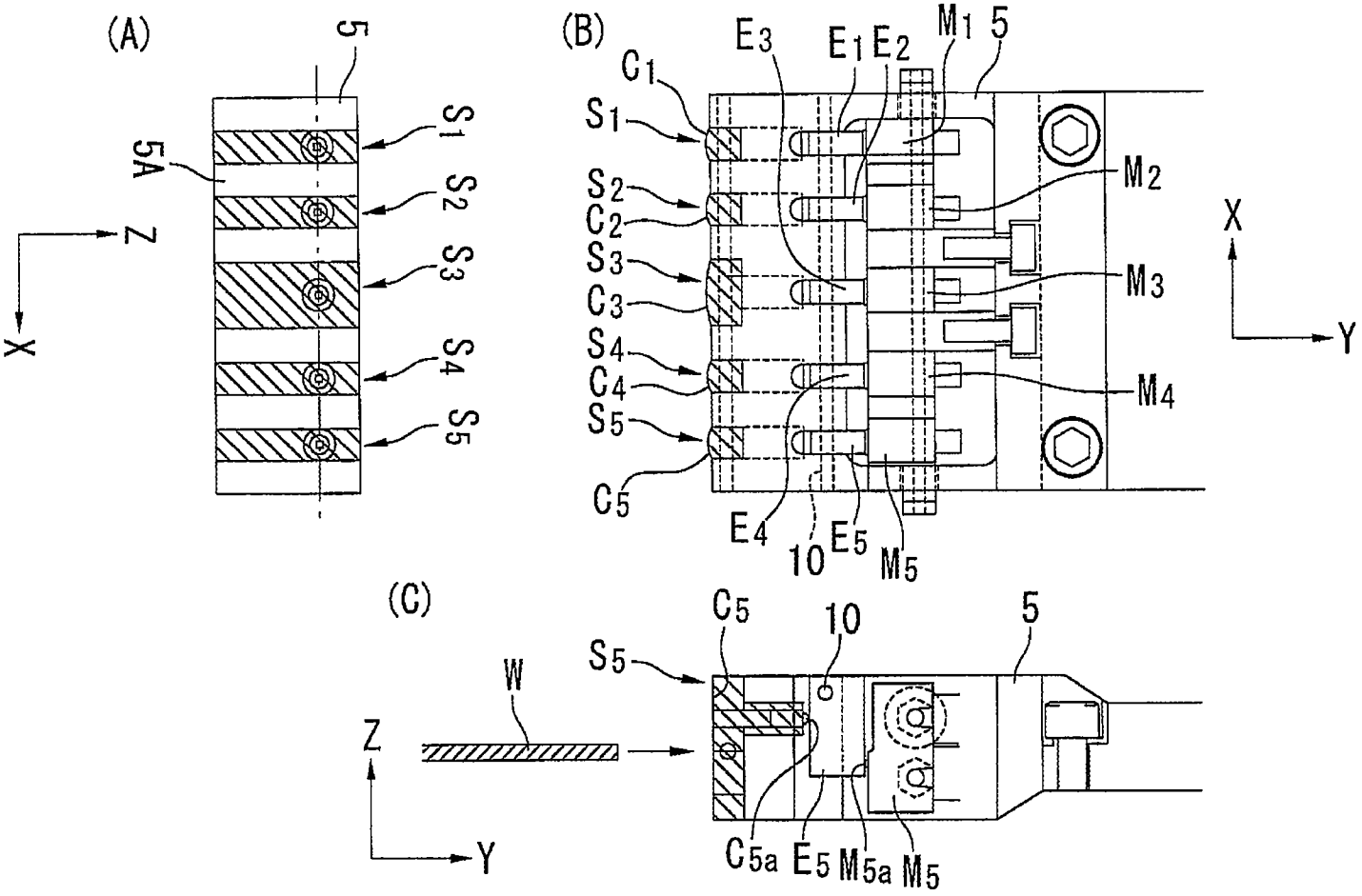
FIG. 4 are an elevation view, a plan view and a side view illustrating details of FIG. 2.

Then, according to the present invention, as described above, there are provided between the workpiece-abutting parts $C_1$ to $C_5$ (FIG. 3 and FIG. 4(B)) and the micro switches $M_1$ to $M_5$ the stroke enlarging levers $E_1$ to $E_5$, whereby, even it the stroke $Y_1$ of a workpiece-abutting part itself (FIG. 5) is comparatively small (for example, 0.2 mm (subtle displacement), the stroke $Y_2$ of the push button of the micro switch is made comparatively large as conventionally (for example, 0.6 mm (enlarged displacement)), and thus the micro switch in the same structure as is conventional is brought in ON.

Consequently, no problem as mentioned above occurs, and thus the burden of an operator comes to be smaller.

In other words, conventionally, even if a workpiece is spaced apart from the back gauge, a micro switch remains in ON state until it is spaced, for example, not less than 0.5 mm, and the workpiece may be machined as it is; while, according to the present invention, in the similar case, supposing that a workpiece is spaced, for example, not less than 0.2 mm, a push button is moved larger not less than 0.6 mm and returned to the original position, so that the micro switch immediately becomes in OFF state, resulting in no possibility of the workpiece being machined.

The workpiece abutting parts $C_1$ to $C_5$ forming the above-mentioned contact confirmation sensors $S_1$ to $S_5$ (FIG. 3) are biased with springs, normally to protrude about 0.2 mm forward (to the workpiece W side) from an abutting face 5A.

Furthermore, each of the workpiece abutting parts $C_1$ to $C_5$ has substantially the same dimension in the vertical direction (Z-axis direction) as the vertical dimension of mentioned abutting face 5A, whereby the contact area thereof with a workpiece w is enlarged.

In addition, the space between respective workpiece-abutting parts $C_1$ to $C_5$ (FIG. 4(B)) is the same, and is, for example, about 5 mm; and the width (X-axis direction) of the middle workpiece-abutting part $C_3$ is comparatively large (for example, about 10 mm), and the width of the other workpiece-abutting parts $C_1$, $C_2$, $C_4$, $C_5$ is comparatively small (for example, about 5 mm), thus allowing to suit the shape and dimension of various abutting parts of a workpiece W.

At the rear of the workpiece-abutting parts $C_1$ to $C_5$ having such construction, protrusions (for example, a protrusion $C_{5a}$ (FIG. 4(C)) with respect to the workpiece-abutting part $C_5$) are provided, and these protrusions are abutted against the stroke enlarging levers $E_1$ to $E_5$, that is, the front (workpiece W side) of the enlarging levers $E_1$ to $E_5$.

Furthermore, each of the enlarging levers $E_1$ to $E_5$ can be pivoted about a common pivot shaft 10, as well as is abutted against a push button in the front of the micro switches $M_1$ to $M_5$ (for example, as to a micro switch $M_5$, a push button $M_{5a}$ (FIG. 4(C)).

In each of the micro switches $M_1$ to $M_5$, when a push button is pressed and moved about 0.5 mm with mentioned enlarging levers $E_1$ to $E_5$, as well known, due to that a moving contact and fixed contact that are contained therein are brought in contact, ON signal is output.

Owing to this construction, for example, by causing a workpiece W (FIG. 4(C)) to about against the workpiece-abutting part $C_5$ of the contact confirmation sensor $S_5$, when this workpiece-abutting part $C_5$ is pressed 0.2 mm, the corresponding enlarging lever $E_5$ is pivoted in the counterclockwise direction accompanied thereby, whereby the push button $M_{5a}$ of the micro switch $M_5$ is pressed by a stroke enlarged substantially three times, that is 0.6 mm.

Therefore, this push button $M_{5a}$ will be pressed not less than 0.5 mm, being a stroke necessary for making the micro switch $M_5$ ON.

In this case, although the enlarging lever $E_5$ is pivoted in the counterclockwise direction as mentioned above, a stroke necessary for making the micro switch $M_5$ ON is such an extremely small value as 0.6 mm, so that approximately the enlarging lever $E_5$ may be thought to go straight in the forward and backward directions (Y-axis direction (FIG. 4(C)).

Figure 5:
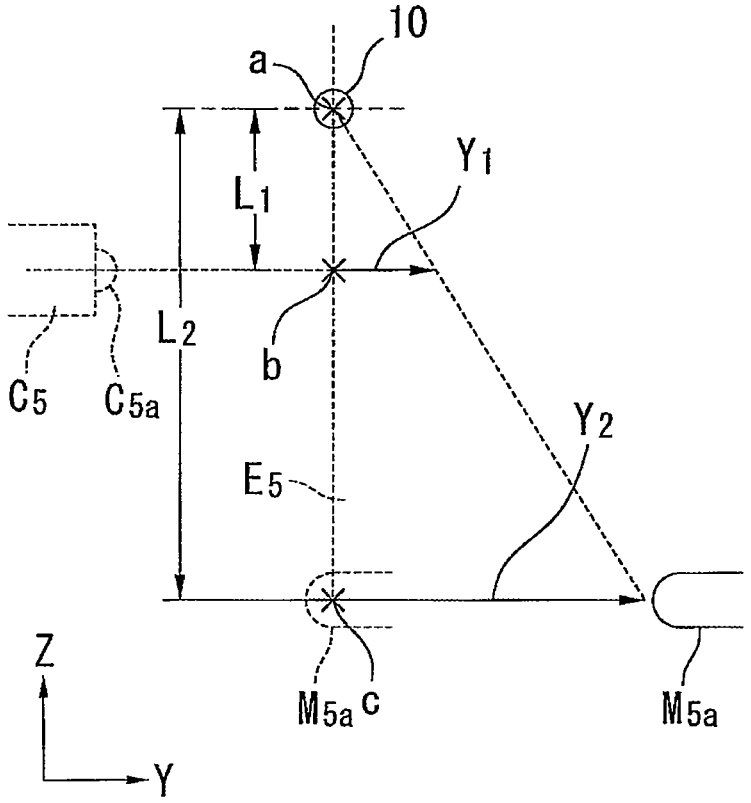
FIG. 5 is a chart showing the relation between the stroke Y1 of a workpiece-abutting part and the stroke Y2 of a stroke enlarging lever that form a contact confirmation sensor according to the first invention.

Therefore, for example, as to the contact confirmation sensor $S_5$, all the abutting part $C_5$ the enlarging lever $E_5$, and the push button $M_{5a}$ of the micro switch $M_5$ ray be regarded as going straight in the forward and backward directions; and in such an assumption, the relation between the stroke $Y_1$ of the abutting part $C_5$ and the stroke $Y_2$ of the enlarging lever $E_5$ is as shown in FIG. 5.

With reference to FIG. 5, letting the distance between the center a of the pivot shaft 10 and the protrusion $C_{5a}$ of the abutting part $C_5$ (center b) $L_1$, and letting the distance between the center a of this pivot shaft 10 and the push button $M_{5a}$ of the micro switch $M_5$ (center c) $L_2$, as obvious from the drawing, $Y_1/Y_2=L_1/L_2$, whereby the following expression is established.

$$Y_2=(L_2/L_1)\times Y_1 \quad (1)$$

Thus, in (1) expression, supposing that $L_2/L_1$ has preliminarily been set to be 3, in the case of the stroke $Y_1$ of the workpiece-abutting part $C_5$=0.2 mm, the stroke $Y_2$ of the enlarging lever $E_5$=0.6 mm.

In the above-mentioned FIG. 5, an axis of abscissas may be thought to be a time axis, as to the workpiece-abutting part $C_5$ and the enlarging lever $E_5$ of the same speed having started at the same time point, based on mentioned (1) expression, when the workpiece-abutting part $C_5$ goes straight just a stroke $Y_1$, the enlarging lever $E_5$ going straight just a stroke $Y_2$, whereby the push button $M_{5a}$ is pressed this stroke $Y_2$, and thus the micro switch $M_5$ is made ON.

On the other hand, the side gauge 8 (FIG. 2), as described already, can be moved in the lateral direction (X-axis direction) along the lower table 2, and originally, functions to determine the lateral position of a workpiece e.g., in the case of avoiding interference between a machined flange of the workpiece and dies P and D at the time of, for example, box-bending.

Figure 6:
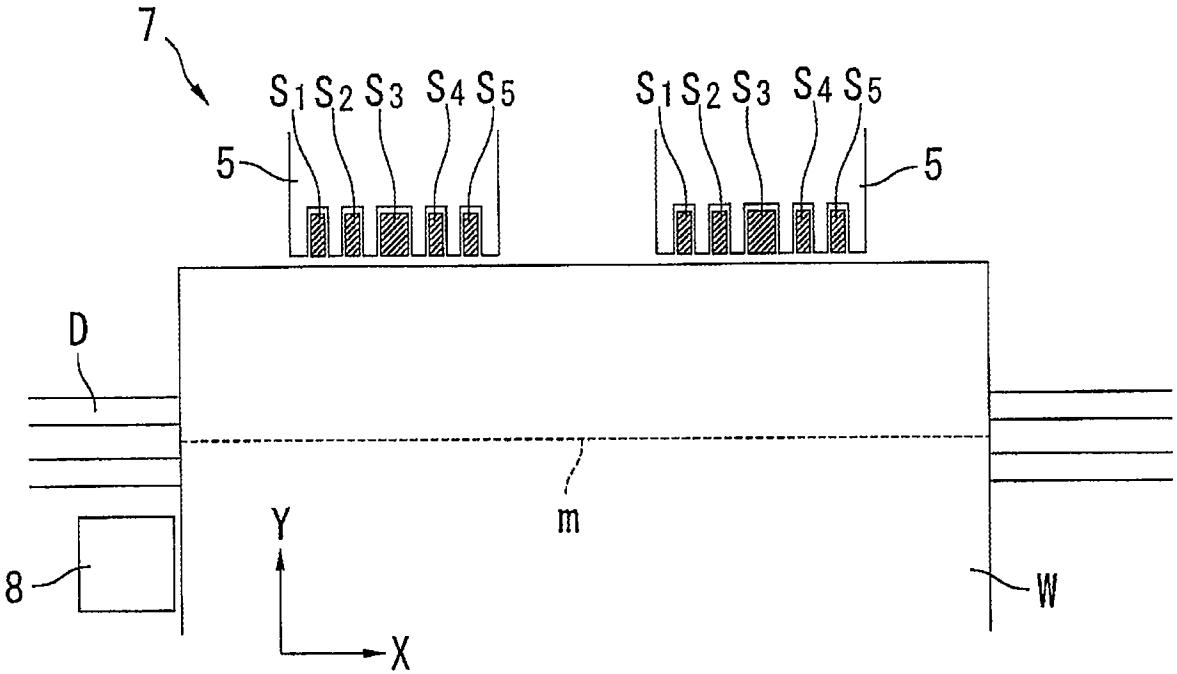
FIG. 6 is a view explaining the functions of a back gauge 7 and a side gauge 8 constructing the first invention.

However, in the present invention, as described already, to enhance the efficiency of machining, e.g., in the case of being machined in the state in which the blade distance between the dies P and D is made smaller, there are some cases where the state of a workpiece being abutted against the back gauge cannot be visually observed, and it is difficult for an operator himself to determine whether or not all the corresponding contact confirmation sensors are ON (Stop 109 of FIG. 11); and thus, this workpiece W is positioned by the workpiece W being abutted against the side gauge 8 besides the back gauge 7 (FIG. 6).

That is, only by a workpiece W being abutted against the back gauge 7 and the side gauge 8 by an operator S, this workpiece W is positioned, thereby making it easy for the operator S to determine whether or not an abutting part of the workpiece is properly abutted against the back gauge abutting part.

Figure 11:
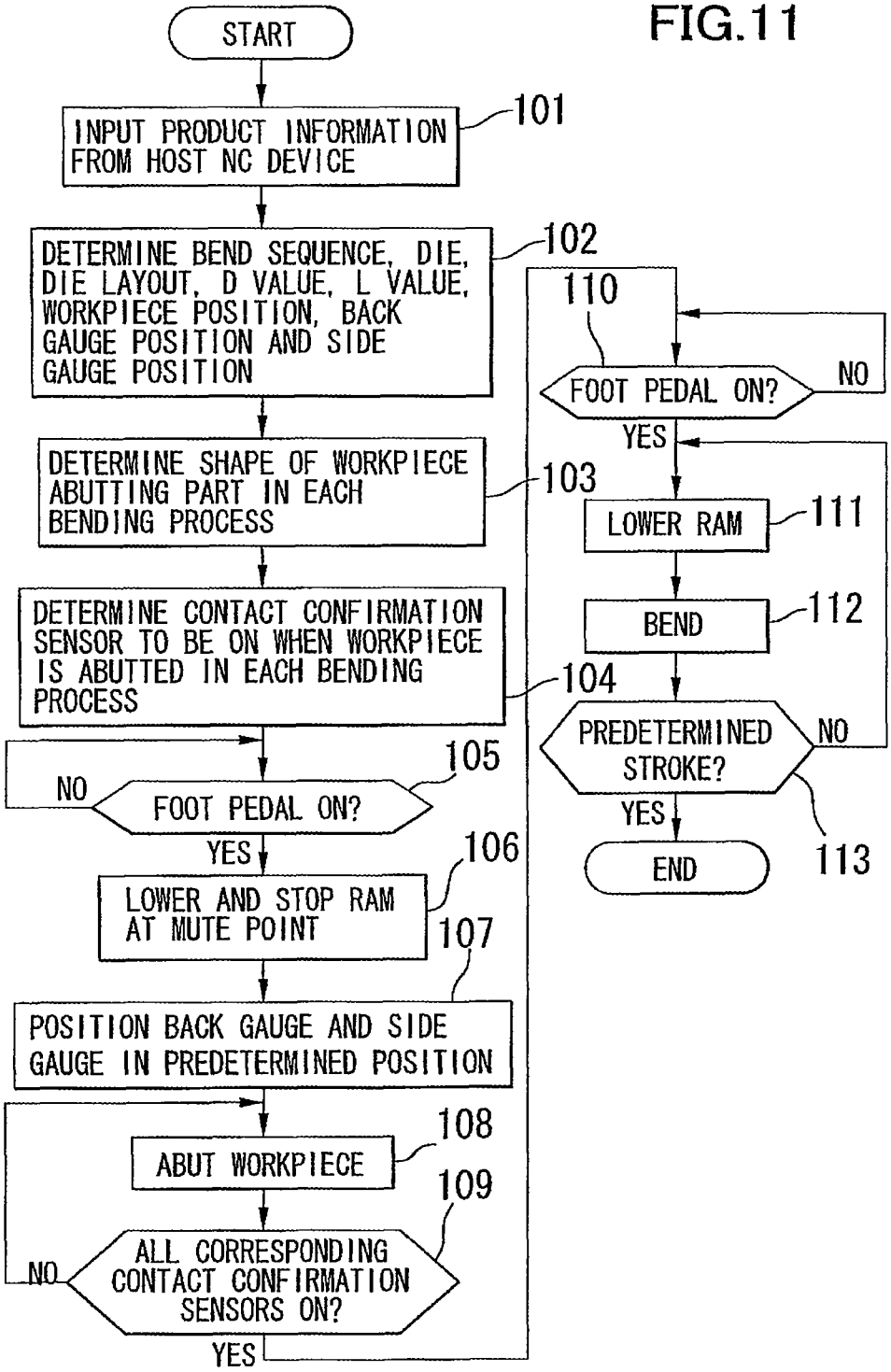
FIG. 11 is a flowchart for explaining operations of the first invention.

Furthermore, a foot pedal 6 is disposed in the vicinity of the above-mentioned lower table 2 (FIG. 1), as mentioned above, when all the corresponding contact confirmation sensors are ON (YES in Step 109 of FIG. 11), as well as this foot pedal 6 is depressed by an operator S (YES in Step 110 of FIG. 11), ram control means 24G (FIG. 1) having detected this fact operates the oil hydraulic cylinder 34 to lower the ram 1 (Step 111 of FIG. 11), to perform bending (Step 112 of FIG. 11).

An NC device 24 having such arrangement (FIG. 1) is constructed of CPU 24A, input means 24B, storage means 24*c*, bend sequence, die and the like determining means 24D, contact confirmation sensor determining means 24E, back gauge and side gauge control means 24F and ram control means 24G.

The CPU 24A makes an integrated control of the entire device illustrated in FIG. 1 such as bend sequence, die and the like determining means 24D and contact confirmation sensor determining means 24E based on an operating procedure (for example, corresponding to FIG. 11) for carrying out the present invention.

Input means 24B is formed of, for example, an operation panel mounted in a movable manner onto the upper table 1, and input with a product information J from a host NC device 23 (Step 101 of FIG. 11); and this input product information J is stored in the below-described storage means 24C to be used for determination of bend sequence, die, die layout and the like.

A product information J is, for example, CAD information, includes information of the plate thickness of a workpiece W, material, the length of a bend line, the bend angle of a product, a flange dimension and the like, and is constructed as a stereoscopic profile sketch and a development elevation.

Furthermore, the host NC device 23 is placed in, for example, an office, and the NC device 24 is placed in, for example, a factory where mentioned press brake is located as a sub NC device with respect to this host NC device.

Moreover, in the example illustrated in FIG. 1, a product information J is stored in mentioned host NC device 23, and the NC device 24 provided with this product information J from the host NC device 23 controls operation of the present invention (FIG. 1).

The present invention, however, is not limited to this arrangement, the host NC device 23 also includes bend sequence, die and the like determining means 24D, contact confirmation sensor determining means 24E and the like as the NC device 24, and this host NC device 23 can directly control operation of the present invention by making a predetermined data processing based on the product information J stored therein (FIG. 11).

Furthermore, as for the input means 24B of mentioned NC device 24, it is also possible that a product information J is input manually by an operator S, not input from the host NC device 23.

This input means 24B includes an operation screen 9, as described below (FIG. 9), supposing that on this operation screen, for example, the contact confirmation sensor determined by mentioned contact confirmation sensor determining means 24E is displayed in each bending process 1, 2 . . . , as well as at each left/right abutting part 5, and the contact state between the workpiece abutting part and the back gauge abutting part 5 in each bending process 1, 2 . . . is sequentially displayed, positioning operation of a workpiece W of an operator can be guided with accuracy.

Storage means 24C (FIG. 1) stores mentioned product information J, additionally the below-described database (FIG. 8), a machining program corresponding to an operating procedure according to the present invention, and the like; and the CPU 24 controls all the operations based on this machining program.

Bend sequence, die and the like determining means 24D (FIG. 1), based on mentioned product information J, determines the bend sequence of a workpiece W, dies P and D to be used in each bend sequence (bending process), die layout, the position of the workpiece and the position of the back gauge 7, and additionally determines D value, L value, and the position of the side gauge 8 respectively (Step 102 of FIG. 11).

In this case, as well known, the position of the back gauge 7 is the position in the forward and backward directions (Y-axis direction) to be determined with the flange dimension of a workpiece w or the elongation amount of the workpiece w based on a product information J; and the position of the side gauge 8 (FIG. 6) is the position in the lateral direction (X-axis direction) to be determined with the bend line m of a workpiece W (FIG. 6) likewise based on a product information J (FIG. 1).

Contact confirmation sensor determining means 24E, based on a product information J, in each bending process 1, 2 . . . , determines the shape of an abutting part of a workpiece W with respect to the back gauge 7 and determines the contact confirmation sensor that has to be ON when a workpiece W is abutted among a plurality of contact confirmation sensors $S_1$ to $S_5$ based on the contact state between this workpiece abutting part and the back gauge abutting part 5A.

That is, in accordance with mentioned product information J (FIG. 1), the shape of an abutting part of a workpiece W in each bending process can be created (flowchart), so that using this flowchart, based on the contact state between the workpiece abutting part and the back gauge abutting part 5, the contact confirmation sensor that has to be ON when a workpiece is abutted is determined.

For example, as the most simple shape of a workpiece abutting part, as illustrated in FIG. 6, there is an end face shape flat throughout the entire lateral direction; and in this case, determined with the length of a bend line m, when the end face is abutted against two abutting parts 5 of the back gauge 7 in entirety, a workpiece W is positioned without being slanted.

That is, on the supposition that a workpiece abutting part is suitably abutted against the back gauge abutting part, all the contact confirmation sensors $S_1$ to $S_5$ of two abutting parts 5 are made ON.

Accordingly, by contact confirmation sensor determining means 24E, the contact confirmation sensor that has to be ON when a workpiece W is abutted is determined to be all the contact confirmation sensors $S_1$ to $S_5$ of the left and right abutting parts 5.

Furthermore, this determination result, as shown in FIG. 8 (o is ON, and/is OFF), is created to be a database as the contact confirmation sensor that has to be ON when a workpiece is abutted, for example, in the bending process 1 to be stored in mentioned storage means 24C, and is searched when the CPU 24A drives the ram 1 via ram control means 24A.

Figure 2:
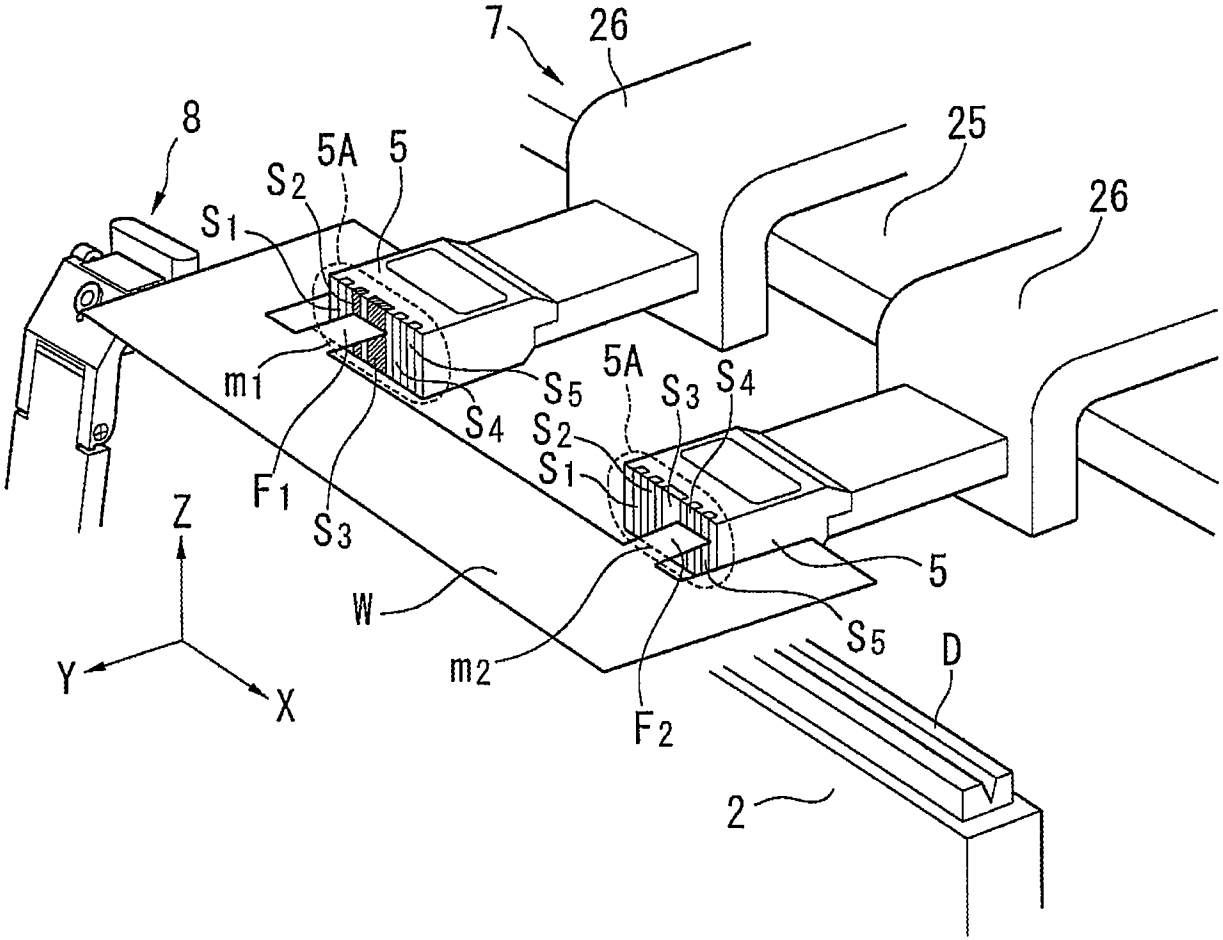
FIG. 2 is a perspective view of a back gauge 7 constructing the first invention.

In addition, for example, as the shape of a workpiece abutting part, as illustrated in FIG. 2, there are flanges $F_1$ and $F_2$ having a comparatively small width (X-axis direction); and in this case, determined with the position of a workpiece W, respective widths of both of the flanges $F_1$ and $F_2$ and the space therebetween, when a part of two abutting parts 5 of the back gauge 7 is abutted, the workpiece W is positioned without being slanted.

That is, when of two abutting parts 5, all the contact confirmation sensors $S_2$ and $S_3$ at the left-side abutting part 5 and contact confirmation sensors $S_4$ and $S_5$ at the right-side abutting part 5 are made ON respectively, the aforementioned workpiece abutting part is determined to be suitably abutted against the back gauge abutting part.

Thus, by contact confirmation sensor determining means 24E, the contact confirmation sensor that has to be ON when a workpiece W is abutted is determined to be the contact confirmation sensors $S_2$ and $S_3$ regarding the left-side abutting part 5, and to be the contact confirmation sensors $S_4$ and $S_5$ regarding the right-side abutting part 5.

Furthermore, this determination result, as illustrated in FIG. 8 (o is ON, and/is OFF), is likewise created to be the database as the contact confirmation sensor that has to be ON when a workpiece is abutted, for example, in the bending process 2 to be stored in mentioned storage means 24C, and is searched when ram control means 24G (FIG. 1) drives the ram 1.

Figure 7:
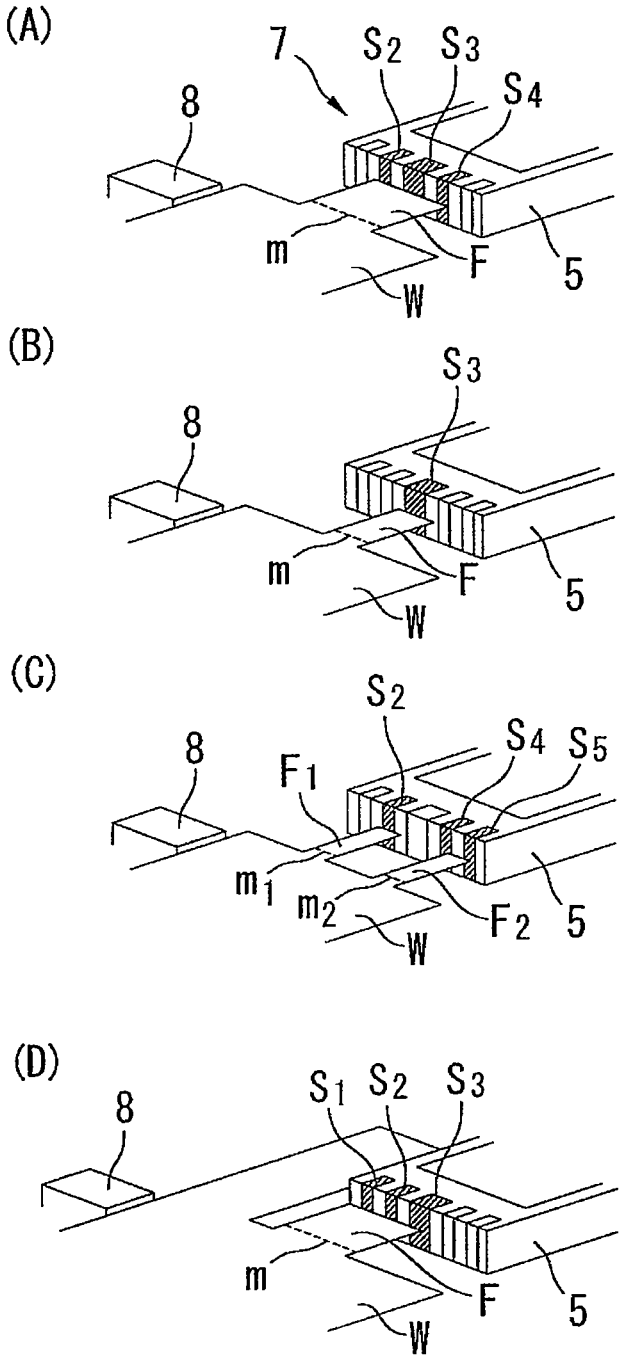
FIG. 7 are views illustrating the contact state between an abutting part of a workpiece W and an abutting part 5 of a back gauge 7 according to the first invention.

Moreover, there are some cases where as the shape of a workpiece abutting part, for example, as illustrated in FIG. 7, the width is extremely small or the space is small; and supposing that a part of the contact confirmation sensors forming one abutting part of the back gauge 7 is ON, this workpiece abutting part is suitably abutted against the back gauge abutting part.

That is, when all the contact confirmation sensors $S_2$, $S_3$, $S_4$ are ON in FIG. 7(A), when the contact confirmation sensor S3 is ON in FIG. 7(B), when all the contact confirmation sensors $S_2$, $S_4$, $S_5$ are ON in FIG. 7(C), and when all the contact confirmation sensors $S_1$, $S_2$, $S_3$ are ON in FIG. 7(D) respectively, a workpiece abutting part is determined to suitably abut against a back gauge abutting part.

Accordingly, by contact confirmation determining means 24E, the contact confirmation sensor that has to be ON when a workpiece is abutted is determined to be the contact confirmation sensors $S_2$, $S_3$, $S_4$ of the left-side abutting part 5, for example, in the case of FIG. 7(A).

Further, also in the case of FIG. 7, likewise, the aforementioned determination is stored in mentioned storage means 24C as database (corresponding to FIG. 8), and searched when ram control means 24G drives the ram 1 (FIG. 1).

Like this, according to the present invention, even if an abutting part of a workpiece with respect to a back gauge has any shape from a large article to a small article, it can be determined with accuracy whether or not this workpiece abutting part is appropriately abutted against a back gauge abutting part.

That is, as is conventional (Japanese Patent Application Laid-Open No. 5-7938), in the case of one sensor, even in the state in which a workpiece is slantingly abutted to be in the so-called point contact, the workpiece is regarded to appropriately abut against the back gauge upon ON of a sensor, to make a wrong determination.

As is the present invention, however, by letting ON of all the corresponding sensors of a plurality of sensors the suitable contact conditions between a workpiece and a back gauge, the so-called surface contact state in the entire area of a workpiece abutting part can be confirmed, so that contact determination between the workpiece and the back gauge is made with accuracy, thereby preventing the production of defective products and improving the efficiency of machining, as well as reducing the burden of an operator.

Furthermore, conventionally, when a hole is formed in a workpiece abutting part, or this workpiece abutting part is strip-shaped with notch (corresponding to FIG. 7(C)), this workpiece abutting part cannot be always contacted with one sensor; whereas, according to the preset invention, provision of a plurality of sensors solves this problem.

On the other hand, back gauge and side gauge control means 24F (FIG. 1) positions mentioned back gauge 7 and side gauge 8 in a predetermined position.

That is, after the contact confirmation sensor that has to be ON when a workpiece is abutted in each bending process is determined by mentioned contact confirmation sensor determining means 24E (Step 104 in FIG. 11), when a foot pedal 6 is ON (YES in Step 105 of FIG. 11), the ram 1 is lowered and stopped at a mute point (Step 106 of FIG. 11), so that mentioned back gauge and side gauge control means 24F having detected this operation positions the back gauge 7 and the side gauge 8 in a predetermined position (Step 107 of FIG. 11) in order for an operator S (FIG. 1) to abut a workpiece W (Step 108 of FIG. 11).

The ram control means 24G (FIG. 1) drives and controls the ram 1 by controlling the oil hydraulic cylinder 34, being a ram driving source.

For example, the ram control means 24G searches database stored in storage means 24C (FIG. 8), when all the corresponding contact confirmation sensors that have to be ON when a workpiece is abutted in each bending process 1, 2 . . . are ON (YES in Step 109 of FIG. 11), as well as the foot pedal 6 is ON (YES in Step 110 of FIG. 11), drives the oil hydraulic cylinder 34 to lower the ram 1 (Step 111 of FIG. 11), and makes bonding of the workpiece W (Step 112 of FIG. 11).

Figure 9:
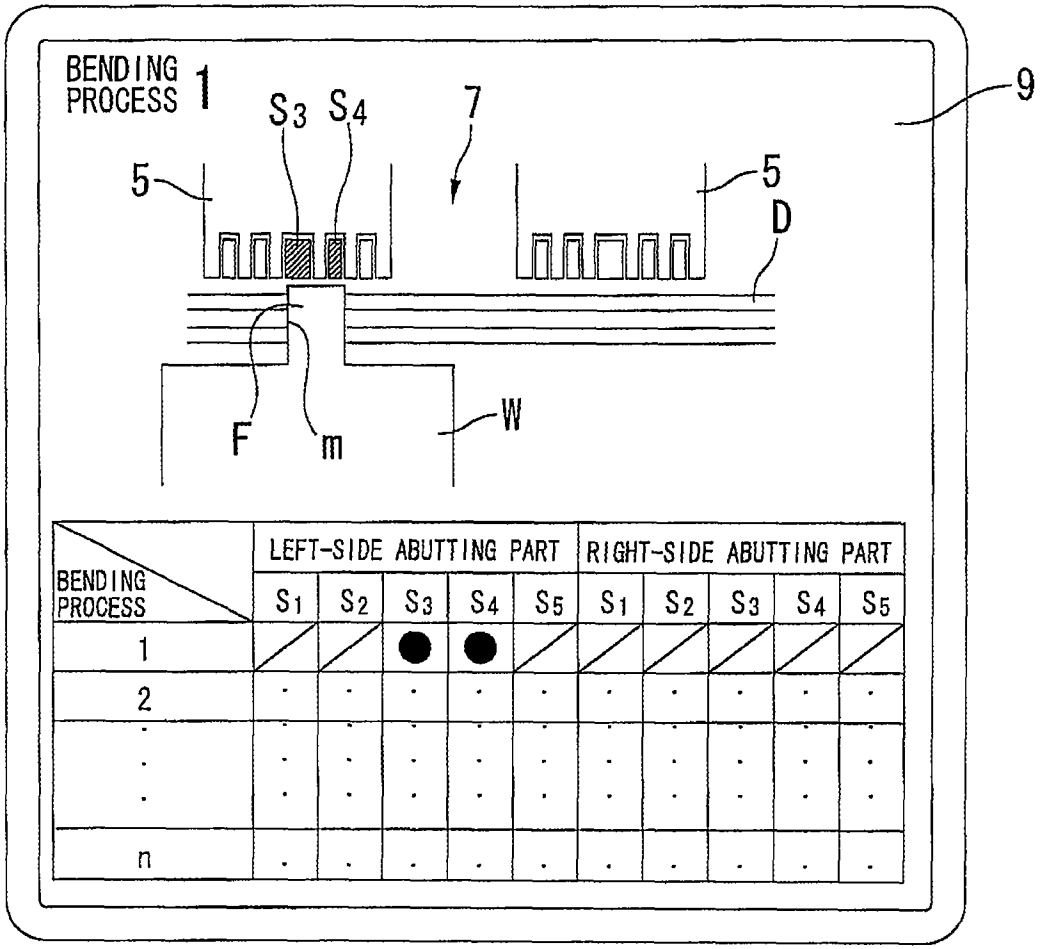
FIG. 9 is a diagram illustrating another exemplary embodiment according to the first invention.

FIG. 9 illustrates another exemplary embodiment according to the present invention, in which the contact confirmation sensor that has to be ON is displayed on the operation screen of mentioned input means 24B, thereby making a corrective work of workpiece abutting operation of an operator.

That is, when by mentioned contact confirmation sensor determining means 24E, the contact confirmation sensor that has to be ON when a workpiece is abutted is determined in each bending process (Step 104 of FIG. 11, FIG. 8), as illustrated in FIG. 9, for example, at the lower portion of the operation screen 9, ON/OFF states of the contact confirmation sensors $S_1$, $S_2$, $S_3$, $S_4$, $S_5$, (o is ON, /is OFF) are displayed in each of all the bending process 1, 2, . . . , as well as at each of the left and right abutting parts 5 of the back gauge 7.

Furthermore, for example, at the upper portion of the operation screen 9, sequentially in each bending process 1, 2, . . . , the shape of an abutting part of a workpiece W with respect to the back gauge 7, and the contact state between a workpiece abutting part and a back gauge abutting part 5 at that time are displayed, and the contact confirmation sensor that has to be ON when this workpiece is abutted is displayed so as to be capable of identified by a color (in the case of illustration, $S_3$ and $S_4$ are displayed in a red color at the upper portion of the operation screen 9).

Owing to such construction, for example, in the case of performing the bending process 1, supposing that an operator abuts a workpiece w against the left-side abutting part 5 without being slanted, at that time, the corresponding contact confirmation sensors $S_3$ and $S_4$ at the lower portion of the operation screen 9 are flickered, so that an operator can easily confirm the contact state between the workpiece W and the back gauge 7, thus making it easy to make a corrective work of workpiece abutting operation.

With reference to FIG. 9, all the contact states between the workpiece abutting part and the back gauge abutting part 5 in each bending process 1, 2, . . . are displayed on the operation screen 9, so that positioning operation in the lateral direction x-axis direction) of a workpiece W made by an operator can be guided properly and accurately, and thus, in this exemplary embodiment, a side gauge 8 (FIG. 2) is not necessarily required.

Furthermore, as further another exemplary embodiment, there are some cases where the contact confirmation sensor that has to be ON when a workpiece is abutted among a plurality of contact confirmation sensors displayed on the operation screen 9 is specified ion the operation screen 9 by an operator himself, thereby manually determining the corresponding sensor.

In this case, it is preferred that after an operator has manually made determination, results thereof are displayed on the operation screen 9, whereby the operator can make confirmation thereof (for example, corresponding to the lower portion of the operation screen of FIG. 9).

Figure 10:
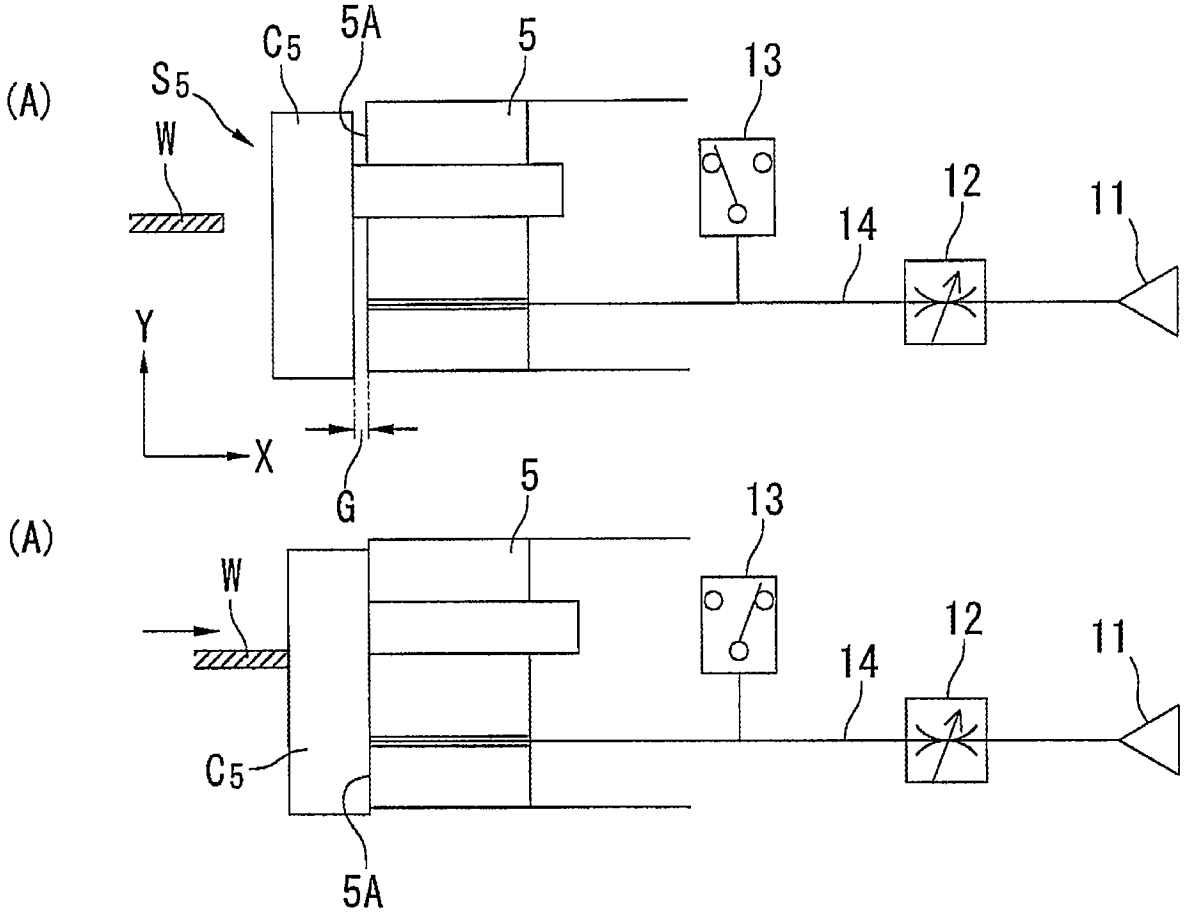
FIG. 10 are diagrams illustrating another example (pressure switch type) of a contact confirmation sensor according to the first invention.

FIG. 10 illustrate the case where a driving mechanism of a contact confirmation sensor is of pressure sensor type.

As illustrated in FIG. 10(A) for example, there is formed between a workpiece-abutting part $C_5$ and an abutting face 5A forming a contact confirmation sensor $S_5$ a gap G, and an air piping 14 exposed to this gap G side is contained in an abutting part 5.

This air piping 14 is communicated with an air source 11 via a flow control valve 12, and a pressure sensor 13 is connected to this air piping 14.

Owing to such construction, on the supposition of setting an air flow corresponding to an air pressure circuit as illustrated, usually, an air is escaped to mentioned gap G side, so that the pressure switch 13 is in OFF state.

However, as illustrated in FIG. 10(B), when a workpiece W is abutted against the workpiece-abutting part $C_5$, there will be no mentioned gap G, so that air cannot escape, the air piping 14 comes to be at a high pressure, and thus the pressure switch 13 becomes in ON state.

Hereinafter, operations of the present invention having the above-mentioned construction are described with reference to FIG. 11.

(1) Operation Until the Contact Confirmation Sensor that has to be on when a Workpiece is Abutted, is Determined A product information J is input from the host NC device 23 in Step 101 of FIG. 11, a bend sequence, die, die layout, D value, L value, workpiece position, back gauge position, and side gauge position are determined in Step 102, the shape of a workpiece abutting part is determined in each bending process (bend sequence) in Step 103, and the contact confirmation sensor that has to be ON when a workpiece is abutted is determined in each bending process in Step 104.

That is, CPU 24A (FIG. 1), when detecting that a product information J has been input from the host NC device 23, determines a bend sequence, die, die layout and the like as described already via bend sequence, die and the like determining means 24D.

Thereafter, CPU 24A, via contact confirmation sensor determining means 24E, based on a product information J, in each bending process (bend sequence), after the shape of an abutting part of a workpiece with respect to a back gauge has been determined (flowchart), based on this shape of the workpiece abutting part and the contact state with a back gauge abutting part 5A (for example, FIG. 7), determines the contact confirmation sensor that has to be ON when the workpiece is abutted among a plurality of contact confirmation sensors.

Then, the contact confirmation sensor having been determined like this is stored in storage means 24C (FIG. 1) as database (FIG. 8).

(2) Workpiece Positioning Operation

When the foot pedal 6 is ON (YES) in Step 105 of FIG. 11, the ram 1 is lowered and stopped at a mute point in Step 106, the back gauge 7 and the side gauge 8 are positioned in a predetermined position in Step 107, a workpiece W is abutted in Step 108, and it is determined whether or not the corresponding contact confirmation sensor is ON.

That is, CPU 24A (FIG. 1), when detecting ON of the foot pedal 6 upon that this foot pedal 6 is depressed by an operator S, operates the oil hydraulic cylinder 34 to lower the ram 1 and temporarily stop in the mute point position via ram control means 24G, and in this state, positions the back gauge 7 and the side gauge 8 in predetermined positions via back gauge and side gauge control means 24F.

Whereby, an operator S inserts a workpiece W from between a punch P and a die D, and abuts this workpiece W against the back gauge 7 and the side gauge 8 having been positioned in mentioned predetermined positions.

Furthermore, as mentioned above, unless all the contact confirmation sensors having been determined via contact confirmation sensor determining means 24E are ON (NO in Step 109 of FIG. 11) an operator S abuts the workpiece W against the back gauge 7 and the side gauge again (returned to Step 108 of FIG. 11), and then when all these corresponding contact confirmation sensors are ON (YES in Step 109 of FIG. 11), this workpiece W is regarded to be positioned.

(3) Bending Operation

When the foot pedal 6 is ON (YES) in Step 110 of FIG. 11, the ram 1 is lowered in Step 111, bending is performed in Step 112, and when the ram 1 has reached a predetermined stroke (YES) in Step 113, all operations are ended (END).

That is, CPU 24A (FIG. 1), after having detected that all the corresponding contact confirmation sensors are ON by searching database (FIG. 8) stored in storage means 24C, when detecting ON of the foot pedal 6 upon that this foot pedal 6 is depressed by an operator S, in other words, on the conditions of ON of all the contact confirmation sensors and ON of the foot pedal 6, operates the oil hydraulic cylinder 34 to lower the ram 1 via ram control means 24G again, and when detecting that this ram has reached a predetermined stroke, regards that bending has been ended to finish all the operations.

B. Second Invention

Figure 12:
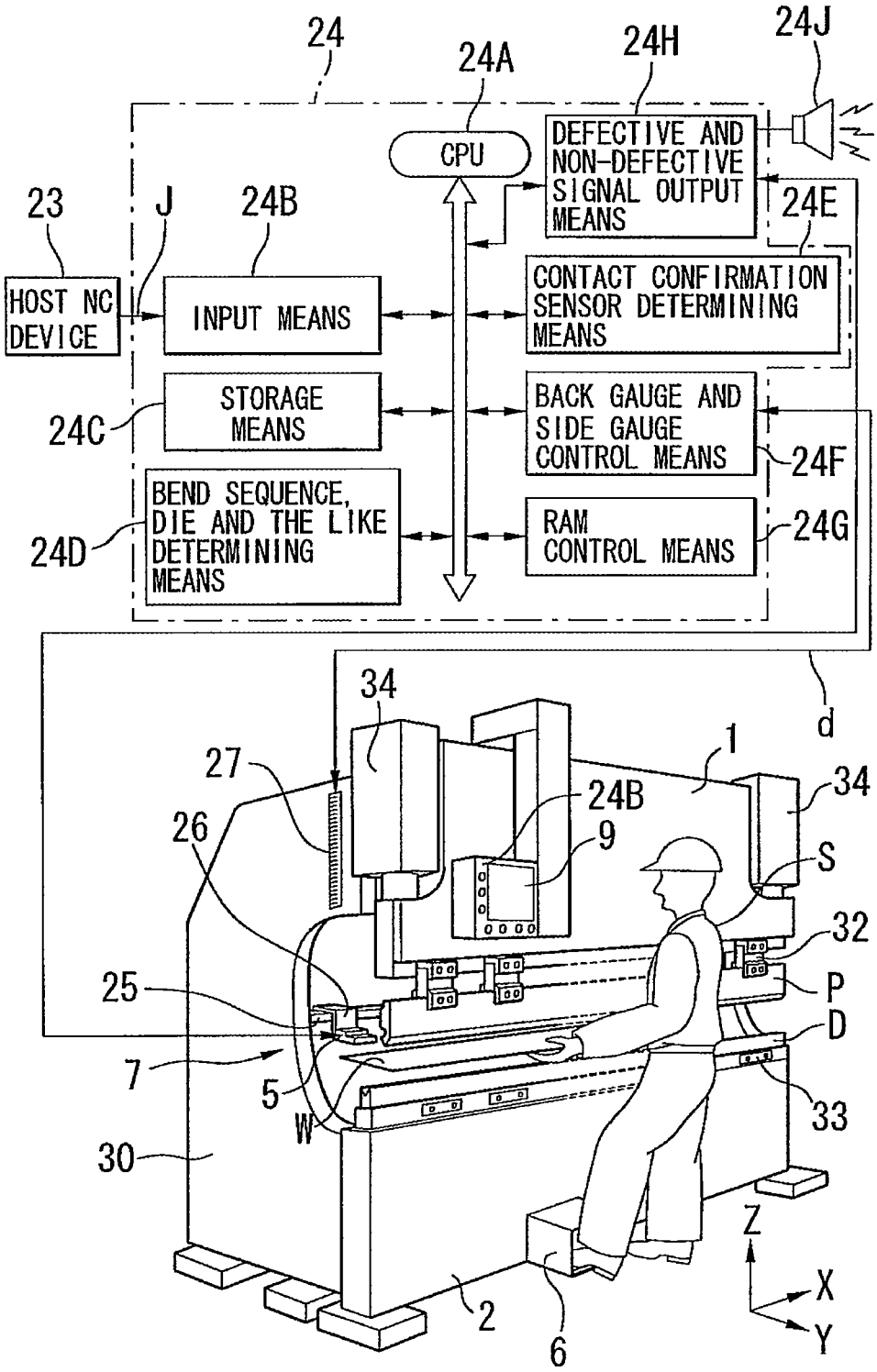
FIG. 12 is an entire view illustrating an exemplary embodiment of a second invention.

FIG. 12 is an entire view illustrating an exemplary embodiment of a second invention according to the present invention, and an illustrated bending machine is, for example, a press brake.

This press brake includes side plates 30 on both sides of a machine main body, an upper table 1, being a ram, is attached to the upper portion of these side plates 30 via, for example, an oil hydraulic cylinder 34, and a punch P is attached to this upper table 1 via an intermediate plate 32.

Figure 13:
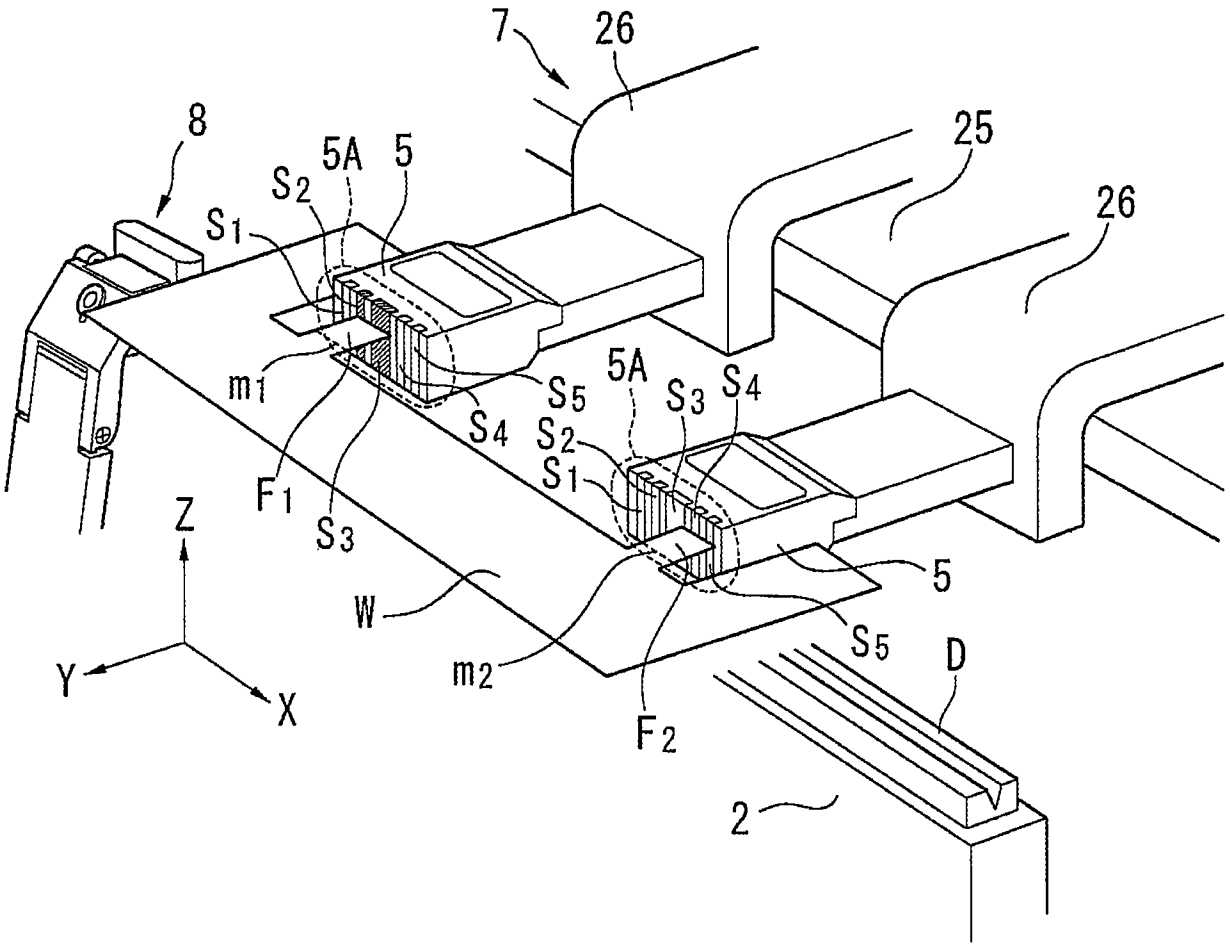
FIG. 13 is a perspective view of a back gauge 7 constructing the second invention.

Furthermore, a lower table 2 is disposed at the lower portion of the side plates 30; and a die D is attached to this lower table 2 via a holding plate 33, as well as a side gauge 8 (FIG. 13) is provided movably in the lateral direction (X-axis direction), functioning to determine the lateral position of a workpiece W.

That is, the bending machine illustrated in FIG. 12 is a lifting-down type press brake, in which after a workpiece w has been abutted against the below-described back gauge 7 disposed behind the lower table 2 and mentioned side gauge 8 (Step 108 of FIG. 18), when all corresponding contact confirmation sensors are ON (YES in Step 109 of FIG. 18) as well as a foot pedal 6 is ON (YES in Step 110 of FIG. 18), the oil hydraulic cylinder 34 is operated via a ram control means 24G (FIG. 12) to lower the ram 1 (Step 111 of FIG. 18), this workpiece W is bent by cooperation between mentioned punch P and die D (Step 112 of FIG. 18).

The back gauge 7 including an abutting part 5 is disposed behind mentioned lower table 2 (FIG. 12), and this back gauge 7 is supported at the lower table via, for example, a link mechanism (illustration is omitted).

A stretch 25 (FIGS. 12 and 13) is disposed in the lateral direction (X-axis direction) between mentioned link mechanisms on both sides of the lower table 2, an abutting part main body 26 including an abutting part 5 in the front is attached to this stretch 25 movably in the lateral direction with X-axis motor Mx (illustration is omitted), and further, the link mechanisms can be moved in the forward and backward directions (Y-axis direction) with Y-axis motor My (illustration is omitted) and in the upward and downward directions (Z-axis direction) with Z-axis motor Mz (illustration is omitted) respectively.

Owing to such construction, by the below-described back gauge and side gauge control means 24F (FIG. 12), the back gauge 7 has preliminarily been positioned in a predetermined position (Step 107 of FIG. 18).

The front face of the above-mentioned abutting part 5 (FIG. 13) is an abutting face 5A against which a workpiece W is abutted; and there are provided on this abutting face 5A a plurality of contact confirmation sensors $S_1$, $S_2$, $S_3$, $S_4$, $S_5$, and these contact confirmation sensors are operated independently of each other, and act to confirm the contact state of a workpiece W with respect to the back gauge 7.

Figure 14:
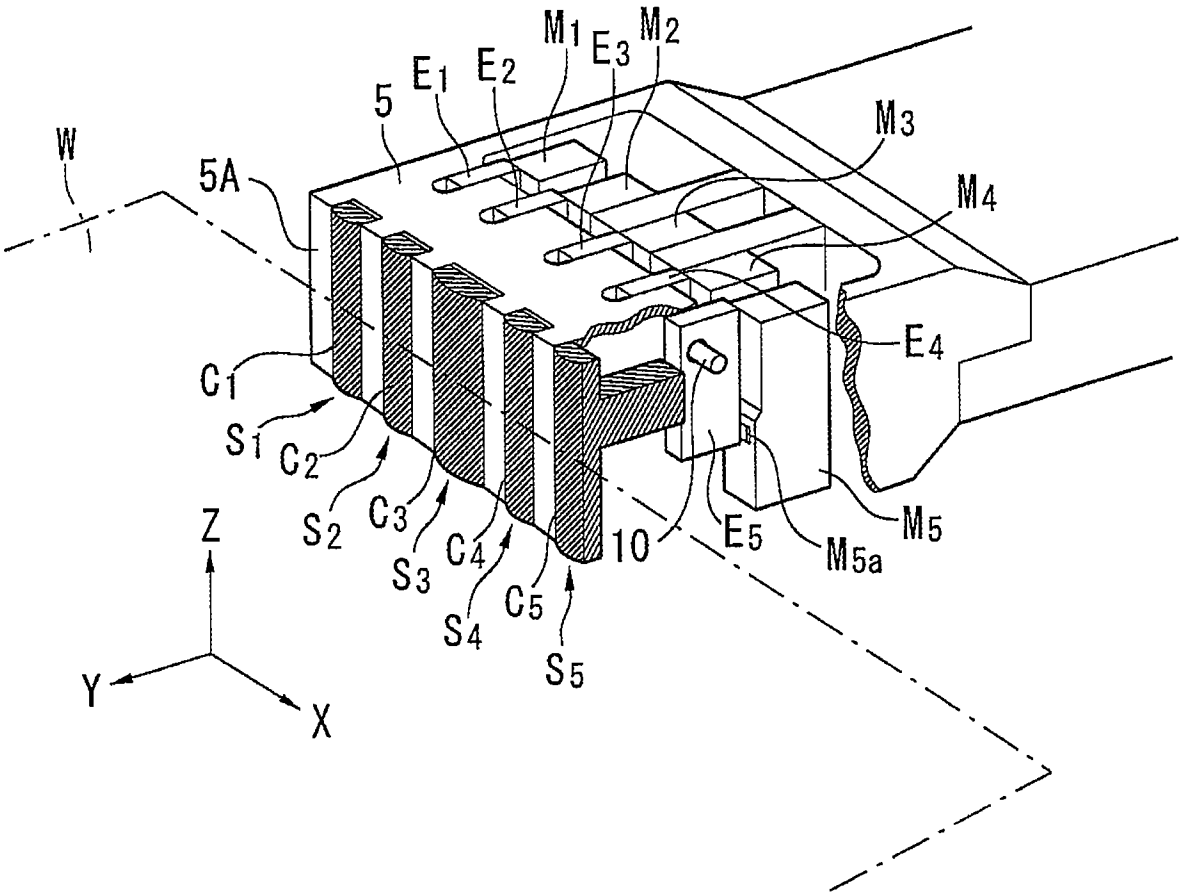
FIG. 14 is a perspective view illustrating details of FIG. 13.

Each of the above-mentioned contact confirmation sensors $S_1$ to $S_5$, as illustrated in FIG. 14, includes a workpiece-abutting part $C_1$ to $C_5$, against which a workpiece W is abutted, a stroke enlarging lever $E_1$ to $E_5$ enlarging a predetermined amount the stroke of each workpiece-abutting part, and a micro switch $M_1$ to $M_5$ brought in ON when a push button is pressed and moved by the stroke that is obtained by being enlarged with each stroke enlarging lever.

Conventionally, to make a micro switch ON, the stroke of this push button needs to be not less than 0.5 mm, and to do so, the stroke of a workpiece-abutting part likewise needs to be not less than 0.5 mm.

Therefore, a workpiece-abutting part has to considerably protrude from the abutting face of the back gauge abutting part (for example, not less than 0.5 mm), and thus, the burden of an operator abutting a workpiece comes to be larger.

Moreover, even if after a micro switch has once been ON, a workpiece is returned forward (to an operator side) from any cause to be moved in a direction separate from the back gauge, the micro switch remains ON until the workpiece is spaced a predetermined distance (for example, not less than 0.5 mm).

Accordingly, even if a workpiece is not suitably abutted with respect to the back gauge, for example, a workpiece is largely slanted, a microswitch continues to be in ON state, and the workpiece is machined as it is, which is the cause of production of defective products.

Figure 15:
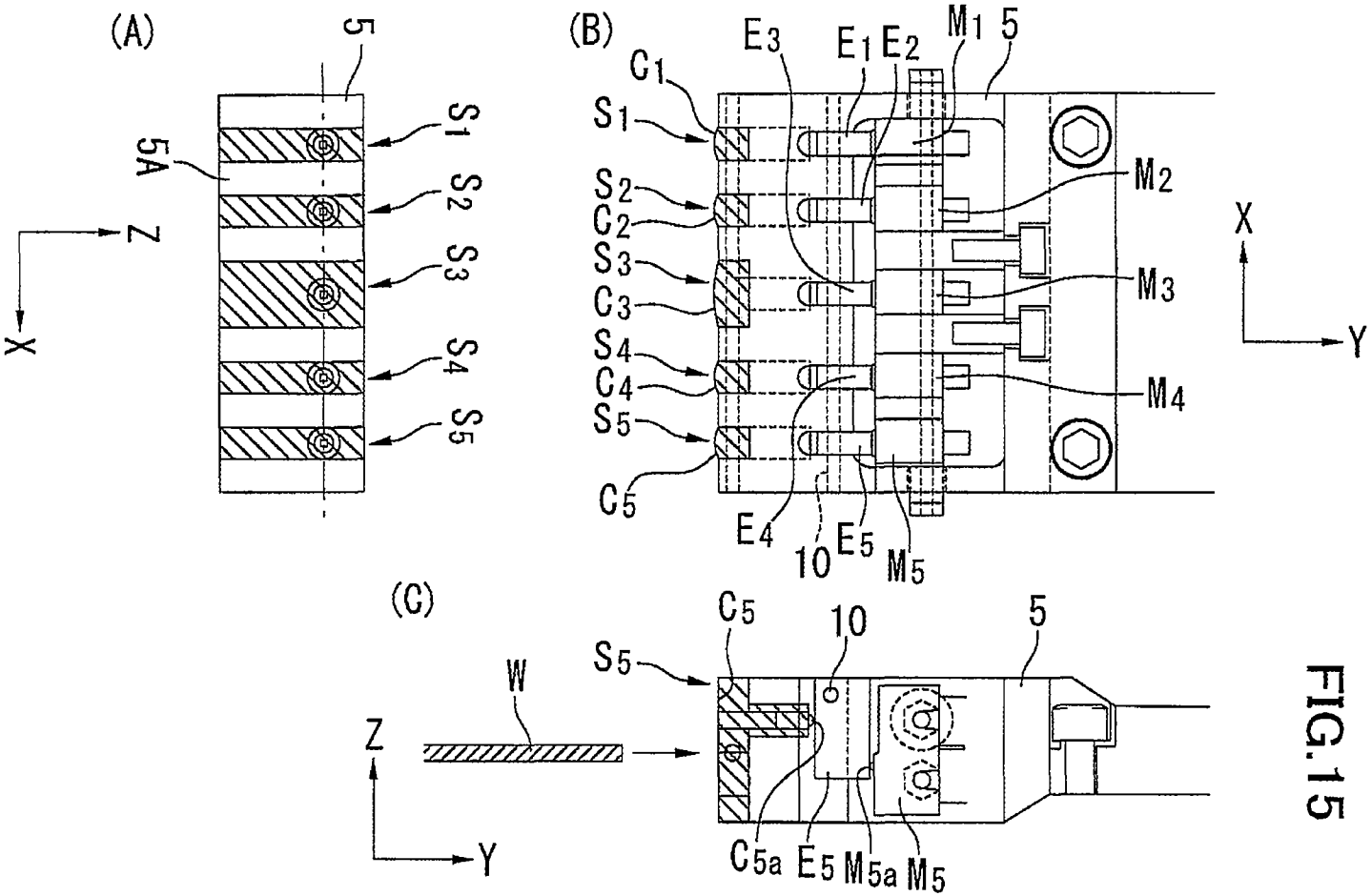
FIG. 15 are an elevation views a plan view, and a side view illustrating details of FIG. 13.

Then, as mentioned above, there are provided between the workpiece-abutting parts $C_1$ to $C_5$, (FIG. 14 and FIG. 15(B)) and the micro switches $M_1$ to $M_5$ the stroke enlarging levers $E_1$ to $E_5$, whereby, even if the stroke of a workpiece-abutting part itself is comparatively small (for example, 0.2 mm (subtle displacement), the stroke $Y_2$ of a push button of the micro switch is made comparatively large as conventionally (for example, 0.6 mm (enlarged displacement)), and thus the micro switch in the same structure as is conventional is brought in ON.

Consequently, no problem as mentioned above occurs, and thus the burden of an operator comes to be smaller.

In other words, conventionally, even if a workpiece is spaced apart from the back gauge, a micro switch remains in ON state until it is spaced, for example, not less than 0.5 mm, and the workpiece may be machined as it is; while, by provision of mentioned stroke enlarging levers $E_1$ to $E_5$, in the similar case, supposing that a workpiece is spaced, for example, not less than 0.2 mm, a push button is moved larger not less than 0.6 mm and returned to the original position, so that the micro switch immediately becomes in OFF state, resulting in no possibility of the workpiece being machined.

The workpiece-abutting parts $C_1$ to $C_5$ forming the above-mentioned contact confirmation sensors $S_1$ to $S_5$ (FIG. 14) are biased with springs, normally to protrude about 0.2 mm forward (to the workpiece W side) from an abutting face 5A.

Furthermore, each of the workpiece-abutting parts $C_1$ to $C_5$ has substantially the same dimension in the vertical direction (Z-axis direction) as the vertical dimension of mentioned abutting face 5A, whereby the contact area thereof with a workpiece W is enlarged.

In addition, the space between respective workpiece-abutting parts $C_1$ to $C_5$ (FIG. 15(B)) is the same, and is, for example, about 5 mm; and the width (X-axis direction) of the middle workpiece-abutting part $C_3$ is comparatively large (for example, about 10 mm), and the width of the other workpiece-abutting parts $C_1$, $C_2$, $C_4$, $C_5$ is comparatively small (for example, about 5 mm), thus allowing to suit the shape and dimension of various abutting parts of a workpiece w.

At the rear of the workpiece-abutting parts $C_1$ to $C_5$ having such construction, protrusions (for example, a protrusion $C_{5a}$ (FIG. 15(C)) with respect to the workpiece-abutting part $C_5$) are provided, and these protrusions are abutted against the stroke enlarging levers $E_1$ to $E_5$, that is, the front (workpiece W side) of the enlarging levers $E_1$ to $E_5$.

Furthermore, each of the enlarging levers $E_1$ to $E_5$ can be pivoted about a common pivot shaft 10, as well as is abutted against a push button in the front of the micro switches $M_1$ to $M_5$ (for example, as to a micro switch $M_5$, a push button $M_{5a}$ (FIG. 15(C)).

In each of the micro switches $M_1$ to $M_5$, when a push button is pressed and moved about 0.5 mm with mentioned enlarging levers $E_1$ to $E_5$, as well known, due to that a moving contact and fixed contact that are contained therein are brought in contact, ON signal is output.

Owing to this construction, for example, by causing a workpiece W (FIG. 15(C)) to abut against the workpiece-abutting pare $C_5$ of the contact confirmation sensor $S_5$, when this workpiece-abutting part $C_5$ is pressed 0.2 mm, the corresponding enlarging lever $E_5$ is pivoted in the counterclockwise direction accompanied thereby, whereby the push button $M_{5a}$ of the micro switch $M_5$ is pressed by a stroke enlarged substantially three times, that is 0.6 mm.

Therefore, this push button $M_{5a}$ will be pressed not less than 0.5 mm, being a stroke necessary for making the micro switch $M_5$ ON, whereby the contact confirmation sensor $S_5$ is ON.

Furthermore, for example, when a workpiece W having been abutted against the workpiece-abutting part $C_5$ (FIG. 15(C)) is separated therefrom, and this workpiece-abutting part $C_5$ is returned to the original position by 0.2 mm, accompanied thereby, the corresponding enlarging lever $E_5$ is pivoted in the clockwise direction, whereby the push button $M_{5a}$ of the micro switch $M_5$ is returned to the original position by mentioned 0.6 mm, being the stroke enlarged substantially three times.

Accordingly, the push button $M_{5a}$ is returned only not less than 0.5 mm, being the stroke necessary for making the micro switch $M_5$ OFF, whereby the contact confirmation sensor $S_5$ will be OFF.

Figure 18:
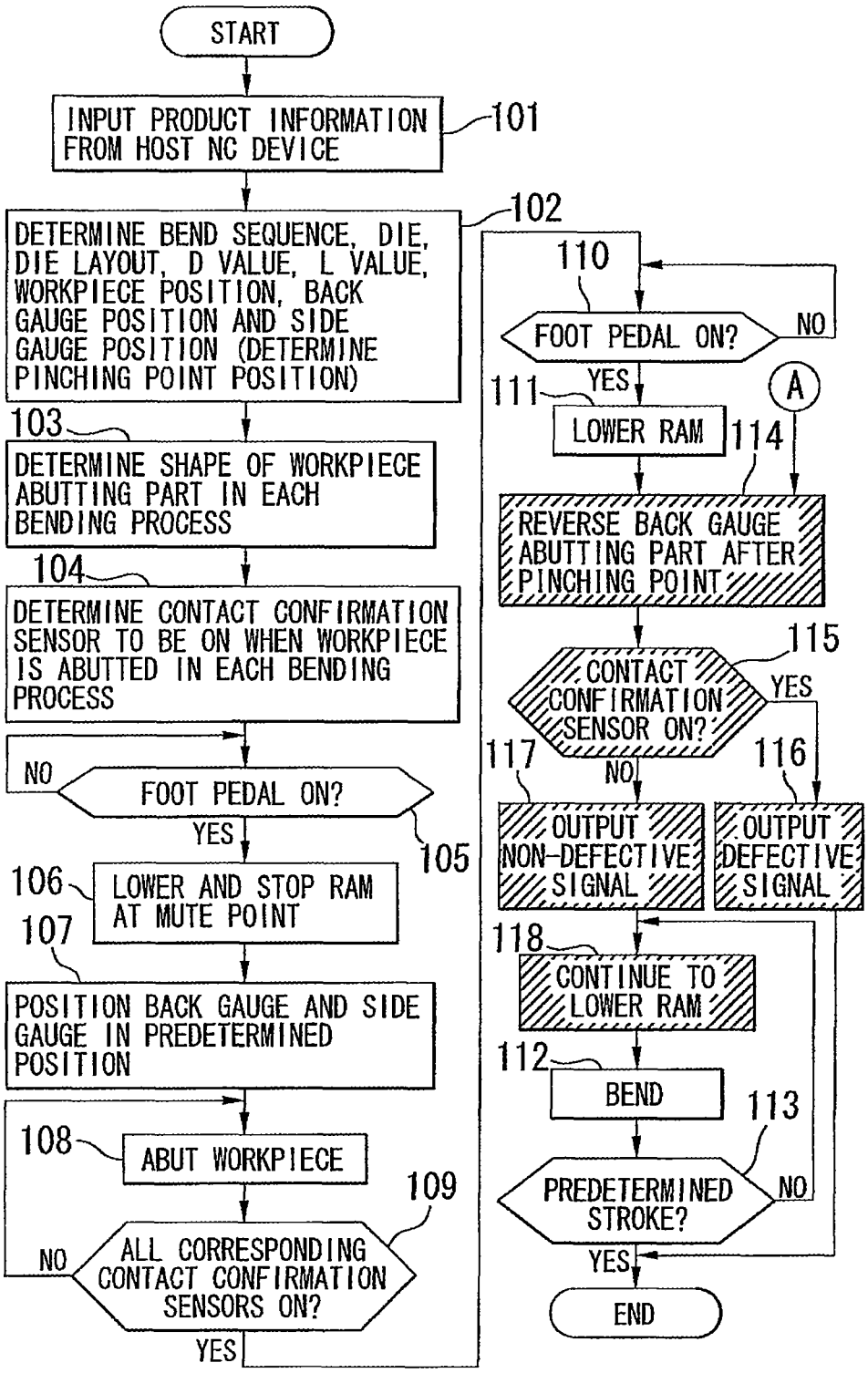
FIG. 18 is a flowchart for explaining operations of the second invention (in the case where a ram 1 is stopped at a mute point).

Using the contact confirmation sensors $S_1$ to $S_5$ making ON/OFF operation like this (FIG. 13), for example, at the time of workpiece positioning, as well known, in the case where all the sensors having preliminarily been determined (Step 104 of FIG. 18) of the above-mentioned plurality of contact confirmation sensors $S_1$ to $S_5$ are ON (Step 109 of FIG. 18), a workpiece abutting part and a back gauge abutting part 5 are regarded to suitably abut, and to perform bending, by making the foot pedal 6 ON, the ram 1 is lowered (Steps 110 to 111 of FIG. 18).

Moreover, for example, mentioned ram 1 is lowered (Step 111 of FIG. 18), and as described already, when the back gauge abutting part 5 is reversed after pinching point at which a punch P is in contact with a workpiece W (Step 114 of FIG. 18), ON or OFF of the contact confirmation sensor is determined; and in the case where at least one of mentioned plurality of contact confirmation sensors $S_1$ to $S_5$ is ON (YES in Step 115 of FIG. 18), misregistration of a workpiece W is regarded to occur, to output a defective signal A (Step 116 of FIG. 18), and in the case where all the sensors are OFF (NO in Step 115 of FIG. 18), misregistration of a workpiece W is regarded not to occur, to output a non-defective signal 8 (Step 117 of FIG. 18).

Whereby, the present invention, likewise, as described already, provided are a bending method and a machine thereof in which due to that defective products and non-defective products are detected at an early stage, waste materials are eliminated to decrease the cost of materials, and inspection processes after machining are omitted to shorten an inspection time, as well as the appointed date of delivery of non-defective products is made earlier, thus improving the entire efficiency of machining.

On the other hand, there is located in the vicinity of mentioned lower table 2 (FIG. 12) a foot pedal 6, and as mentioned above, in the case where all the corresponding contact confirmation sensors are ON (YES of Step 109 of FIG. 18), to perform machining, this foot pedal 6 is to be ON (Step 110 of FIG. 18).

Furthermore, there is provided in the above-mentioned press brake (FIG. 12) punch contact detecting means, and this punch contact detecting means detects that a punch P is in contact with a workpiece W, and is formed of, for example, ram position detecting means 27 or pressure detecting means.

This ram position detecting means 27, with a workpiece plate thickness information included in the below-described product information J, detects that a punch P has reached the top position of a workpiece W having preliminarily been determined, that is, detects that the punch P has reached a pinching point PP, and as mentioned above, thereafter, the back gauge abutting part 5 is reversed (Step 114 of FIG. 18).

In addition, pressure detecting means is, for example, a pressure sensor, and detects the rise of pressure when a punch P is in contact with a workpiece W.

An NC device 24 of the press bake having such construction (FIG. 12) is constructed of CPU 24A, input means 24B, storage means 24*c*, bend sequence, die and the like determining means 24D, contact confirmation sensor determining means 24E, back gauge and side gauge control means 24F, ram control means 24G, and defective and non-defective signal generating means 24H.

The CPU 24A makes an integrated control of the entire device illustrated in FIG. 1 such as bend sequence, die and the like determining means 24D and contact confirmation sensor determining means 24E based on an operating procedure for carrying out the present invention (for example, corresponding to FIG. 18).

Input means 24B is formed of, for example, an operation panel mounted in a movable manner onto the upper table 1, and input with a product information J from a host NC device 23 (Step 101 of FIG. 18); and this input product information J is stored in the below-described storage means 24C to be used for determination of bend sequence, die, die layout and the like, and besides for position determination of a pinching point PP, being the position in which a punch P is contacted with a workpiece W (Step 102 of FIG. 7).

A product information J is, for example, CAD information, includes information of the plate thickness of a workpiece W, material, the length of a bend line, the bend angle of a product, a flange dimension and the like, and is constructed as a stereoscopic profile sketch and a development elevation.

Furthermore, the host NC device 23 is placed in, for example, an office, and the NC device 24 is placed in, for example, a factory where mentioned press brake is located as a sub NC device with respect to this host NC device.

Moreover, in the example illustrated in FIG. 12, a product information J is stored in mentioned host NC device 23, and the NC device 24 provided with this product information J from the host NC device 23 controls operation of the present invention (FIG. 18).

The present invention, however, is not limited to this arrangement, the host NC device 23 also includes bend sequence, die and the like determining means 24D, contact confirmation sensor determining means 24E and the like as the NC device 24, and this host NC device 23 can directly control operation of the present invention by making a predetermined data processing based on the product information J stored therein (FIG. 18).

Furthermore, as for the input means 24B of mentioned NC device 24, it is also possible that a product information J is input manually by an operator S, not input from the host NC device 23.

Storage means 24C (FIG. 12) stores mentioned product information J, additionally a machining program corresponding to an operating procedure according to the present invention, and the like; and the CPU 24 controls all the operations based on this machining program.

Bend sequence, die and the like determining means 24D (FIG. 12), based on mentioned product information J, determines the bend sequence of a workpiece W, dies P and D to be used in each bend sequence (bending process), die layout, the position of the workpiece W and the position of the back gauge 7, additionally determines D value, L value, and the position of the side gauge 8 respectively, and further, as described already, determines the position of a pinching point (Step 102 of FIG. 18).

In this case, as well known, the position of the back gauge 7 is the position in the forward and backward directions (Y-axis direction) to be determined with the flange dimension of a workpiece w or the elongation amount of the workpiece W based on a product information J; and the position of the side gauge 8 (FIG. 13) is the position in the lateral direction (X-axis direction) to be determined with the bend line of a workpiece W likewise based on a product information J (FIG. 12).

Contact confirmation sensor determining means 24E, based on a product information J, in each bending process 1, 2 . . . , determines the shape of an abutting part of a workpiece W with respect to the back gauge 7, and determines the contact confirmation sensor that has to be ON when a workpiece W is abutted among a plurality of contact confirmation sensors $S_1$ to $S_5$ based on the contact state between this workpiece abutting part and the back gauge abutting part 5A; and as described already, when all these contact confirmation sensors having been determined are ON (YES in Step 109 of FIG. 18), the workpiece abutting part is determined to be suitably abut against the back gauge abutting part.

Back gauge and side gauge control means 24F (FIG. 12) positions mentioned back gauge 7 and side gauge 8 in a predetermined position.

In this case, as to important operations of the present invention (Step 114 to Step 118 diagonally shaded in FIG. 18), back gauge and side gauge control means 24F only controls the back gauge 7, for example, causes the back gauge abutting part 5 to reverse a predetermined amount (FIG. 16(B).

Accordingly, if there are no particular difficulties, hereinafter, back gauge and side gauge control means 24F is described as back gauge control means 24F.

Ram control means 24G (FIG. 12) drives and controls the ram 1 by controlling the oil, hydraulic cylinder 34, being a ram driving source, and, for example, as described already, when the foot pedal 6 is ON (YES in Step 110 of FIG. 18), drives the oil hydraulic cylinder 34 to lower the ram 1 (Step 111 of FIG. 18).

Furthermore, defective and non-defective signal output means 24H (FIG. 12), as described above, when the back gauge abutting part 5 is reversed (Step 114 of FIG. 18), outputs a defective signal A informing the production of a defective product based on the misregistration of a workpiece W in the case where the contact confirmation sensor is ON (YES in Step 115 of FIG. 18), and outputs a non-defective signal B informing the production of a non-defective product in the case where this contact confirmation sensor is OFF (NO in Step 115 of FIG. 18).

This defective and non-defective signal output means 24H includes (FIG. 12), for example, a buzzer 24J, and outputs a defective signal A or a non-defective signal B that is composed of sounds an operator recognizes with this buzzer 24J.

Moreover, defective and non-defective signal output means 24H can output a defective signal A or a non-defective signal B that is formed of light such as patlites.

Hereinafter, operations according to the present invention including the above-mentioned construction are described with reference to FIGS. 16 to 18.

(1) Operation Until Punch P has Reached Pinching Point PP

In this case, as well known, a product information J is input from the host NC device 23 (Step 101 of FIG. 18), after a bend sequence, die, die layout and the like, and additionally a pinching point position have been determined (Step 102 of FIG. 138), predetermined operations are made (Steps 103 to 108 of FIG. 18), in the case where all the corresponding contact confirmation sensors of mentioned plurality of contact confirmation sensors (FIG. 13) are ON (YES in Step 109 of FIG. 18), a workpiece abutting part is determined to suitably abut against the back gauge abutting part 5, so that supposing that the foot pedal 6 is ON (Step 110 of FIG. 18), and the ram is lowered (Step 111 of FIG. 18), whereby a punch P has reached a pinching point PP (Step 114 of FIG. 18).

(2) Reverse Operation of Back Gauge Abutting Part 5

Then, after mentioned punch P has reached a pinching point PP (after pinching point), the back gauge abutting part 5 is reversed (Step 114 of FIG. 18).

That is, during the ram 1 being lowered (Step 111 of FIG. 18), CPU 24A (FIG. 12) monitors the position of the ram 1 via mentioned ram position detecting means 27, when a detection signal d indicating that a punch P has reached a pinching point PP is transmitted with respect to back gauge control means 24F from this ram position detecting means 27, regards a workpiece Was being clamped with a punch P and a die D, and causes the back gauge abutting part 5 to reverse a predetermined amount via this back gauge control means 21F.

(3) Determination Operation of Whether or not Contact Confirmation Sensors $S_1$ to $S_5$ are ON Next, it is determined whether or not the contact confirmation sensors $S_1$ to $S_5$ are ON (Step 115 of FIG. 18).

That is, CPU 24A (FIG. 12), when detecting that mentioned back gauge abutting part 5 has been reversed (Stop 114 of FIG. 18), determines whether or not a contact confirmation sensor located at the back gauge abutting part 5 is ON (Step 115 of FIG. 18).

(4) Operation in the Case where Contact Confirmation Sensor is ON

As the result of mentioned determination, in the case where the contact confirmation sensor is ON (YES in Step 115 of FIG. 18), a defective signal A is output (Step 116 of FIG. 18).

Figure 16:
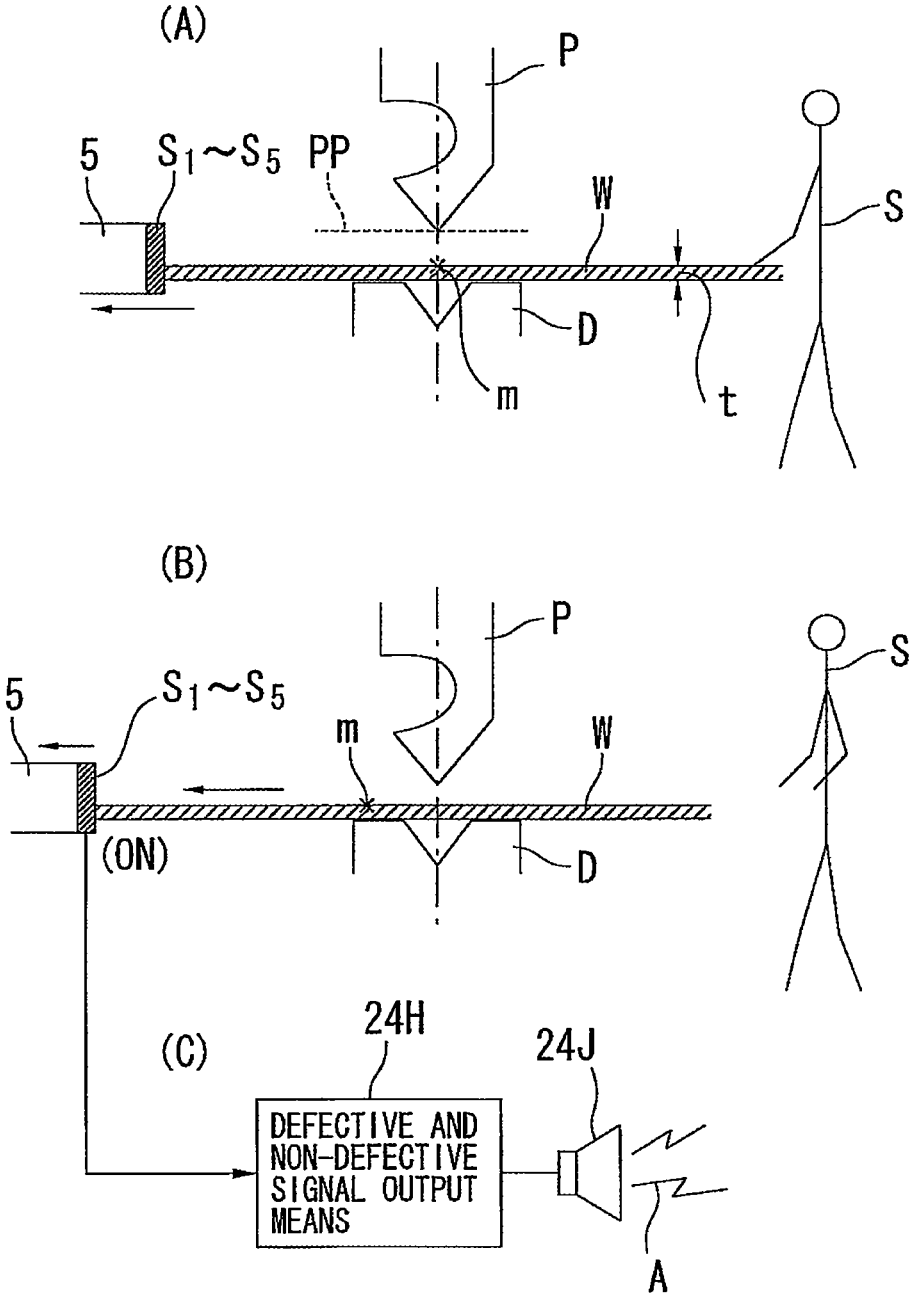
FIG. 16 are operation explanatory views in the case of production of a defective product in the second invention.

That is, in this case, as illustrated in FIG. 16, although a punch P (FIG. 16(A)) has reached a pinching point PP, the plate thickness t of a workpiece W is different from a nominal plate thickness and actually a thin plate thickness t, and thus the workpiece W is in a non-clamped state.

Therefore, when the back gauge abutting part 5 (FIG. 16(B)) is reversed, an operator is to push a workpiece W to the abutting part 5, so that the workpiece W is also reversed accompanied by the reverse of this abutting part 5, whereby this workpiece w is in the state of being abutted against the abutting part 5, and thus the contact confirmation sensor comes to be ON (as described already, in the case where there are provided a plurality of contact confirmation sensors, at least one may come to be ON).

As a result, a bend line m on a workpiece W will be shifted from the tip of a punch P, resulting in the occurrence of misregistration.

Defective and non-defective output means 24H to which this ON signal is input (FIG. 16 (C)) regards that a defective product is produced due to the misregistration of a workpiece W, outputs a defective signal A through a buzzer 24J, and informs an operator S of the production of a defective product.

In addition, in synchronization with output of a defective signal A, the ram 1 (FIG. 12) is stopped.

(5) Operation in the Case where No Contact Confirmation Sensor is ON

Furthermore, as the result of mentioned determination, in the case where no contact confirmation sensor is ON(NO in Step 115 of FIG. 18), that is, in the case where the contact confirmation sensor is OFF, a non-defective signal 1 is output (Step 117 of FIG. 18), the ram 1 continues to be lowered (Step 118 of FIG. 18), bending is made (Step 112 of FIG. 18), and in the case where the ram has reached a predetermined stroke (YES in Step 113 of FIG. 18), bending is ended.

Figure 17:
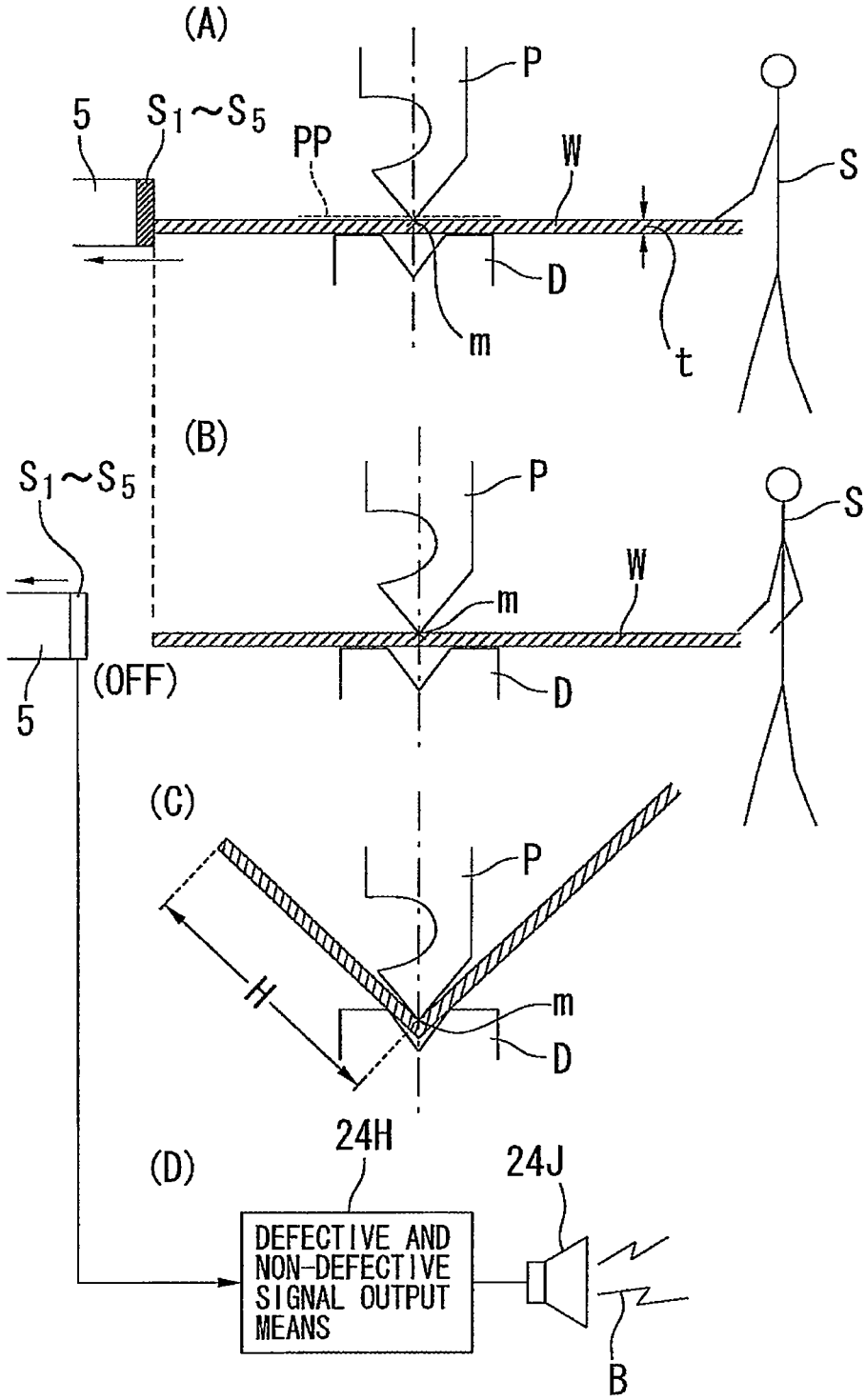
FIG. 17 are operation explanatory views in the case of production of a non-defective product in the second invention.

That is, in this case, as illustrated in FIG. 17, the plate thickness t of a workpiece W (FIG. 17(A)) is the same as the nominal plate thickness, and thus there is no error; and at the same time as a punch P has reached a punching point PP, the workpiece W is in the clamped state with a punch P and a die D.

Therefore, when the back gauge abutting part 5 (FIG. 17(B)) is reversed, a workpiece W comes not to abut against the abutting part 5, and thus the contact confirmation sensors $S_1$ to $S_5$ will be in OFF state (as described already, in the case where there are provided a plurality of contact confirmation sensors, all of them are in OFF state).

As a result, the bend line m on a workpiece W is aligned with the tip of a punch P in contact, the workpiece W is suitably positioned, and the ram 1 (FIG. 12) continues to lower as it is, whereby a flange F having a predetermined dimension H (FIG. 17(C)) is formed, thus producing a non-defective product.

In this case, as mentioned above, based on the state in which the contact confirmation sensors $S_1$ to $S_5$ (FIG. 17(B)) are OFF, for example, on the conditions that no ON signal is input for a predetermined time period, defective and non-defective signal output means 24H (FIG. 17(D)) regards as a non-defective product being produced by a suitable positioning of the workpiece W, outputs a non-defective signal B via a buzzer 24J, and informs an operator S of the production of a non-defective product.

Figure 19:
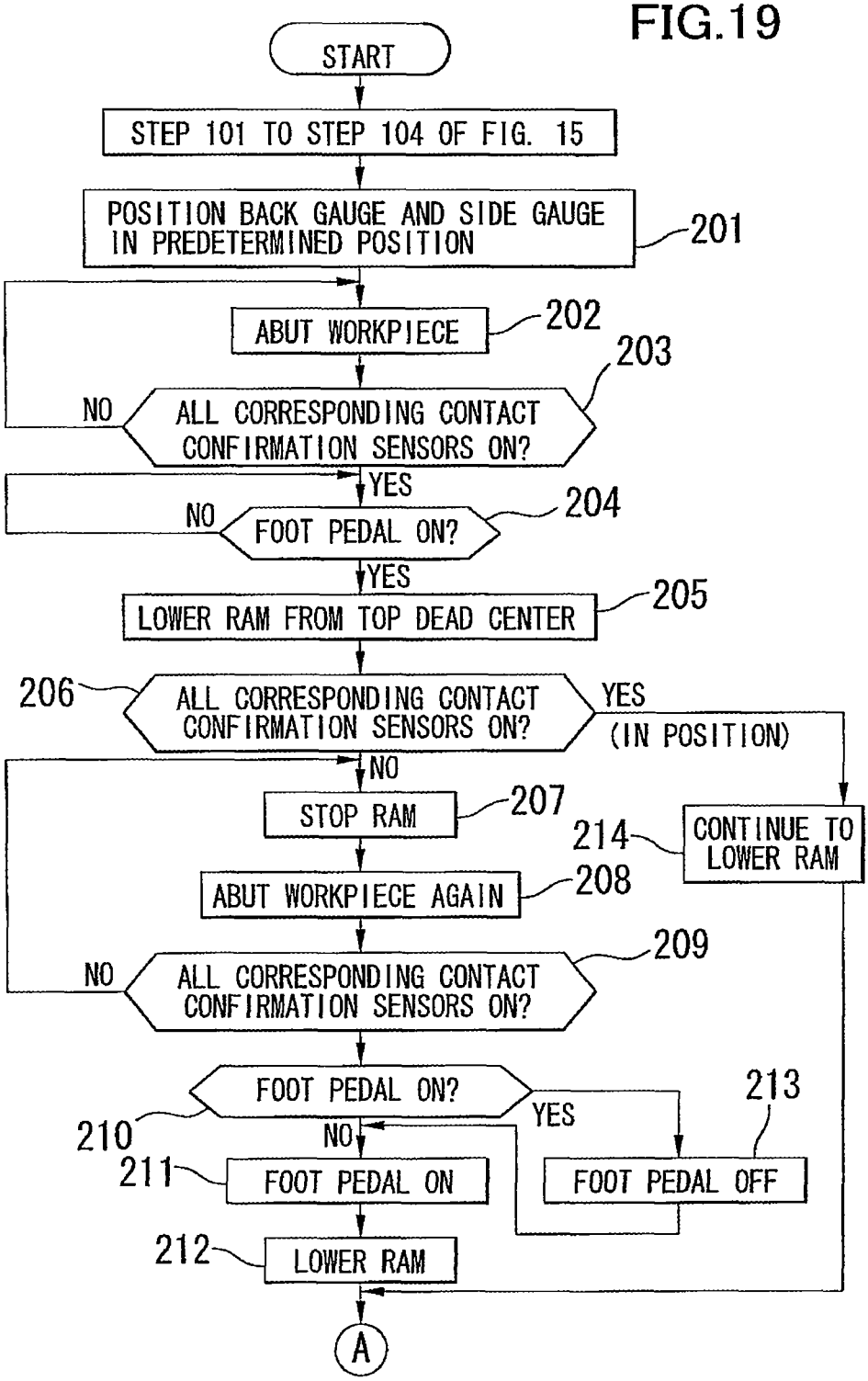
FIG. 19 is a flowchart for explaining another operation according to the second invention (in the case where the ram 1 is not stopped at a mute point).
Figure 20:
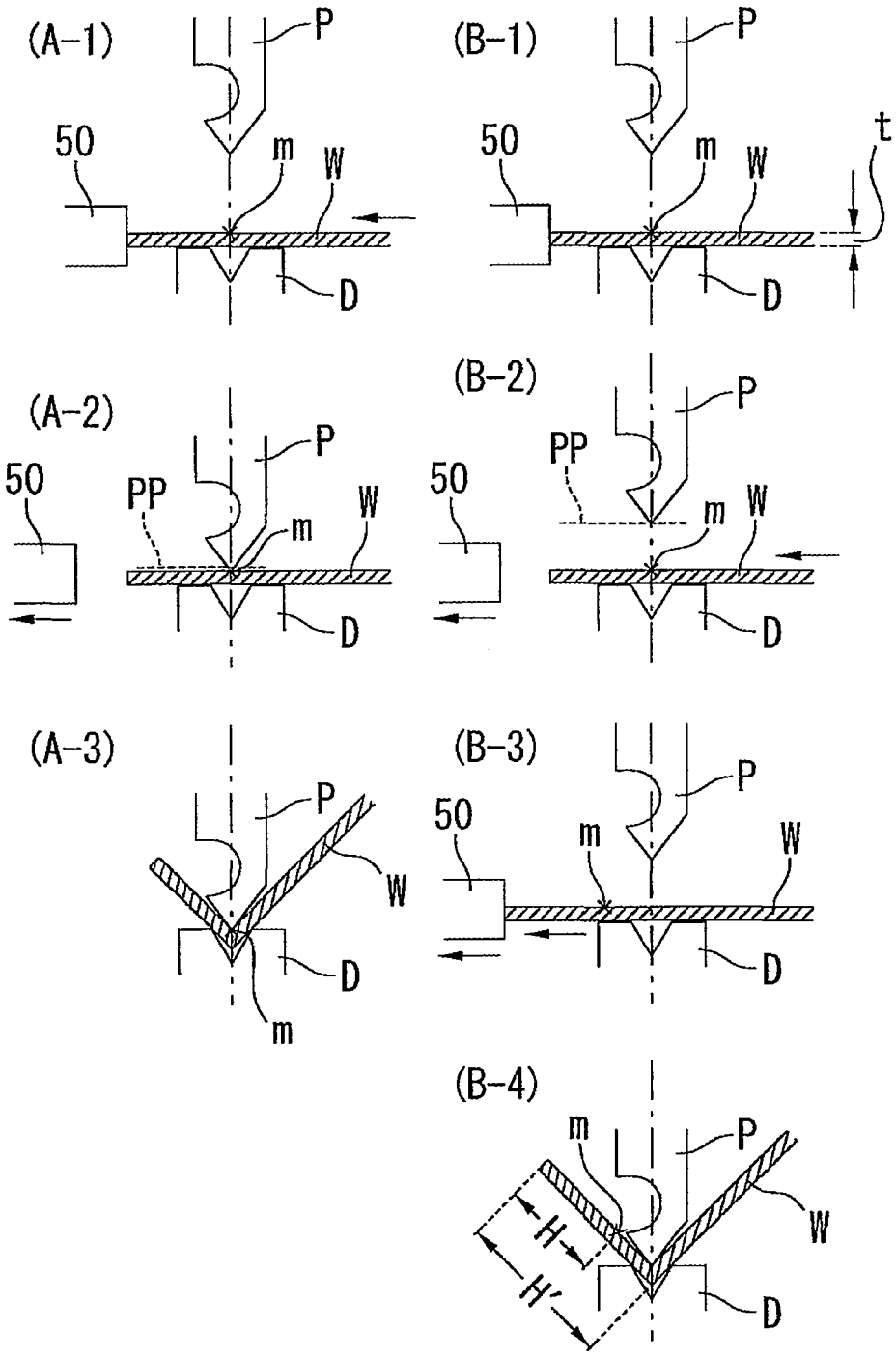
FIG.20 Prior Art
FIG. 20 are explanatory views of a conventional art according to the second invention.

FIG. 19 illustrates another example of operation according to the present invention, which different from the case of mentioned FIG. 18 (Step 106 of FIG. 18), is the case where the ram 1 is not stopped at a mute point.

(1) Operation Until Ram 1 is Lowered from Top Dead Center

As illustrated in FIG. 19, at the beginning, exactly the same operations from Step 101 to Step 104 of FIG. 18 are made, subsequently, after the back gauge 7 (FIG. 13) and the side gauge 8 are positioned in predetermined positions (Step 201 of FIG. 19), a workpiece W is abutted against the back gauge 7 and the side gauge 8 (Step 202 of FIG. 19), when all the corresponding contact confirmation sensors are ON (YES of Step 203 of FIG. 19), the workpiece W is regarded to be positioned, and the foot pedal 6 is ON (YES of Step 204 of FIG. 19), whereby the ram 1 is lowered from a top dead center (Step 205 of FIG. 19).

(2) Operation in the Case where During the Ram 1 being Lowered from Top Dead Center, Workpiece W Remains to be Abutted Against Back Gauge Abutting Part 5, as Well as all Corresponding Contact Confirmation Sensors are ON In this case, at a time point when all the corresponding contact confirmation sensors are ON (YES in Step 206 of FIG. 19), positioning of a workpiece W is regarded to complete, and the ram 1 continues to be lowered (Step 214 of FIG. 19), whereby operation goes to Step 114 of FIG. 18 as already described, and then exactly the same operations from Step 114 to Step 113 of FIG. 18 are made, thereby outputting a defective signal A or a non-defective signal B via defective and non-defective signal output means 24H to inform an operator of the production of a defective product or a non-defective product.

(3) Operation in the Case where During the Ram 1 being Lowered from Top Dead Center, Workpiece W is Separated from Back Gauge Abutting Part 5, and all the Corresponding Contact Confirmation Sensors are not ON In this case, at a time point when all the corresponding contact confirmation sensors are not ON (NO in Step 206 of FIG. 19), that is, at a time point when at least one of the corresponding contact confirmation sensors is OFF, the ram 1 in lowering is stopped (Step 207 of FIG. 19), and a workpiece W is abutted against the back gauge 7 and the side gauge 8 again (Step 208 of FIG. 19); and in the case where all the corresponding contact confirmation sensors are ON (YES in Step 209 of FIG. 19), positioning of the workpiece W is regarded to complete, and then it is determined whether or not the foot pedal 6 is ON (Step 210 of FIG. 19).

Furthermore, in the case where the foot pedal 6 is ON (YES in Step 210 of FIG. 19), the foot pedal 6 is once brought in OFF (Step 213 of FIG. 19), and thereafter made ON again (depressed again) (Step 211 of FIG. 19), whereby the ram 1 is lowered (Step 212 of FIG. 19), thus preventing dangers.

Moreover, in the case where the foot pedal 6 is not ON(NO in Step 210 of FIG. 19), the foot pedal 6 continues to be ON as it is (Step 211 of FIG. 19), whereby the ram 1 is lowered (Step 212 of FIG. 19).

After mentioned ram 1 has been lowered (Step 212 of FIG. 19), operation goes to Step 114 of FIG. 18 as described already, and then exactly the same operations from Step 114 to Step 113 of FIG. 18*a* are made, thereby outputting a defective signal A or a non-defective signal B via defective and non-defective signal output means 24H to inform an operator of the production of a defective product or a non-defective product.

C. Third Invention

Figure 21:
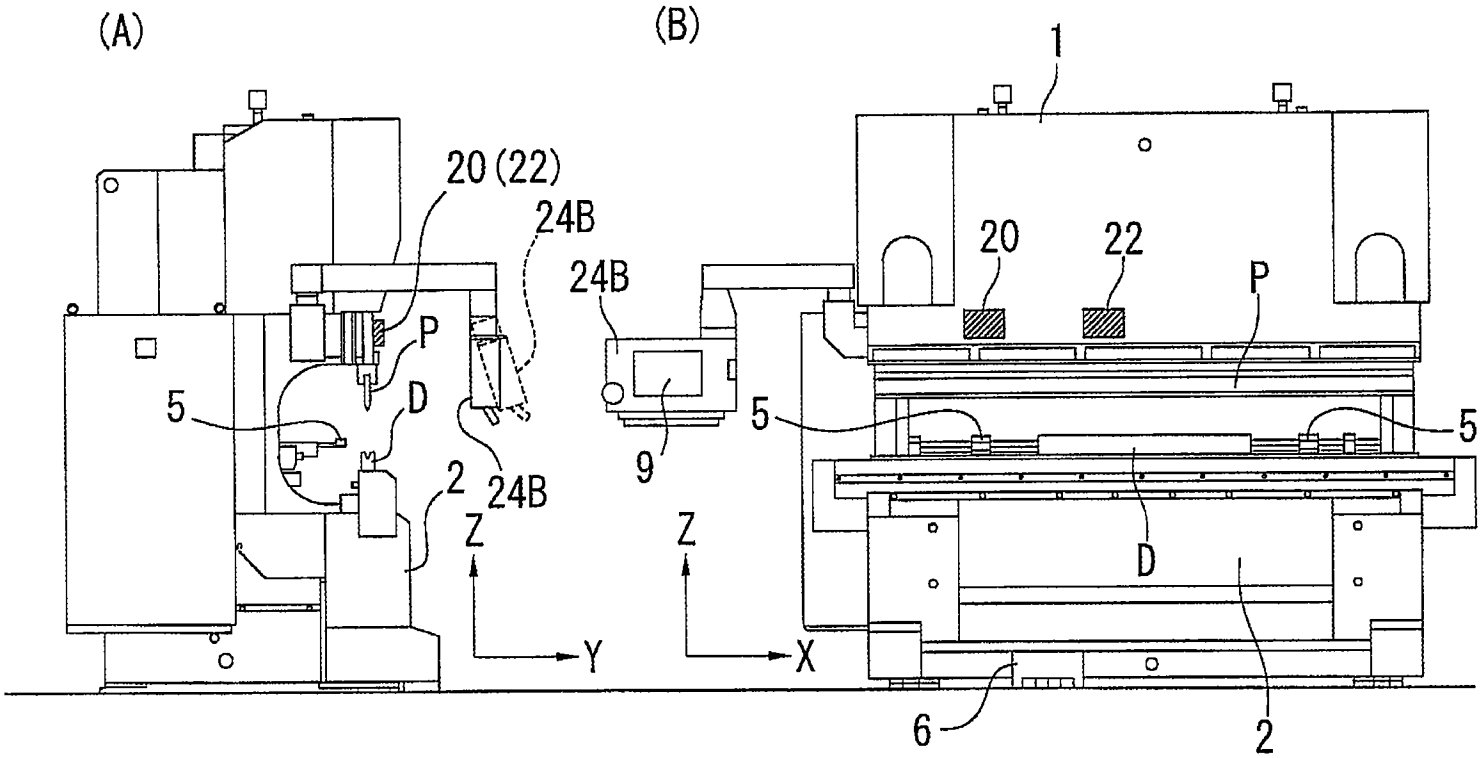
FIG. 21 are entire views illustrating an exemplary embodiment according to a third invention and a fourth invention.

FIG. 21 is an entire view illustrating an exemplary embodiment according to a third invention and a fourth invention of the present invention, and an illustrated bending machine is, for example, a press brake.

To this press brake, an upper table 1, being a ram is attached, for example, via an oil hydraulic cylinder, and a punch P is mounted onto this upper table 1, as well as a die D is mounted onto a lower table 2.

Figure 22:
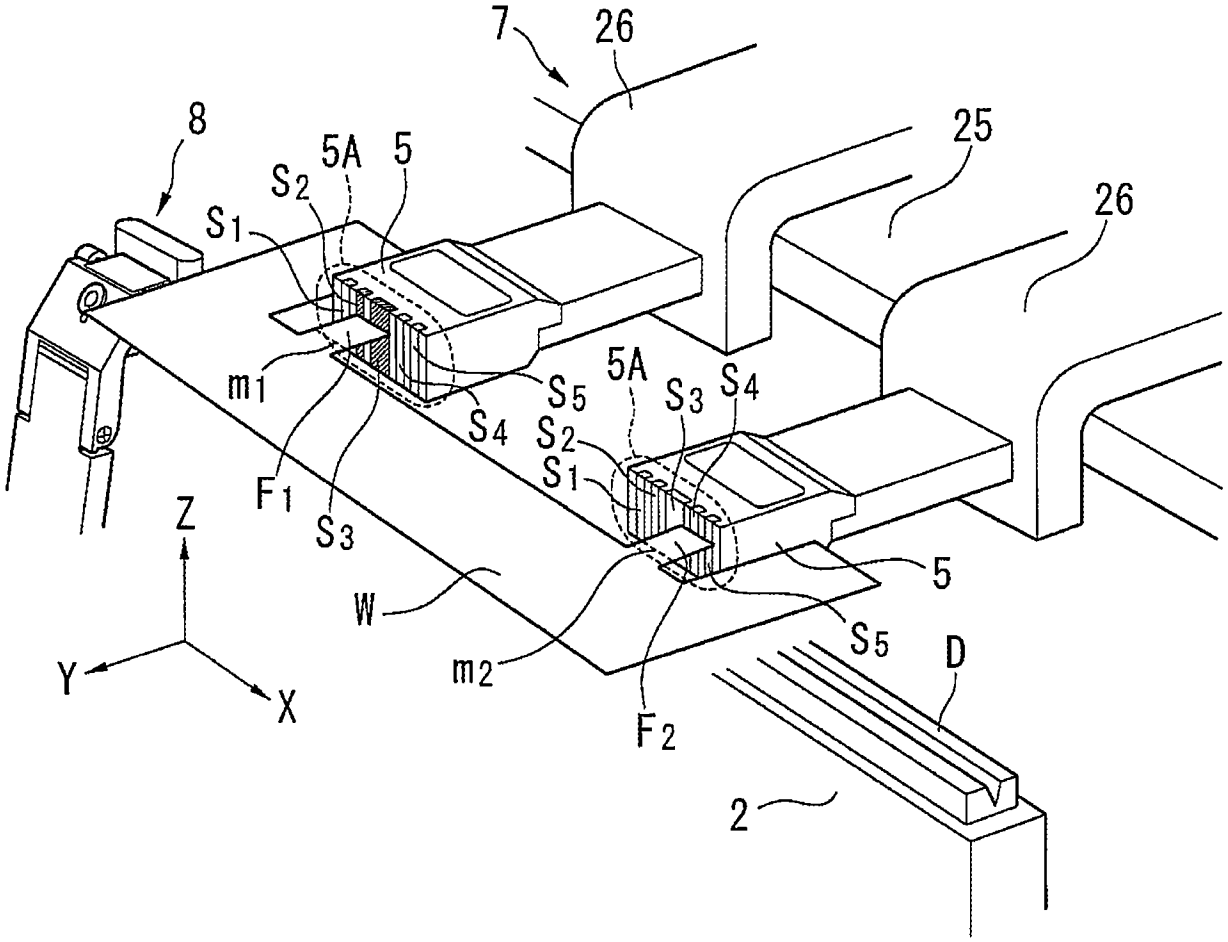
FIG. 22 is a perspective view of contact confirmation sensors $S_1$, $S_2$, $S_3$, $S_4$, $S_5$ an operation panel 20 or 22 according to the third invention selects and specifies.

Behind mentioned lower table 2 (FIG. 21), as illustrated in FIG. 22 in which contact confirmation sensors to be selected and specified according to the third invention, a back gauge 7 including an abutting part 5 is disposed, and this back gauge 7 is supported at the lower table 2, for example, via a link mechanism (illustration is omitted).

The front face of the above-mentioned abutting part 5 (FIG. 22) is an abutting face 5A against which a workpiece w is abutted, there are provided on this abutting face 5A a plurality of contact confirmation sensors $S_1$, $S_2$, $S_3$, $S_4$, $S_5$, and each contact confirmation sensor is operated independently of each other, thus enabling to confirm the contact state of the workpiece W with respect to the back gauge 7.

An operation panel 20 or 22 with which these contact confirmation sensors $S_1$ to $S_5$ can be easily selected and specified is disposed, for example, at the upper table 1 (FIG. 21) of mentioned press brake.

Figure 23:
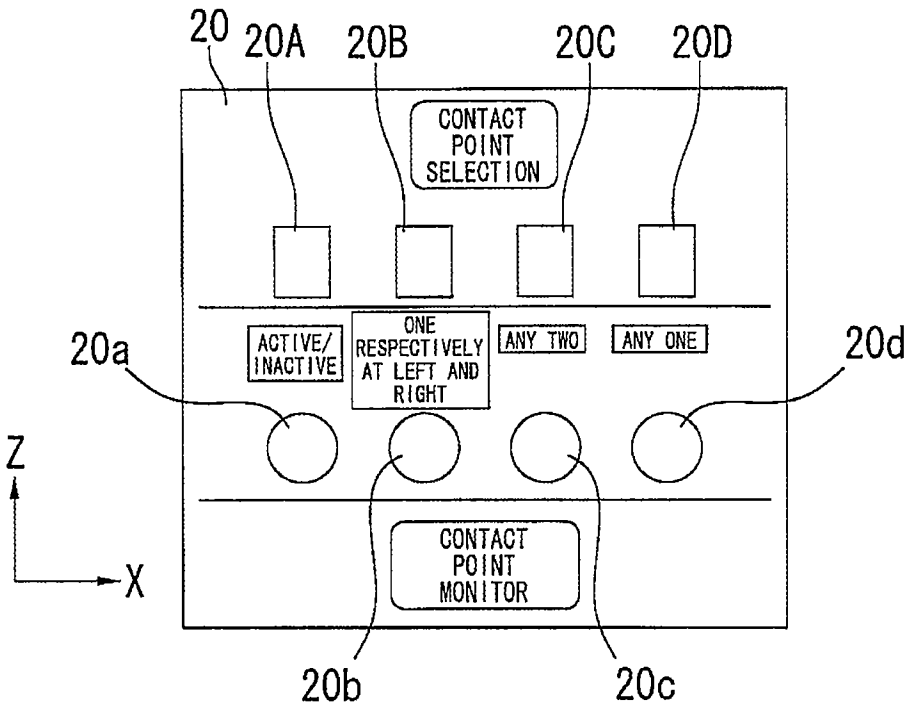
FIG. 23 is a diagram showing an exemplary embodiment in the case where the operation panel 20 according to the third invention is formed of touch panel.

Of these, the operation panel 20, as illustrated in FIG. 23, for example, is constructed of a touch panel.

There are provided at the upper portion of this touch panel 20, for example, four push button switches, and as illustrated, in the order from the left side, "active/inactive" push button switch 20A, "one respectively at left and right" push button switch 20B, "any two" push button switch 20C, and "any one" push button switch 20D are disposed respectively.

Furthermore, at the lower portion of the touch panel 20, corresponding to mentioned push button switches 20A to 20D, monitor display lamps 20*a* to 20*d* are likewise disposed respectively.

Of these, the "active/inactive" push button switch 20A is a switch an operator presses in the case where bending is performed using a plurality of contact confirmation sensors $S_1$ to $S_5$ disposed at one back gauge abutting part 5 of mentioned FIG. 22, and by pressing this "active/inactively" push button switch 20A, the corresponding monitor display lamp 20*a* is lighted.

Whereby, in the case where the remaining push button switches 20B, 20C, 20D are pressed, the corresponding monitor display lamps 20*b*, 20*c*, 20*d* are lighted; as well as such a predetermined operation as which contact confirmation sensor is selected and specified in each bending process (FIG. 24), and this is stored in NC device (illustration is omitted), comes to be active, and thus, an operator can recognize that bending with the use of the already-described contact confirmation sensors $S_1$ to $S_5$ (FIG. 22) is performed.

Here, let it be assumed that there are provided at the left and right back gauge abutting parts 5 (FIG. 22) plural numbers (five) of contact confirmation sensors $S_1$ to $S_5$ respectively.

In this case, mentioned push button switch 20B (FIG. 23), by being pressed, selects and specifies not less than one contact confirmation sensor respectively at left and right from respective five contact confirmation sensors $S_1$ to $S_5$ (FIG. 22) at left and right (at least one contact confirmation sensor respectively at left and right).

That is, it is with "one respectively at left and right" push button switch 20B that not less than one contact confirmation sensor is selected and specified from the left-side contact confirmation sensors $S_1$ to $S_5$, and not less than one contact confirmation sensor is selected and specified from the right-side contact confirmation sensors $S_1$ to $S_5$.

Figure 30:
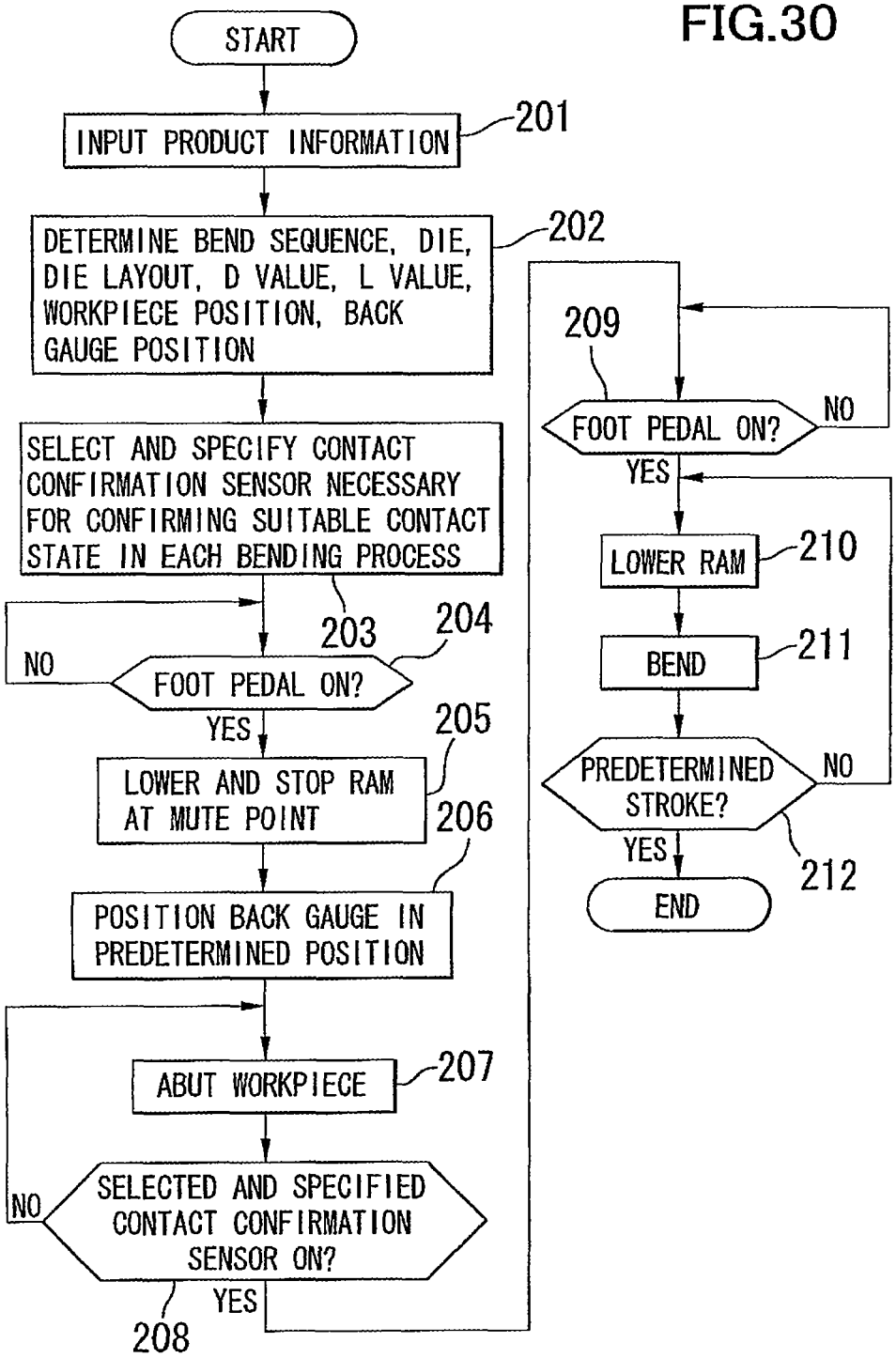
FIG. 30 is a flowchart for explaining operations of the third invention.
Figure 31:
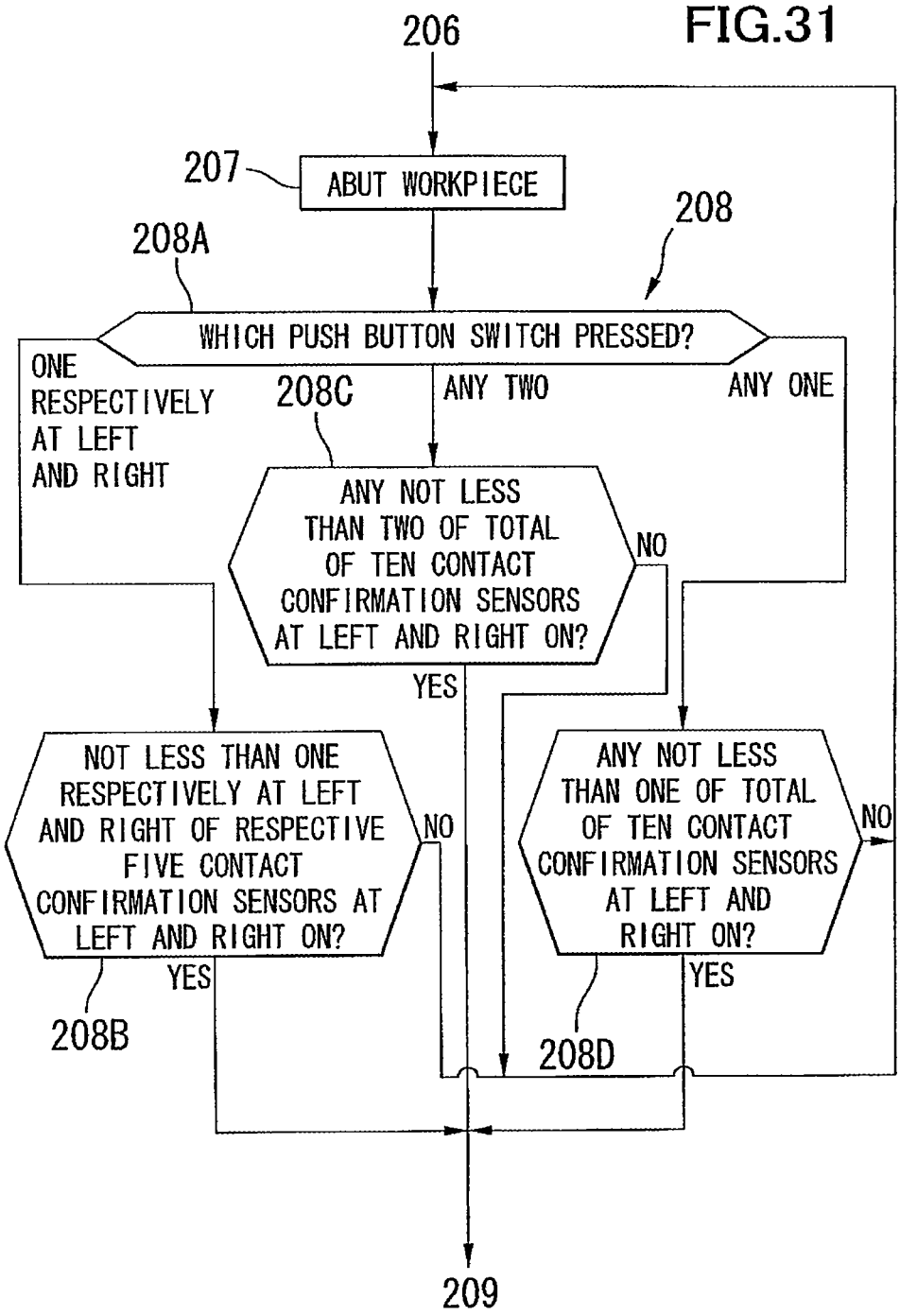
FIG. 31 is a flowchart explaining details of FIG. 30.

In the case where this "one respectively at left and right" push button switch 20B (FIG. 23) is pressed (indicated by a left-hand arrow in Step 208A of FIG. 31 showing details of Step 208 of FIG. 30), when not less than one contact confirmation sensor respectively at left and right from mentioned respective five contact confirmation sensors $S_1$ to $S_5$, at left and right (FIG. 22) (YES in Step 208B of FIG. 31), NC device determines that a workpiece is suitably abutted, upon the foot pedal 6 (FIG. 21) being ON (YES in Step 209 of FIG. 30), and the ram 1 (FIG. 21) is lowered (Step 210 of FIG. 30).

Furthermore, mentioned push button switch 20C (FIG. 23), by being pressed, selects and specifies not less than two contact confirmation sensors (at least any two numbers) from ten numbers of contact confirmation sensors $S_1$ to $S_5$ both on the right side and the left side.

That is, it is with "any two" push button switch 20C that not less than any two contact confirmation sensors are selected and specified out of a total of ten numbers of both the left-side contact confirmation sensors $S_1$ to $S_5$ and the right-side contact confirmation sensors $S_1$ to $S_5$.

In the case where this "any two" push button switch 20C (FIG. 23) is pressed (indicated by a lower arrow in Step 208A of FIG. 31), when not less than any two contact confirmation sensors of mentioned total of ten contact confirmation sensors $S_1$ to $S_5$ on both the left side and the right side (FIG. 22) (YES in Step 208C of FIG. 31), NC device determines that a workpiece W is suitably abutted, upon the foot pedal 6 (FIG. 21) being ON (YES in Step 209 of FIG. 30), and the ram 1 (FIG. 21) is lowered (Step 210 of FIG. 30).

Furthermore, mentioned push button switch 20D (FIG. 23), by being pressed, selects and specifies not less than any one (at least any one) of a total of ten numbers of contact confirmation sensors $S_1$ to $S_5$ (FIG. 22) on both the left side and the right side.

That is, it is with "any one" push button switch 20D that not less than any one of a total of ten numbers of both five left-side contact confirmation sensors $S_1$ to $S_5$ and five right-side contact confirmation sensors $S_1$ to $S_5$.

In the case where this "any one" push button switch 20D (FIG. 23) is pressed (indicated by a right-hand arrow in Step 208A of FIG. 31), when not less than any one of mentioned total of ten numbers of contact confirmation sensors $S_1$ to $S_5$ of both the left side and the right side (FIG. 22) (YES in Step 208D of FIG. 31), NC device determines that a workpiece W is suitably abutted, upon the foot pedal 6 (FIG. 21) being ON (YES in Step 209 of FIG. 30), and the ram 1 (FIG. 21) is lowered (Step 210 of FIG. 30).

These "one respectively at left and right" push button switch 20B, "any two" push button switch 20C, or "any one" push button switch 20D, by having preliminarily been pressed before machining, selects and specifies the contact confirmation sensor necessary for confirming the suitable contact state in each bending process (Step 203 of FIG. 30).

Then, these results, as illustrated in FIG. 24, are stored in NC device as database, and the NC device searches them when driving the ram 1 (FIG. 21).

In mentioned FIG. 24, o shows a push button pressed in each bending process 1, 2, . . . , for example, in bending process 1, "one respectively at left and right" push button switch 20B is to be pressed, so that at the time of an actual machining, when not less than one contact confirmation sensor respectively at left and right is ON (YES in Step 208B of mentioned FIG. 31), a workpiece is determined to be suitably abutted.

Due to that the operation panel 20 formed of a touch panel described in detail in mentioned FIGS. 23 to 24 includes a common push button switch with respect to the left-side and right-side back gauge abutting parts 5 (FIG. 22), a plurality of contact confirmation sensors $S_1$ to $S_5$ disposed at one back gauge abutting part 5 needs not to be selected and specified individually, thus enabling to achieve shortening of a time period for selection and specification.

Figure 25:
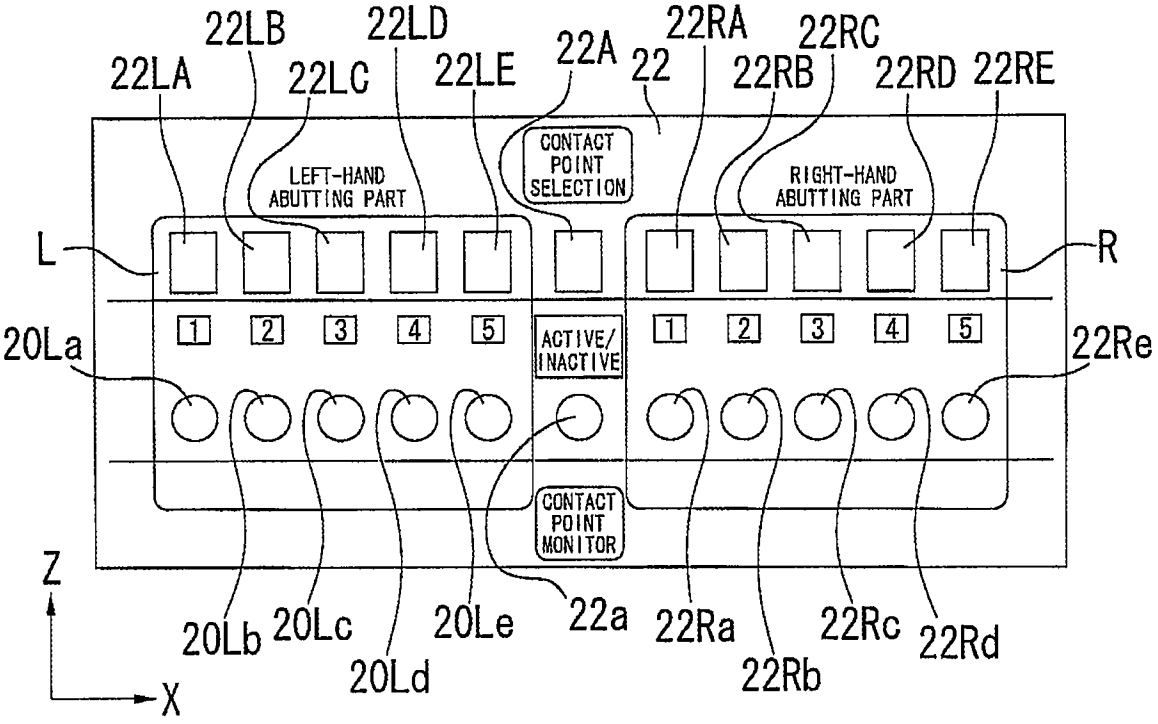
FIG. 25 is a diagram showing an exemplary embodiment in the case where the operation panel 22 according to the third invention is formed of a touch panel.

On the other hand, an operation panel 22 illustrated in FIG. 25 is likewise formed of a touch panel, but includes push button switches and monitor display lamps individually corresponding to the contact confirmation sensors $S_1$ to $S_5$, disposed in plural at respective left-side and right-side back gauge abutting parts 5 (FIG. 22).

There is provided at the upper central portion of the touch panel 22 (FIG. 25) the already-described "active/inactive" push button switch 20A, and there are provided at the lower central portion thereof a monitor display lamp 20*a* lighted when this "active/inactive" push button switch 20A is pressed respectively.

With the central portion of mentioned touch panel 22 a boundary, on the left side and on the right side, corresponding to the left-side back gauge abutting part 5 (FIG. 22) and the right-side back gauge abutting part 5 respectively, a left-hand abutting part L (FIG. 25) and a right-hand abutting part R are disposed respectively.

Further, at the upper portion of the above-mentioned left-hand abutting part L, corresponding to a plurality of contact confirmation sensors $S_1$ to $S_5$ disposed at the left-side back gauge abutting part 5 (FIG. 22), push button switches 22LA to 22LE are provided; and at the lower portion of this left-hand abutting part L, monitor display lamps 22La to 22Le lighted when mentioned push button switches 22LA to 22LE are pressed are provided respectively.

Further, at the upper portion of the above-mentioned right-hand abutting part R, corresponding to a plurality of contact confirmation sensors $S_1$ to $S_5$ disposed at the right-side back gauge abutting part 5 (FIG. 22), push button switches 22RA to 22RE are provided; and at the lower portion of this right-hand abutting part R, monitor display lamps 22RA to 22RE lighted when mentioned push button switches 22RA to 22RE are pressed are provided respectively.

Owing to such construction, likewise, by the push button switch 20LA and the like of mentioned touch panel 22 (FIG. 25) having preliminarily been pressed before machining, the contact confirmation sensor necessary for confirming a suitable contact state is selected and specified in each bending process.

Then, these results, likewise, are created to be database (corresponding to FIG. 24) and stored in NC device, and the NC device searches them when driving the ram 1 (FIG. 21).

With the operation panel 22 formed of a touch panel described in detail in mentioned FIG. 25, the contact confirmation sensors $S_1$ to $S_5$ disposed in plural at one back gauge abutting part 5 (FIG. 22) correspond to the push button switch 22LA and the like (FIG. 25) one-to-one, so that selection and specification without mistake can be made.

Figure 26:
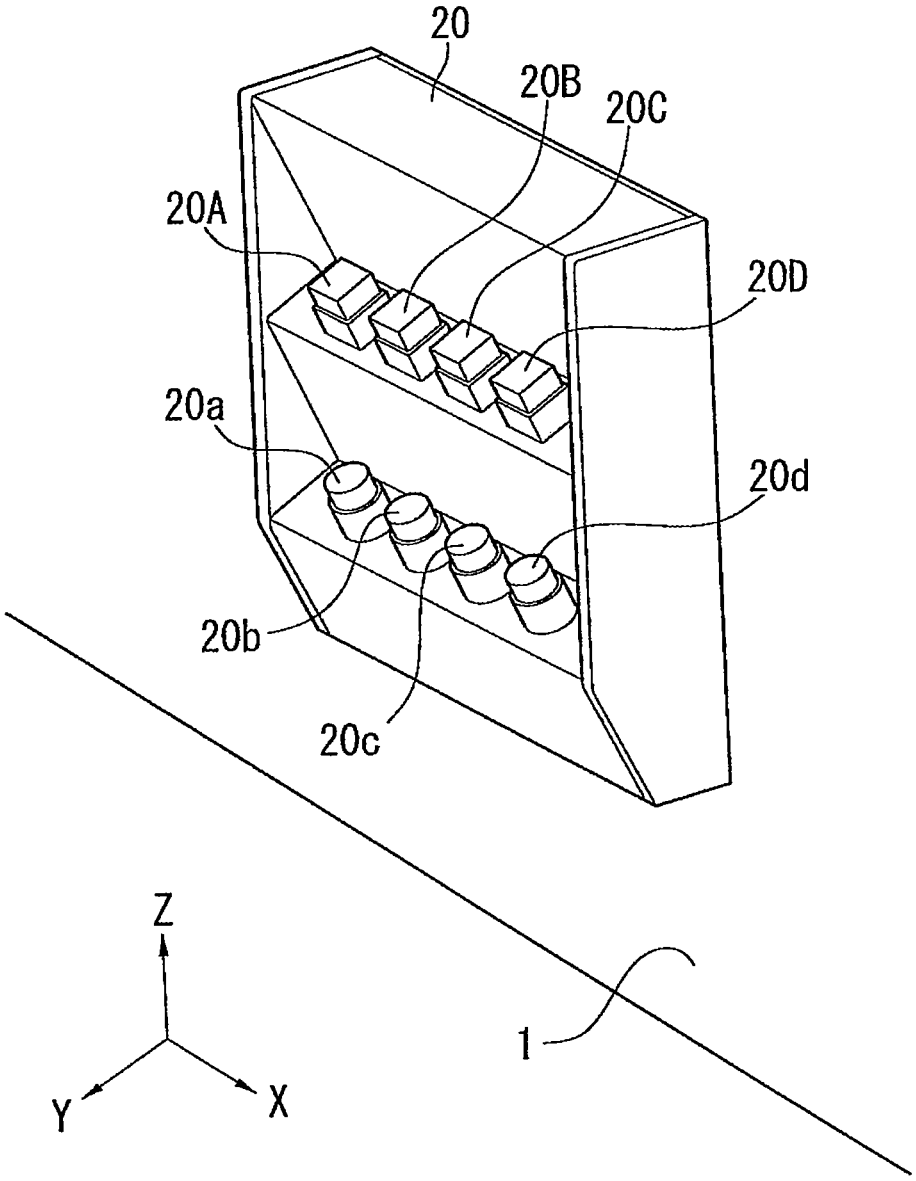
FIG. 26 is a perspective view in the case where the operation panel 20 according to the third invention is formed of a box.
Figure 27:
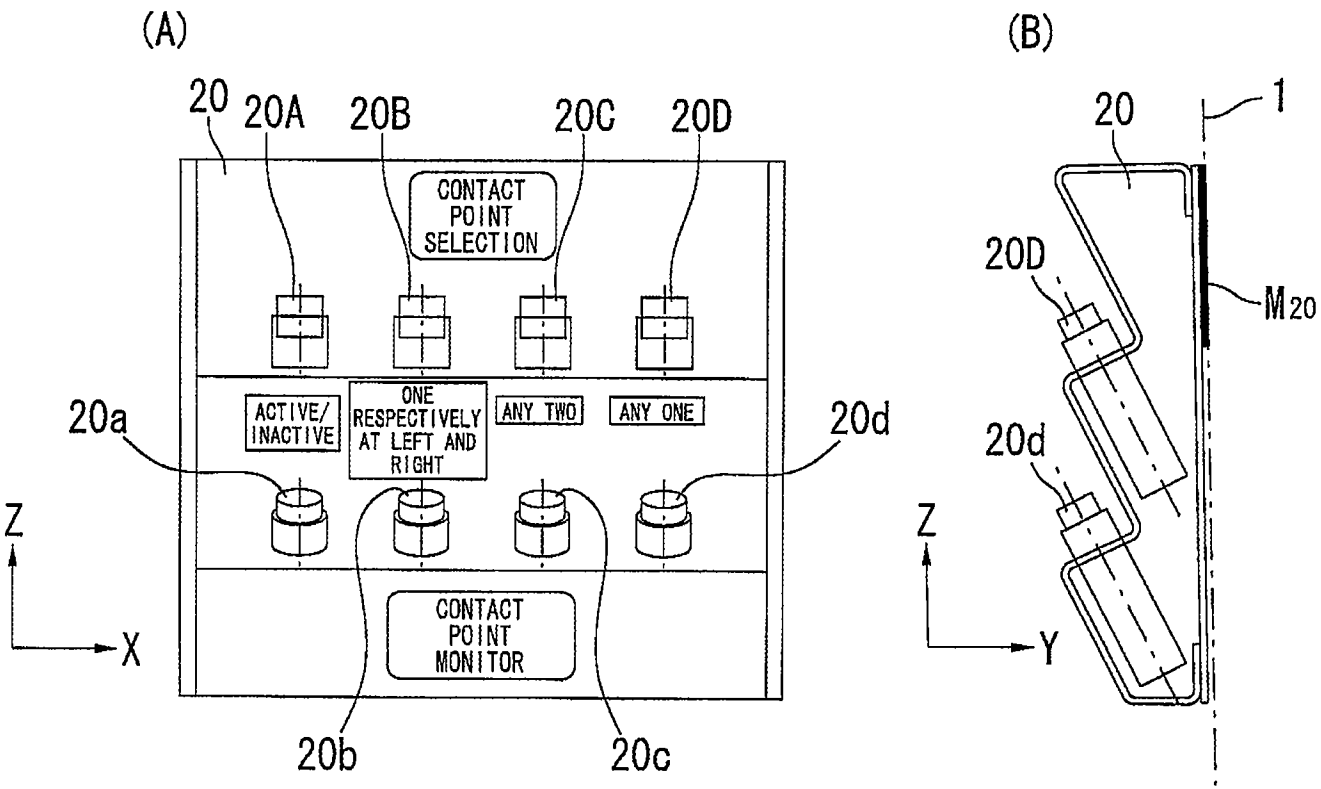
FIG. 27 are an elevation view and a side view of FIG. 26.
Figure 28:
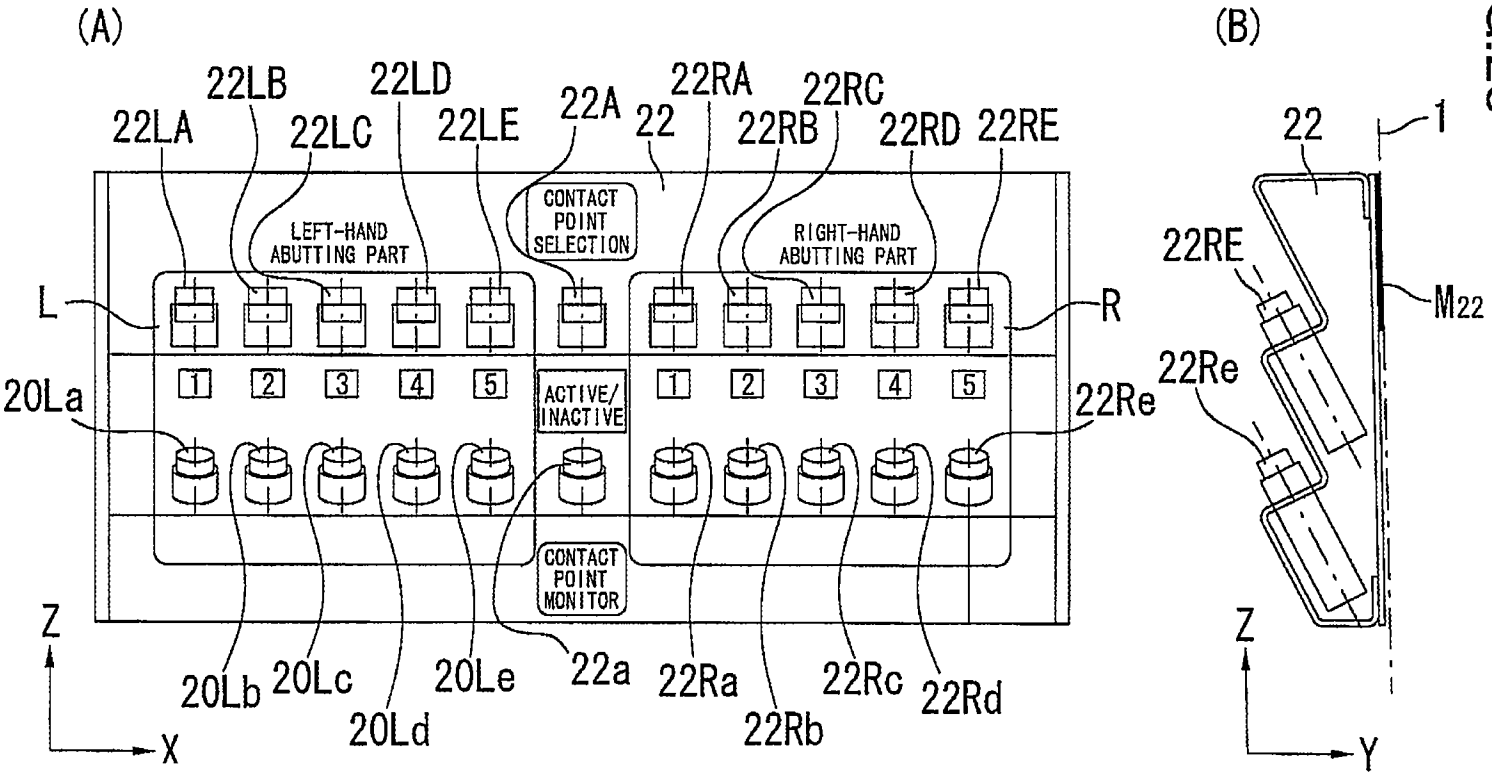
FIG. 28 are an elevation view and a side view illustrating an exemplary embodiment in the case where the operation panel 22 according to the third invention is formed of a box.

FIGS. 26 to 28 are views illustrating an exemplary embodiment in the case where the operation panels 20 and 22 are formed to be box-shaped; and FIGS. 26 and 27 correspond to the already-described FIG. 23, and FIG. 28 corresponds to the already-described FIG. 25.

A box 20 (FIG. 26, FIG. 27), 22 (FIG. 28) has a rectangular parallelepiped shape in its entirety, there are provided on the rear face thereof magnets $M_{20}$ (FIG. 27), $M_{22}$ (FIG. 28), and any box 20, 22 is mounted detachably onto mentioned upper table 1 (FIG. 21) via these Magnets M20, M22.

All "active/inactive" push button switch 20A and the like disposed at the box 20 (FIG. 26, FIG. 27) or 22 (FIG. 28) have a mechanical construction, and each function thereof is exactly the same as in the already-described FIG. 23, 25, thus omitting detailed descriptions.

Furthermore, although with reference to mentioned FIGS. 21 to 28, the operation panel 20, 22 is described as a different one from the conventional operation panel 24B (FIG. 21), by additionally providing the already-described push button switches (FIGS. 23 to 28) and monitor display lamps on the screen 9 of mentioned conventional operation panel 24B, one and the same operation panel can function as both.

Furthermore, by making inputs as shown in FIG. 29 on the screen 9 of the conventional operation panel 20B (FIG. 21), the contact confirmation sensor that has to be ON in the case where a workpiece abutting part is suitably abutted against a back gauge abutting part, can be selected and specified.

FIG. 29(A) is an input method in which in each bending process, letting the number corresponding to "one respectively at left and right" pushbutton switch 20B (FIG. 23) 1, letting the number corresponding to "any two" push button switch 20C (FIG. 23) 2, and letting the number corresponding to "any one" push button switch 20D (FIG. 23) 3, each number is input (number input type).

This input method, due to that a number common to a plurality of contact confirmation sensors $S_1$ to $S_5$ at the left-side and right-side back gauge abutting parts 5 (FIG. 22), is the most simple method, thus enabling to input in a short time period.

FIG. 29(B) is an input method in which in each bending process, numbers corresponding to actual positions of a plurality of contact confirmation sensors $S_1$ to $S_5$ of the left-side and right-side back gauge abutting parts (FIG. 22) are input (1 in the case of being selected and specified, and 0 in the case of not being selected and specified) (arrangement specified type).

For example, in the case of 10000, 00001, the former represents that only the leftmost contact confirmation sensor $S_1$ at the left-side back gauge abutting part 5 (FIG. 22) is selected and specified, and the latter represents that only the rightmost contact confirmation sensor $S_5$ at the right-side back gauge abutting part 5 (FIG. 22) is selected and specified.

This input method is an input method corresponding to the actual position of a plurality of contact confirmation sensors $S_1$ to $S_5$ at the left-side and right-side back gauge abutting parts 5 (FIG. 22), and therefore, fine selection and specification can be made, thus making it extremely easy for an operator to confirm, resulting in less input mistake.

Moreover, selection and specification of a contact confirmation sensor is not made by one operation in each bending process 1, 2, . . . (Step 203 of FIG. 30) before machining, but may be made in each actual bending process.

Hereinafter, operations of the third invention according to the present invention having the above-mentioned construction is described based on FIGS. 30 and 31.

(1) Operation Until Contact Confirmation Sensor is Selected and Specified.

A product information is input in Step 201 of FIG. 30, a bend sequence, die, die layout, D value, L value, workpiece position, and a back gauge position are determined in Step 202, and the contact confirmation sensor necessary for confirming a proper contact state in each bending process (bend sequence) in Step 203.

That is, NC device, when detecting that a product information (for example, CAD information, including the plate thickness of a workpiece, material, the length of a bend line, the bend angle of a product, a flange dimension and the like, which are formed as a stereoscopic profile sketch and a development elevation) has been input, determines a bend sequence, die, die layout and the like, and thereafter displays such an indication as "manually determine a contact confirmation sensor" on, for example, the conventional screen 9 (FIG. 21) with respect to an operator.

The operator having seen this indication, using the already-described operation panel 20 (FIG. 23 and FIG. 27) or 22 (FIG. 25 and FIG. 28), selects and specifies the contact confirmation sensor.

For example, supposing that using the touch panel-type operation panel 20 (FIG. 23), "one respectively at left and right" push button switch 20B is pressed, as described already, not less than one contact confirmation sensor respectively at left and right from the contact confirmation sensors $S_1$ to $S_5$, five at each of the back gauge abutting parts 5 at left and right (FIG. 22).

NC device having detected these selection and specification stores mentioned selected and specified results (FIG. 24) as database.

(2) Operation Until it is Determined Whether or not the Contact Confirmation Sensor Having been Selected and Specified is ON.

Subsequently, after an operator has selected and specified a contact confirmation sensor (Step 203 of FIG. 30), when the foot pedal 6 is ON in Step 204 of FIG. 30, the ram 1 is lowered and stopped at a mute point in Step 205, the back gauge 7 is positioned in a predetermined position in Step 206, a workpiece W is abutted in Step 207, and thereafter it is determined whether or not the contact confirmation sensor having been selected and specified using mentioned operation panel 20 (for example, FIG. 23) is ON in Step 208.

That is, an operator, when the ram 1 (FIG. 21) is lowered and once stopped at a mute point, inserts a workpiece W (FIG. 22) in a gap between a punch P and a die D, and abuts this workpiece W against the back gauge 7 positioned in mentioned predetermined position, thereby positioning this workpiece W.

At that time, NC device determines which push button switch 20B, 20C, 20D of mentioned operation panel 20 (FIG. 23) is pressed, for example, in bending process 1 (Step 208A of FIG. 31).

In this case, as described already, NC device, by searching a stored database (FIG. 24), in the case where, for example, "one respectively at left and right" push button switch 20B is determined to press in bending process 1 (indicated by a left-hand arrow in Step 208A of FIG. 31), supposing that not less than one contact confirmation sensor respectively at left and right is ON, determines that a workpiece is abutted suitably, and regards that positioning of the workpiece W has been completed.

(3) Bending Operation

After positioning of mentioned workpiece w has been completed (YES in Step 208 of FIG. 30), when the foot pedal 6 is ON in Step 209 of FIG. 30, the ram 1 is lowered in Step 210, and bending is made in Step 211; and when the ram has reached a predetermined stroke in Step 212, all the operations are ended (END).

D. Fourth Invention

Figure 32:
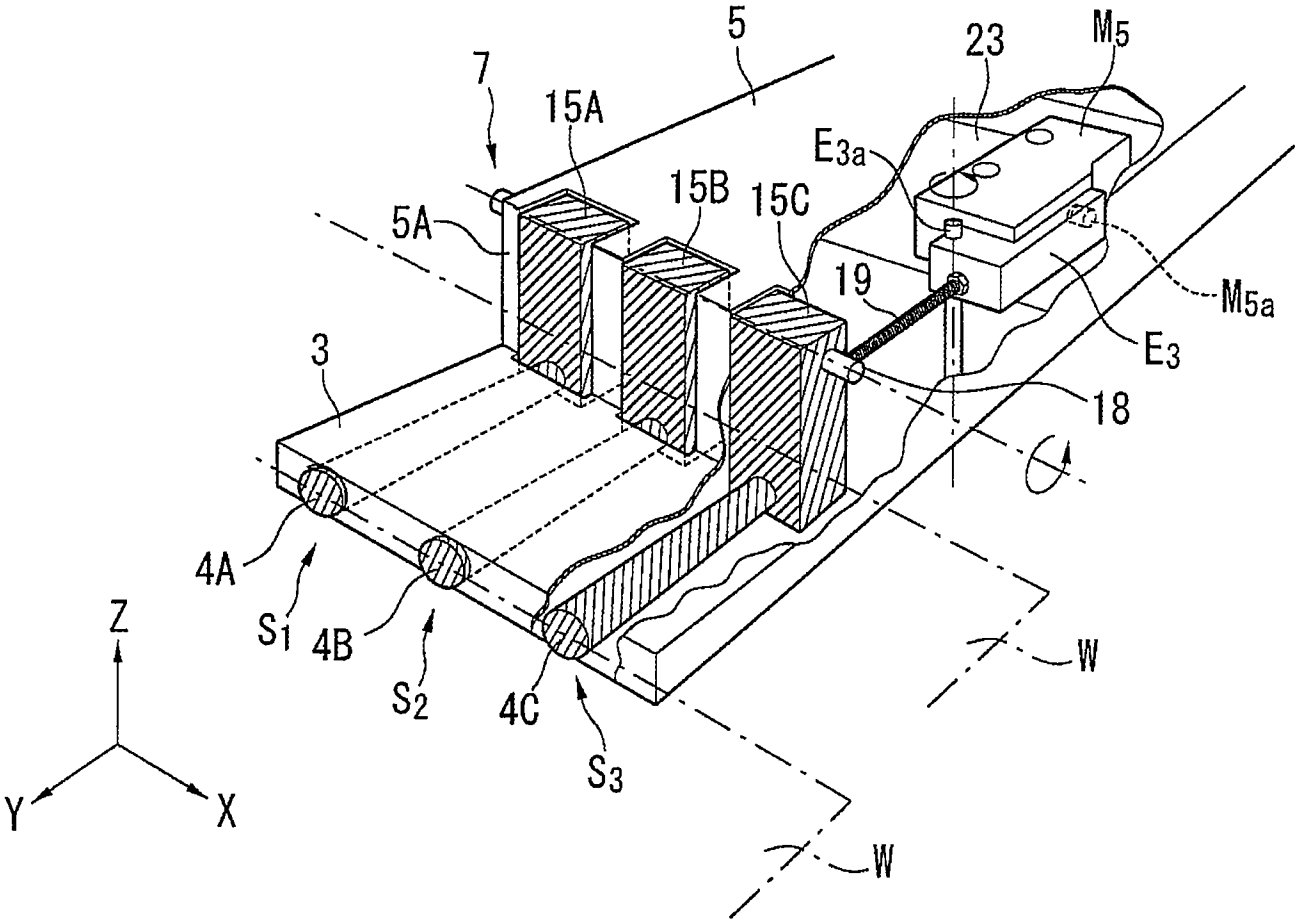
FIG. 32 is a perspective view of contact confirmation sensors $S_1$, $S_2$, $S_3$ according to the fourth invention.

FIG. 32 is a perspective view of contact confirmation sensors $S_1$, $S_2$, $S_3$ according to a fourth invention of the present invention effectively functioning even in the case where a workpiece W is abutted against a workpiece support 3 to be positioned.

There are provided at the lower portion of an abutting face 5A of a back gauge abutting part 5 illustrated a workpiece support 3.

Figure 34:
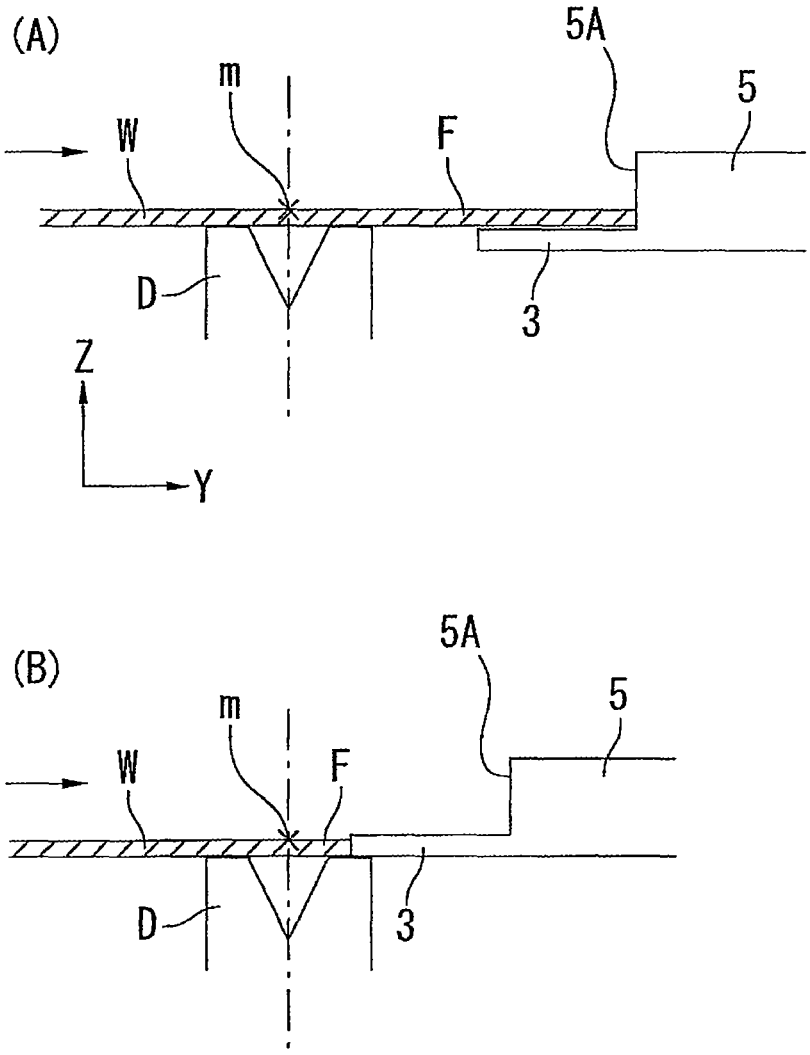
FIG. 34 are diagrams illustrating examples of use of the contact confirmation sensor $S_1$, $S_2$, $S_3$ of FIG. 32.

That is, as illustrated in FIG. 34(A), when a workpiece abutting part F of a workpiece W from a bend line m to a leading end is too long, at the time of the workpiece being abutted, only with the leading end abutted against the abutting face 5A, this workpiece W will be hung down, and thus the workpiece W cannot be positioned.

Accordingly, as illustrated, by provision of a workpiece support 3 supporting a workpiece abutting part F at the lower portion on the abutting face 5A, a workpiece W is abutted against the abutting face 5A of the back gauge abutting part 5 in the state in which the workpiece W is supported with this workpiece support 3, thus preventing the workpiece W from being hung down as described already and enabling the workpiece W to be positioned.

Furthermore, in this workpiece support 3, as illustrated in FIG. 32, pin members 4A to 4C biased by springs are contained, as well as these pin members 4A to 4C are abutted against swing members 15A to 15C.

The above-mentioned pin members 4A to 4C protrude from the front face of the workpiece support 3, and the swing members 15A to 15C protrude from the abutting face 5A a little respectively (for example, 0.2 mm).

Figure 33:
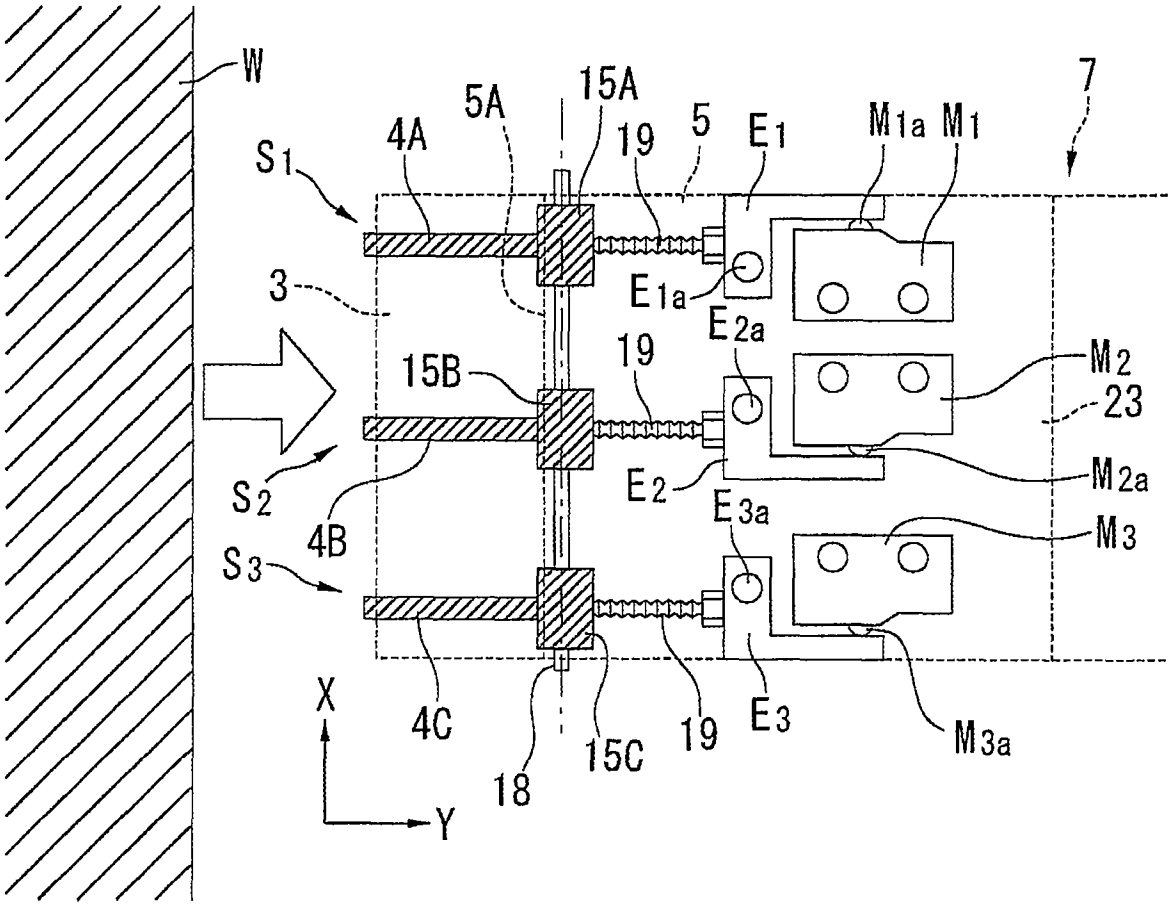
FIG. 33 is a plan view of FIG. 32.

The swing members 15A to 15C are attached in a swingable manner in a vertical plane about a common horizontal pivot shaft 18 in the front of the back gauge abutting part 5, and the rear face of these swing members 15A to 15C are connected to the front face of the below-described stroke enlarging levers $E_1$ to $E_3$ via a bolt 19 (FIG. 33).

The above-mentioned stroke enlarging levers $E_1$ to $E_3$, that is enlarging levers $E_1$ to $E_3$, as well known, have a function to enlarge the stroke of mentioned swing members 15A to 15C by a predetermined amount (paragraph numbers 0041 to 0046 of mentioned U.S. Pat. No. 3,668,895, FIG. 5 (FIG. 5 of the present application), and can be pivoted in a horizontal plane about vertical pivot shafts $E_{1a}$ to $E_{3a}$.

Furthermore, micro switches $M_1$ to $M_3$ are attached to a mount 23 in a workpiece abutting part F, and push buttons $M_{1a}$ to $M_{3a}$ thereof are abutted against the inside of the already-described enlarging levers $E_1$ to $E_3$.

Like this, a plurality of contact confirmation sensors $S_1$, $S_2$, $S_3$ provided at one back gauge abutting part 5 (FIGS. 32 and 33) is constructed of the workpiece support 3 disposed at the back gauge abutting part 5, the pin members 4A to 4C contained in this workpiece support 3, the swing members 15A to 15C abutted against these pin members 4A to 4C, as well as disposed in a swingable manner at the back gauge abutting part 5, the stroke enlarging members $E_1$ to $E_3$ enlarging the stroke of these swing members 15A to 15C by a predetermined amount, and the micro switches $M_1$ to $M_3$ brought in ON when the push buttons $M_{1a}$, to $M_{3a}$ are pressed and moved by the stroke that is enlarged by these stroke enlarging levers $E_1$ to $E_3$.

Owing to such construction, as mentioned above (FIG. 34(A)) in the case where the workpiece abutting part F is long, a workpiece W is abutted against the abutting face 5A of the back gauge abutting part 5 in the state of being supported by the workpiece support 3.

Figure 35:
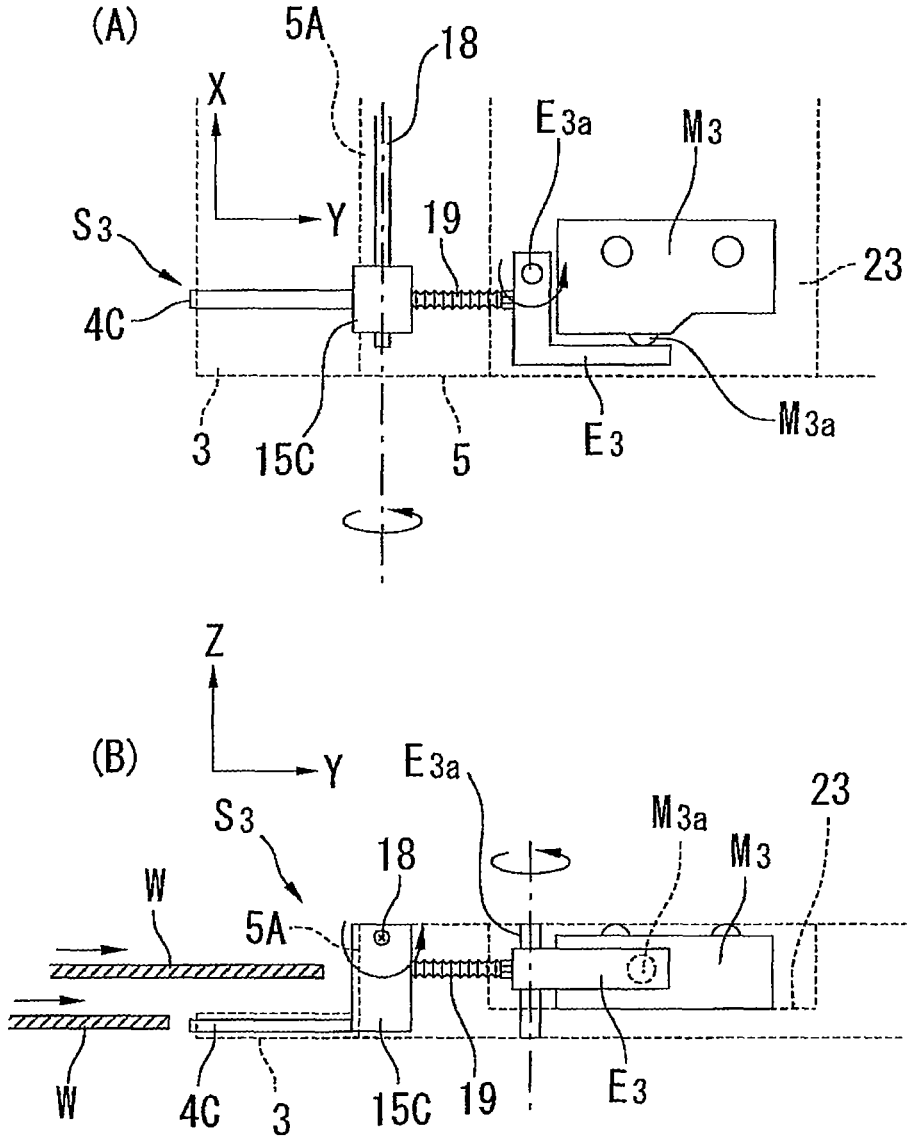
FIG. 35 are operation explanatory views of FIG. 32.

Whereby, as illustrated in FIG. 35(B), for example, the swing member 15C is swung in a vertical plane, and this swing movement is converted into a translatory movement to press the enlarging lever $E_3$, so that this enlarging lever $E_3$ is pivoted in the counterclockwise direction in a horizontal plane (FIG. 35(A)), and the push button $M_{3a}$ is pressed and moved, whereby the micro switch $M_3$ outputs ON signal.

As illustrated in FIG. 34(B), however, in the case where a workpiece abutting part F is short, first, mentioned workpiece support 3 is put on a die D, and then the leading end of a workpiece W is abutted against the front face of this workpiece support 3.

Whereby, as illustrated in FIG. 34(B), for example, the pin member 4A protruding from the front face of the workpiece support 3 is pressed, likewise, the swing member 15C is swung in the vertical plane, and this swing movement is converted into a translatory movement with the bolt 19 to press the enlarging lever $E_3$ so that this enlarging lever $E_3$ is pivoted in the counterclockwise direction in a horizontal plane (FIG. 35(A)), and the push button $M_{3a}$ is pressed and moved, whereby the micro switch $M_3$ outputs ON signal.

The already-described back gauge abutting part 5 at which the contact confirmation sensors according to the present invention are disposed (FIGS. 32 and 33) is formed to be extremely thin as compared with the conventional art (FIG. 3 of U.S. Pat. No. 3,668,895), and to contain the micro switches $M_1$ to $M_5$, these micro switches $M_1$ to $M_3$ are disposed to lie as illustrated (FIGS. 32 and 33).

As a result, the contact confirmation sensor according to the present invention and the conventional contact confirmation sensor (FIG. 3 of U.S. Pat. No. 3,668,895 (FIG. 3 of the present application)) are different in the following points.

That is, in the present invention, the width in the lateral direction (x-axis direction) of the micro switches $M_1$ to $M_3$ comes to be larger, and the number of these contained micro switches $M_1$ to $M_3$ becomes smaller, for example, 3 numbers (five numbers in mentioned conventional art (FIG. 3 of U.S. Pat. No. 3,668,895 (FIG. 3 of the present application)).

Furthermore, in the present invention, the push buttons $M_{1a}$ to $M_{3a}$ of the micro switches $M_1$ $M_3$ are positioned on the side of each of the micro switches $M_1$ to $M_3$, so that the enlarging levers $E_1$ to $E_3$ are formed to be L-shaped, and as described already, pivoted in the horizontal plane, whereby the push buttons $M_{1a}$ to $M_{3a}$ on the side of mentioned micro switches $M_1$ to $M_3$ are pressed and moved (in mentioned conventional art (FIG. 3 of U.S. Pat. No. 3,668,895 (FIG. 3 of the present application)), the push button $M_{5a}$ is positioned in the front, so that e.g., the enlarging lever $E_5$ is in an ordinary rectangular shape, and presses and moves a push button by being swung in the vertical plane).

Industrial Applicability

As described above, the first invention according to the present invention is applicable to the bending method and the machine thereof in which by provision of a plurality of contact confirmation sensors at one back gauge abutting part, based on the contact state between a workpiece abutting part and a back gauge abutting part, the contact confirmation sensor that has to be ON when a workpiece is abutted is determined, on the conditions of ON of all these contact confirmation sensors having been determined and ON of a foot pedal, and a ram is driven to make bending of the workpiece; the second invention according to the present invention is applicable to the bending method and the machine thereof in which after a workpiece has been positioned, when the back gauge abutting part is reversed after a punch has been contacted with the workpiece, based on ON/OFF states of the contact confirmation sensor disposed at the back gauge abutting part, a defective signal and a non-defective signal are output; the third invention according to the present invention is applicable to the bending machine including an operation panel formed of push button switches with which a contact confirmation sensor necessary for confirming the suitable contact state between a workpiece abutting part and a back gauge abutting part is selected and specified out of a plurality of contact confirmation sensors provided at back gauge abutting part; and the fourth invention according to the present invention is applicable to the bending machine including a contact confirmation sensor formed of a pin member contained in a workpiece support disposed at a back gauge abutting part, a swing member, and a micro switch brought in ON via a stroke enlarging lever, respectively.

Furthermore, the first to fourth inventions according to the present invention are applied not only to a lifting-down type press brake, but also a lifting-up type press brake, and are extremely useful in either case.

The invention claimed is:

1. A bending method, comprising:

identifying a die, a die layout, a position of a workpiece, a position of a back gauge, and a shape of an abutting part of the workpiece with respect to the back gauge based on product information, wherein the back gauge includes a plurality of abutting portions, each of the abutting portions includes a plurality of contact confirmation sensors, and the plurality of abutting portions are horizontally arranged in a direction that is the same as a direction in which the plurality of contact confirmation sensors are arranged;

selecting at least one contact confirmation sensor from the plurality of contact confirmation sensors of at least one abutting portion of the plurality of abutting portions of the back gauge, based on a contact state between the abutting part of the workpiece and the at least one abutting portion of the back gauge, wherein the selected at least one contact confirmation sensor has to be ON when the workpiece abuts the back gauge; and driving a ram to bend the workpiece upon determining that all of the selected at least one contact confirmation sensor is ON and a foot pedal is ON.

2. The bending method according to claim 1, the driving a ram further comprising:

initially lowering the ram to a point when the foot pedal is ON, after selecting the at least one contact confirmation sensor from the plurality of contact confirmation sensors provided at the at least one abutting portion of the back gauge;

abutting the workpiece against the back gauge and a side gauge after initially lowering the ram;

determining that all of the selected at least one contact confirmation sensor is ON, and again lowering the ram to bend the workpiece when all of the selected at least one contact confirmation sensor is ON and the foot pedal is ON.

3. The bending method according to claim 1, further comprising:

displaying, on an operation screen, a status of the selected at least one contact confirmation sensor and a contact state between the abutting part of the workpiece and the plurality of abutting portions of the back gauge, so that an ON status of the selected at least one contact confirmation sensor can be confirmed on the operation screen by a viewer reviewing the contact state.

4. The bending method according to claim 3, further comprising:

displaying, on the operation screen, the shape of an abutting part of the workpiece with respect to the plurality of confirmation contact switches on the abutting portions of the back gauge, displaying, on the operation screen, the selected at least one contact confirmation sensor that has to be ON when the workpiece is abutted, in a color different from a color of the contact confirmation sensor that is not selected; and displaying the selected at least one contact confirmation sensor flickering, when the workpiece is abutted to the selected at least one contact confirmation sensor.

5. The bending method according to claim 1, further comprising:

displaying, on an operation screen, the plurality of contact confirmation sensors; and specifying, on the operation screen, the at least one contact confirmation sensor to select.

6. A bending machine, comprising:

a plurality of contact confirmation sensors provided at each of a plurality of abutting portions of a back gauge for confirming contact of the plurality of abutting portions of the back gauge with a workpiece, the plurality of abutting portions being horizontally arranged in a direction that is the same as a direction in which the plurality of contact confirmation sensors are arranged; and a controller that selects at least one contact information sensor from the plurality of contact information sensors of at least one abutting portion of the plurality of abutting portions of the back gauge, and drives a ram upon a determination that all of the selected at least one contact confirmation sensor of the plurality of contact confirmation sensors of the at least one abutting portion is ON and a foot pedal is ON, when the workpiece abuts the abutting part of the back gauge, wherein the selected at least one contact confirmation sensor is automatically or manually selected prior to the controller driving the ram.

7. A bending machine, comprising:

a plurality of contact confirmation sensors provided at each of a plurality of abutting portions of a back gauge, the plurality of abutting portions are horizontally arranged in a direction that is the same as a direction in which the plurality of contact confirmation sensors are arranged;

a bend sequence identifier that identifies a die, a die layout, a position of a workpiece, and a position of a back gauge based on product information;

a contact confirmation sensor determiner that determines a shape of an abutting part of the workpiece with respect to the back gauge, based on product information, and that selects at least one contact confirmation sensor from the plurality of contact confirmation sensors of at least one abutting portion of the plurality of abutting portions of the back gauge based on a contact state between the abutting part of the workpiece and the at least one abutting portion of the back gauge, wherein the selected at least one contact confirmation sensor has to be ON when the workpiece abuts the back gauge; and a ram controller that drives a ram when all of the selected at least one contact confirmation sensor is ON and a foot pedal is ON.

8. The bending machine according to claim 7, wherein each of the plurality of contact confirmation sensors comprises:

a workpiece-abutting part against which the workpiece is abutted;

a stroke increasing lever that increases a stroke of the workpiece-abutting part by a predetermined amount; and a micro switch that is turned ON when a push button is pressed and moved by the stroke increased by the stroke increasing lever.

9. The bending machine according to claim 7, wherein the contact confirmation sensor determiner selects at least one of the plurality of contact confirmation sensors of each abutting portion.

10. The bending machine according to claim 7, wherein a contact area of one of the plurality of contact confirmation sensors is greater than a contact area of an other of the plurality of contact confirmation sensors.

* * * * *